US006652062B2

(12) United States Patent
Umeyama et al.

(10) Patent No.: US 6,652,062 B2
(45) Date of Patent: Nov. 25, 2003

(54) LIQUID DISCHARGE RECORDING HEAD WITH ORIFICE PLATE HAVING EXTENDED PORTION FIXED TO RECORDING HEAD MAIN BODY, LIQUID DISCHARGE RECORDING APPARATUS HAVING SUCH HEAD, AND METHOD FOR MANUFACTURING SUCH HEAD

(75) Inventors: Mikiya Umeyama, Tokyo (JP); Yutaka Koizumi, Yokohama (JP); Yukuo Yamaguchi, Tokyo (JP); Hideo Fukazawa, Chigasaki (JP); Hiroki Tajima, Yokohama (JP); Nobuyuki Hatasa, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 252 days.

(21) Appl. No.: 09/818,561

(22) Filed: Mar. 28, 2001

(65) Prior Publication Data

US 2002/0012021 A1 Jan. 31, 2002

(30) Foreign Application Priority Data

| | | |
|---|---|---|
| Mar. 31, 2000 | (JP) | 2000-098126 |
| Mar. 31, 2000 | (JP) | 2000-098669 |
| Mar. 31, 2000 | (JP) | 2000-098671 |
| Mar. 31, 2000 | (JP) | 2000-098851 |

(51) Int. Cl.[7] ..... B41J 2/015; B41J 2/14; B41J 2/16; B41J 2/165

(52) U.S. Cl. ..... 347/20; 347/47; 347/33

(58) Field of Search ..... 347/20, 44, 47, 347/33, 56, 67, 63, 65

(56) References Cited

U.S. PATENT DOCUMENTS

| | | | | |
|---|---|---|---|---|
| 5,059,973 A | * | 10/1991 | Watanabe | 347/56 |
| 5,374,948 A | * | 12/1994 | Saito et al. | 347/47 |
| 5,534,898 A | | 7/1996 | Kashino et al. | 347/33 |
| 5,548,894 A | * | 8/1996 | Muto | 347/47 |
| 6,017,110 A | | 1/2000 | Jackson | 347/33 |
| 6,168,254 B1 | | 1/2001 | Karita et al. | 347/20 |

FOREIGN PATENT DOCUMENTS

| | | | |
|---|---|---|---|
| EP | 0 352 468 A2 | 1/1990 | B41J/2/16 |
| EP | 0 564 072 A2 | 10/1993 | B41J/2/16 |
| EP | 0 581 553 | 2/1994 | B41J/2/165 |
| JP | 2000-098126 | 3/2000 | G02B/5/20 |
| JP | 2000-098669 | 3/2000 | G03G/15/00 |
| JP | 2000-098671 | 3/2000 | G03G/15/00 |
| JP | 2000-098851 | 3/2000 | G03G/21/14 |

* cited by examiner

*Primary Examiner*—Juanita Stephens
(74) *Attorney, Agent, or Firm*—Fitzpatrick, Cella, Harper & Scinto

(57) ABSTRACT

A liquid discharge recording head comprising a recording head main body provided with a plurality of liquid flow paths communicated with a plurality of discharge ports for discharging liquid, respectively, and energy generating means for generating energy utilized for discharging the liquid filled in the liquid flow paths from the discharge ports, and an orifice plate provided with a discharge port array having the plurality of discharge ports aligned in one straight line, and bonded to the front face of the recording head main body having openings of the plurality of discharge ports formed therefor, wherein the orifice plate is provided with the extended portion in the alignment direction of the discharge port array or in the direction orthogonal to the alignment direction, being extended more than the width of the front face of the recording head main body, and the extended portion is fixed to the adjacent face of the front face of the recording head main body.

29 Claims, 48 Drawing Sheets

LIQUID DISCHARGE RECORDING HEAD WITH ORIFICE PLATE HAVING EXTENDED PORTION FIXED TO RECORDING HEAD MAIN BODY, LIQUID DISCHARGE RECORDING APPARATUS HAVING SUCH HEAD, AND METHOD FOR MANUFACTURING SUCH HEAD

BACKGROUND OF THE INVENTION

1. Field of the Invention

The present invention relates to a liquid discharge recording head for recording on a recording medium by discharging ink from the discharge port group provided for an orifice plate. The invention also relates to a method of manufacture therefor.

2. Related Background Art

A liquid discharge recording apparatus is such that, for example, ink is supplied to a liquid discharge recording head, and by driving ink droplet discharging means, such as piezoelectric elements or electrothermal converting elements provided for a liquid discharge recording head, in accordance with image data in order to form images on a recording sheet or some other recording medium by means of ink dot patterns. The ink discharge recording apparatus that performs recording by discharging ink from the discharge ports of the liquid discharge recording head is known as a recording apparatus having such excellent advantages as a lesser amount of noises, a capability of recording at high speed, among some others.

FIG. 67 is a perspective view which shows the conventional liquid discharge recording head in a state of partially broken in representation, and also, in a state where the orifice plate is separated. FIG. 68 is a perspective view which shows the liquid discharge recording head represented in FIG. 67 in a state where the orifice plate is bonded to it.

For the conventional liquid discharge recording head 315 of the kind, a heater board 301, having electrothermal converting elements (discharge heaters 301*a*) which are the elements that generate energy for discharging ink, and wiring for supplying electric power to the discharge heaters 301*a* formed on a silicon base plate using silicon film formation process, is set by means of die bonding on a supporting base (base plate 304) formed by aluminum, ceramics, or the like. The base plate 304 also functions as the heat sink that radiates heat generated on the heater board 301 along with the driving of discharge heaters 301*a* and cools it.

On the heater board 301, there is arranged the ceiling plate 305 that forms ink flow paths. The ceiling plate 305 is provided with the nozzles 307 which constitute ink flow paths communicated with the discharge ports 306*a* of the orifice plate 306 formed in a recess on the bottom face of the ceiling plate 305; the common liquid chamber 308 which serves as a sub-tank for supplying ink to the nozzles 307 each formed in a recess on the bottom face of the ceiling plate 305; and the ink supply port 309 through ink is supplied to the common liquid chamber 308.

Further, on the base plate 304, a chip tank 311 to form ink passage 311*a* to guide ink to the ink supply port 309 from an ink storage tank, or sub-tank, or the like (not shown) arranged on the upstream side of the liquid discharge recording head 315 in the ink flow direction.

A front plate portion 311*b* is formed on the surface to which the nozzles 307 of the chip tank 311 is open. The front plate portion 311*b* functions to bond and hold the orifice plate 306 having the discharge ports 306*a* open at the same intervals as those between nozzles 307 themselves on the circumferential area of the discharge ports 306*a*, and also, functions to support the orifice plate 306 so as to enable the orifice plate 306 to withstand sufficiently against the force exerted by the time of attachment or detachment, and the holding pressure exerted by the cap member (not shown) arranged for the recording apparatus main body at the time of capping operation.

Here, in the specification hereof, the structure of liquid discharge recording head which is in a state that the orifice plate is removed is called "recording head main body".

In this respect, the ceiling plate 305 is formed by resin, such as polysulfone, polyether sulfone, polypropylene, denatured polyphenylene oxide, polyphenylene sulphide, or liquid crystal polymer or formed by such material as ceramics, silicon, nickel, or carbon.

Also, the orifice plate 306 is formed by metallic plate, such as SUS (stainless steel), Ni, Cr, or Al, or a resin mold, resin film material, or the like, such as polyimide, polysulfone, polyether sulfone, polyphenylene oxide, polyphenylene sulfide, or polypropylene, or further, formed by silicon, ceramics, or the like.

Now, the description will be made of the outline of assembling process of the liquid discharge recording head.

At first, the discharge heaters 301*a* on the heater board 301 set on the base plate 304 and the nozzles 307 of the ceiling plate 305 which is arranged relatively therefor are aligned to be in agreement in high precision, and using bonding means such as bonding agent or pressure means such as pressure spring (not shown) the heater board 301 and the ceiling plate 305 are kept closely in contact for the formation of ink flow paths.

Then, the chip tank 311 is incorporated on the base plate 304 to connect the ink supply port 309 of ceiling plate 305 with the ink passage 311*a* of chip tank 311. At this juncture, the front plate portion 311*b* of chip tank 311 covers the front end of heater board 301*b* that forms the edge faces of ink flow paths, and the outer side of front end of ceiling plate 305*b* as well. In this respect, the edge faces of ink flow paths 301*b* and 305*b* are structured to protrude from the surface of front plate portion 311*b* by several tens of $\mu$m to several hundreds of $\mu$m approximately.

Next, the orifice plate 306 is bonded by use of bonding agent or some other bonding means to the edge faces of ink flow paths 301*b* and 305*b* which are formed to protrude by the heater board 301 and the ceiling plate 305. At this juncture, the surface of the front plate portion 311*b* is formed to be retracted from the ink flow path edge faces 301*b* and 305*b* as described earlier so as not to impede bonding of the orifice plate 306 and the ink flow edge faces 301*b* and 305*b*.

Then, in the last process that follows, bonding agent or sealant is poured into the gap (the stepped portion of several tens of $\mu$m to several hundreds of $\mu$m between the front plate portion 311*b* and the ink flow path edge faces 301*b* and 305*b*) formed between the area where no discharge ports 306*a* are arranged on the backside of the orifice plate 306 and the front plate portion 311*b*, thus completing the bonding of orifice plate 306.

In this way, the assembling process of the liquid discharge recording head 315 is completed.

Also, as another conventional liquid discharge recording head, there exists the structure in which, as shown in FIG. 69, the central portion of front face of an orifice cover 312 is removed, and additionally arranged to cover only four sides of orifice plate 306.

In a general case where a liquid discharge recording head is structured so that the orifice plate is bonded to the opening face of liquid flow paths (nozzles) of a recording head, the ink discharge face is cleaned by the wiping operation of recovery device as shown in FIG. 70, and then, as in the wiping operation b shown in FIG. 70, the edge portion of the wiping blade 321 is in contact with the orifice plate edge portion 306*c* as if to draw it. As a result, the orifice plate 306 is liable to be peeled off from the recording head 315 at the edge portion 306*c*. Also, the leading end of the wiping blade 321 slidably rubs the facing end 306*b* of the orifice plate 306. As a result, there is a possibility that peeling off occurs at the edge portion of the orifice plate other than the edge portion at 306*c* by the repetition of wiping operation.

If the edge portion of orifice plate should be peeled off even slightly, it advances further by repetition of wiping operations to follow, and the recording head is damaged beyond recovery ultimately. In order to avoid such problem as this, the structure is arranged as shown in FIG. 69 to provide an orifice cover 312 to cover the four sides of an orifice plate 306. With this structure, however, the area where capping means is allowed to abut against for suction recovery becomes relatively narrower. As a result, there is a need for the use of highly precise component as capping means in order to make the capping operation more accurately. Then, if it is intended to make the area larger where capping means abuts against in such structure having the additional orifice cover 312 as it is, the recording head components should become relatively larger to increase both costs and the area occupied by the recording apparatus as a whole which is made larger after all.

Further, the structure in which the orifice cover 312 is added creates a step between the orifice cover 312 and the orifice plate 306. As a result, remaining liquid on the orifice plate 306 tends to form a pool on the corners of such step when wiping is performed by use of the blade 321 or there is a fear that uneven wiping takes place due to the insufficient contact which is caused by the vibration or jump over of the blade 321. Furthermore, there is a possibility that the blade 321 is damaged due to the one-sided contact of the blade 321 with the step between the orifice cover 312 and orifice plate 306. Thus, this structure presents the problem of reliability, too.

Also, the structure that does not use any orifice cover may make it possible to design a method for regulating the slidably rubbing area between the wiping blade and the face of the orifice plate by making the movable range of the wiping blade narrower so that the wiping blade is not hooked by the edge portion of the orifice plate. In this method, however, it is firstly needed to arrange the structure so that the wiping blade is made detractable from the face of orifice plate, which makes the costs of wiping device higher inevitably. Secondly, this structure brings about such unfavorable condition as to return dust particles (such as dust, powdered paper, paper fluffs) or excessively viscous ink (ink the volatile component of which has been evaporated), which are collected by the rubbing face of blade by wiping and adhere to it, onto the face of the orifice plate. In other words, there is a fear that the dust particles or excessively viscous ink collected by the rubbing face of the blade by wiping and adhere to it are transferred and returned to the face of the orifice plate when the wiping blade is retracted or rubbed again to adhere to the face of orifice plate.

As described above, the method that uses the orifice cover or the method for regulating the area where the wiping blade and face of orifice plate are slidably rubbed each other is not very advisable.

SUMMARY OF THE INVENTION

With a view to solving the problems discussed above, the present invention is designed. It is an object of the invention to provide a liquid discharge head capable of preventing the orifice plate from being peeled off due to wiping operation without adopting the method that uses the orifice cover or the method that regulates the area where the wiping blade and the face of orifice plate are slidably rubbed each other.

In order to achieve the object described above, the liquid discharge recording head of the present invention comprises a recording head main body provided with a plurality of liquid flow paths communicated with a plurality of discharge ports for discharging liquid, respectively, and energy generating means for generating energy utilized for discharging the liquid filled in the liquid flow paths from the discharge ports; and an orifice plate provided with discharge port array having the plurality of a discharge port aligned in one straight line, and bonded to the front face of the recording head main body having openings of the plurality of discharge ports formed therefor. For the liquid discharge recording head thus structured, the orifice plate is provided with the extended portion in the alignment direction of the discharge port array or in the direction orthogonal to the alignment direction, being extended more than the width of the front face of the recording head main body, and the extended portion is fixed to the adjacent face of the front face of the recording head main body.

In accordance with the present invention, the orifice plate is fixed not only to the front face of recording head, but also, to the two face adjacent thereto. With the increased number of fixing faces of orifice plate to the recording head, the fixing strength is enhanced. Therefore, it becomes possible to prevent the edge portion of orifice plate from being peeled off by use of the wiping blade.

Further, in accordance with the liquid discharge recording head of the present invention, the orifice plate is structured to be folded along the edge face on the front side of recording head, and provided with the area almost the same as that of front face of recording head. Therefore, it becomes possible to arrange the structure to enable the orifice plate to cover substantially the front face of recording head. Thus, as compared with the structure in which an orifice cover is provided to cover the circumference of an orifice plate, it becomes possible to obtain a wider capping area. As a result, the suction recovery operation can be performed more reliably without using complicated capping mechanism to make it possible to suppress and keep the lower costs of recording apparatus.

Further, the entire front face of orifice plate is made flat and smooth to make it possible to reduce remaining liquid or wiping unevenness significantly when the wiping operation is carried out by use of the blade. Also, with the flat wiping face, it becomes possible to reduce the damages that may be caused to the blade, and enhance the reliability of the blade as well.

With these functions, the freedom of designing recording head is increased to be able to promote making the recording head and the recording apparatus itself smaller and reducing the costs of manufacture thereof. Also, it becomes possible to provide the liquid discharge recording head the life of which is implemented to be longer.

The method of the present invention for manufacturing a liquid discharge recording head, which is provided with a recording head main body having a plurality of liquid flow paths aligned in one straight line and communicated with a plurality of discharge ports for discharging liquid, respectively, and energy generating means for generating energy utilized for discharging the liquid filled in the liquid flow paths from the discharge ports; and an orifice plate provided with a discharge port array having the plurality of discharge ports aligned in one straight line, and bonded to the front face of the recording head main body having openings of the plurality of discharge ports formed therefor, the orifice plate being provided with the extended portion in the alignment direction of the discharge port array or in the direction orthogonal to the alignment direction, being extended more than the width of the front face of the recording head main body, and the extended portion being fixed to the adjacent face of the front face of the recording head main body, comprises the steps of bonding the orifice plate to the recording head main body with the positioning of the discharge port array to the liquid flow path array; folding the extended portion of the orifice plate along ridge lines formed by the front face of the recording head main body and the face adjacent to the front face; and fixing the extended portion to the front face of the recording head main body and the adjacent face.

Further, in this respect, it may be possible to arrange the structure in which the step of fixing the extended portion to the front face of the recording head main body and the adjacent face comprises a step of fixing the extended portion to the face adjacent to the front face by putting the extend portion between a fixing member for the extended portion to be fixed thereon, and the face adjacent to the front face.

DETAILED DESCRIPTION OF THE PREFERRED EMBODIMENTS

Now, hereinafter, with reference to the accompanying drawings, the description will be made of the embodiments in accordance with the present invention.

First Embodiment

Figure 1:
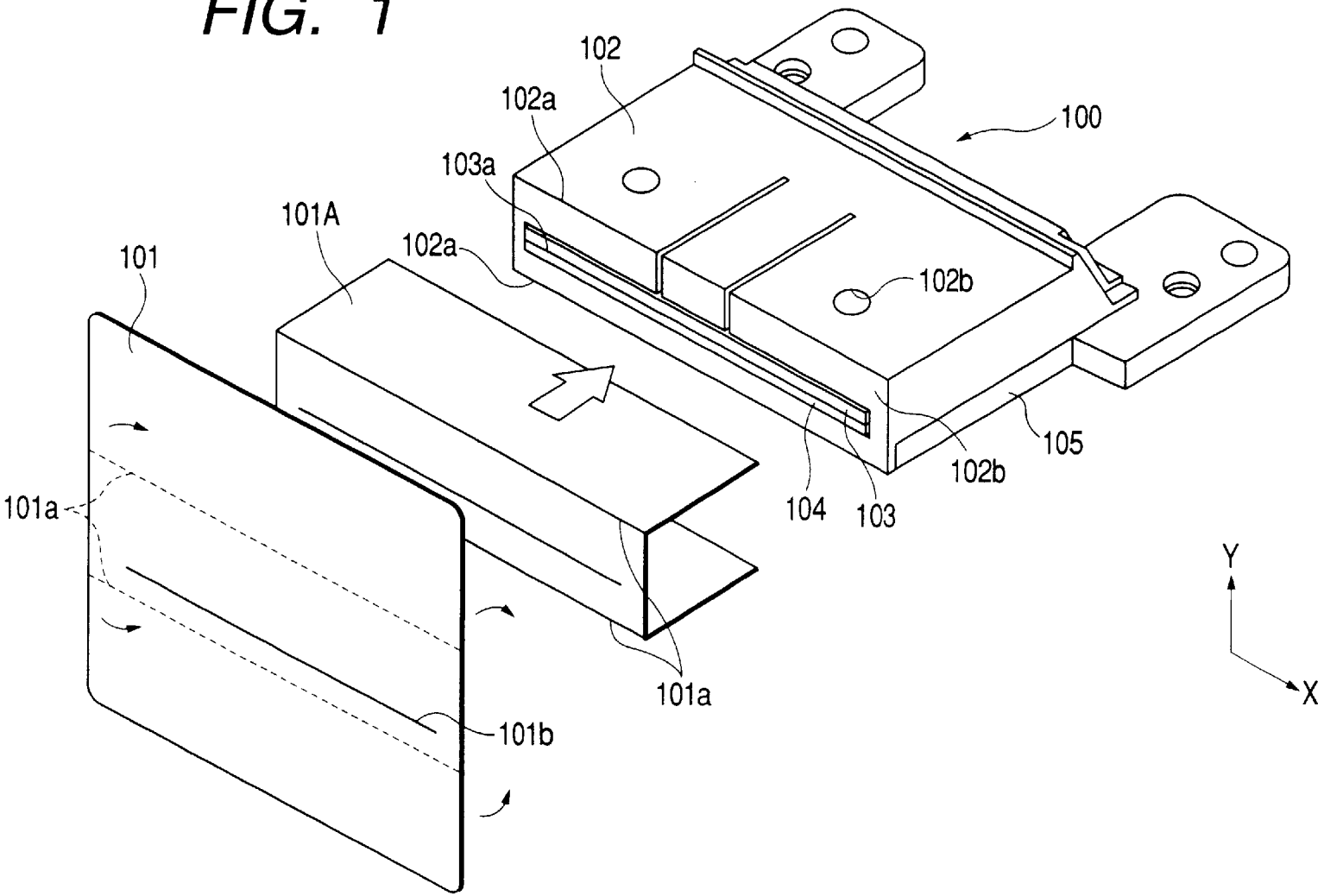
FIG. 1 is an exploded perspective view which shows a liquid discharge recording head in accordance with a first embodiment of the present invention in a state where the orifice plate thereof is separated.

FIG. 1 is an exploded perspective view which shows the liquid discharge recording head in accordance with a first embodiment of the present invention in the state where the orifice plate is separated. Here, in FIG. 1, the orifice plate 101 in a flat form before being folded and the orifice plate 101A after having been folded are shown simultaneously. In this respect, the liquid discharge recording head 100 of the present embodiment is structured almost the same way as the structure illustrated with reference to FIG. 15 with the exception of that of the orifice plate. Therefore, the detailed description thereof will be omitted.

At first, the description will be made of the structure of the orifice plate 101, and the process for bonding the orifice plate 101 to the recording head main body 100 as well.

For the orifice plate 101 of the present embodiment, an extended portion is formed in a length larger than the thickness (in the direction Y in FIG. 1) of the front plate portion 102*b* in the direction orthogonal to the arrangement direction of the discharge port array 101*b*. As a result, the orifice plate 101 is structured to be provided with the connecting faces to the surface of the chip tank 102 and the surface of the base plate 105, that is, the two faces adjacent to the nozzle opening surface of the recording head main body 100, besides the connecting face to the nozzle opening face (front plate portion 102*b*) of the recording head main body 100.

Then, the description will be made of the process for bonding the orifice plate 101 to the recording head main body 100.

At first, the ceiling plate 103 and the heater board 104 are closely in contact for formation, and the discharge port array 101*b* formed for the orifice plate 101 is positioned to the nozzle line 103*a* protruded from the surface of the front plate portion 102*b* and fixed by fixing means such as bonding agent. Then, bonding agent or sealant is poured into the gap between the area around the discharge port array 101*b* on the backside of the orifice plate 101 and the front plate portion 102*b*.

Further, the orifice plate 101 is folded along the ridge lines 102*a* of the front plat portion 102*b* of the chip tank 102. At this juncture, the orifice plate 101 is folded to the surface side (chip tank 102 side) and the backside (base plate 105 side) of the recording head main body 100 at the folding lines 101*a* that correspond to the ridge lines 102*a* of the front plate portion 102*b* as indicated at a reference numeral 101A.

Figure 2:
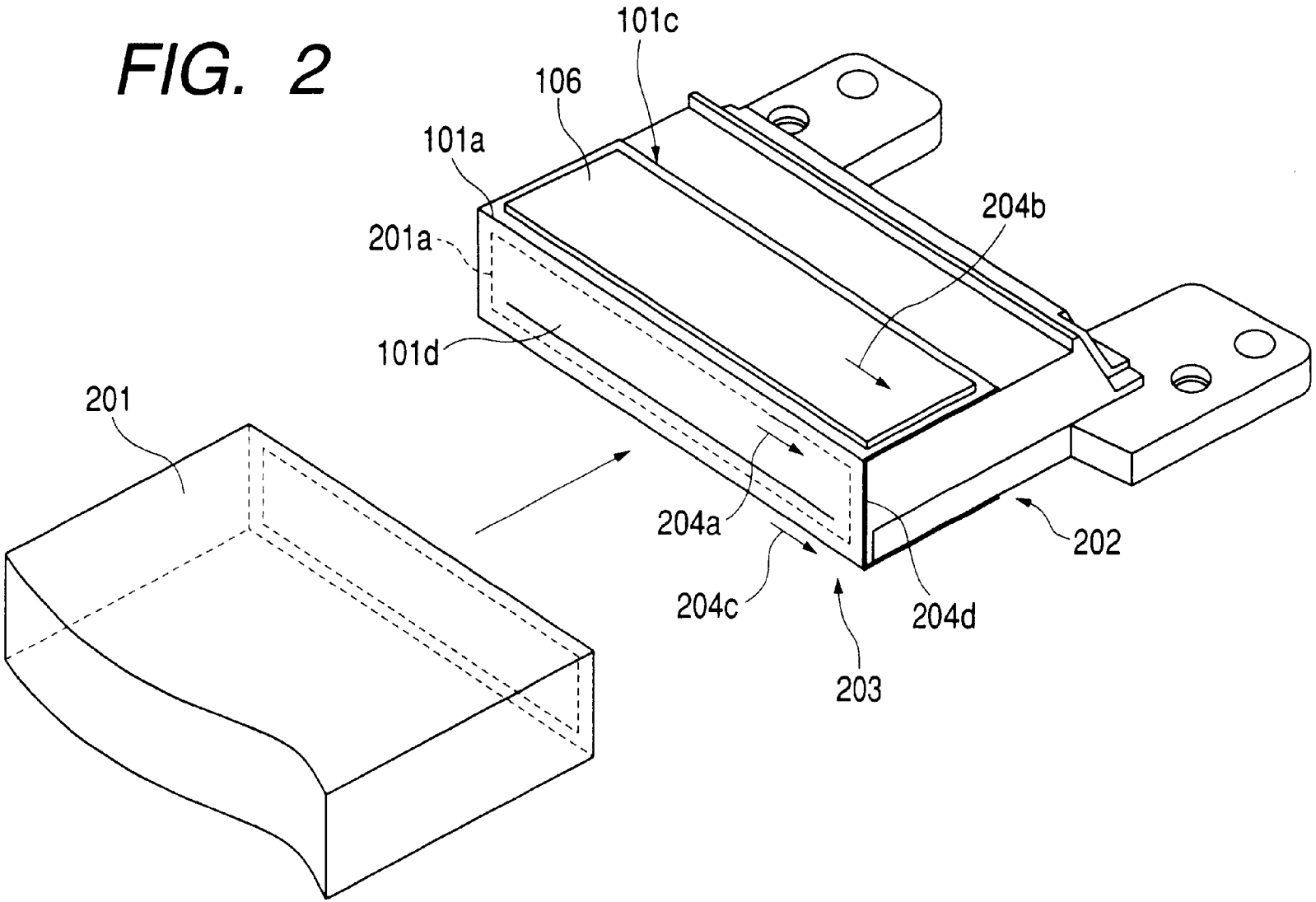
FIG. 2 is a perspective view which shows the liquid discharge recording head represented in FIG. 1 in a state where the extended portion of the orifice plate is fixed to the recording head.

Then, the folded portions of the orifice plate 101A (that is, the extended portions thereof) are, as shown in FIG. 2, fixed by means of the pressure plate 106 to the surface and backside of the recording head main body 100.

The procedure of holding the orifice plate 101 may be such that the orifice plate 101 is positioned to the nozzle array 103*a* and bonded, and then, folded as in the case of present embodiment or such that after the orifice plate 101 is folded in advance along the folding lines 110*a*, it may be positioned and bonded to the nozzle array 103*a* for fixation. In the former case, it is possible to fold the orifice plate 101 along the ridge lines 102*a* of an actual recording read main body with the advantage that even when individual difference is large in the dimension of the recording head main body, there is a room to deal therewith. In the latter case, folding is possible more assuredly with the advantage that the folding lines 110*a* of the orifice plate can be secured firmly. Also, in the former case, thinner resin film, metallic plate, or the like that has a weaker bending strength so as to be easily folded is suitable as the material of the orifice plate 101, and in the latter case, the one having larger bending strength is suitable. Therefore, it is necessary to select material and configuration appropriately for the orifice plate 101 before deciding on which one of procedures is adopted for the folding process.

Also, in the process of pouring bonding agent or sealant into the gap between the area around the discharge port array 101*b* on the backside of the orifice plate 101 and the front plate portion 102*b*, it may be possible to execute this pouring process after the folded portion, that is, the extended portion, is fixed to the surface and backside of the recording head 100 subsequent to the orifice plate 101 having been folded. Besides, if there is some other process in which bonding agent should be used, this pouring process may be executed simultaneously. Then, the delay time needed for hardening bonding agent can be reduced to make the number of preparatory products smaller for more efficient production.

Now, when recovery operation should be executed for the liquid discharge recording head in operating liquid discharge recording, the recovery cap 201 advances to the orifice plate 101 side to be in contact with the surface of the orifice plate 101*d*, thus closing the discharge port array 101*b* airtightly. The surface 110*d* of the orifice plate is smooth and flat without any steps. Therefore, it is possible to secure airtightness by means of the cap contact portion 201*a* of the orifice plate 101 if only this portion is in contact with any part of the surface 110*d* of the orifice plate. As a result, it becomes unnecessary to define a high precision for a member needed to determine the advancing position of the recovery cap 201. Thus, the recording apparatus can be made simpler.

Also, as to the peeling off of the orifice plate edge portion due to the repeated capping operation, there is no influence that may be exerted, because the extended portion of the orifice plate 101 is held by the presence of the pressure plate 106, and also, because the orifice plate edge portion is positioned outside the area of the cap contact portion 201*a*, hence making it possible to prevent any drawback caused by the peeling off of the edge portion thereof.

Next, the description will be made of the wiping operation which is carried out after capping, continuous discharges, and the like.

As described above, for obtaining recording in good condition, it is necessary to carry out wiping operation to clean the surface 110*d* of the orifice plate 101. In some cases, however, the conventional art may cause the orifice plate to be peeled off from the contact surface 204*d* with the orifice plate edge portion when the wiping blade advances onto the surface 110*d* of the orifice plate.

This is because the orifice plate 101 is held only by adhesive power with the front plate portion 102*b* in the vicinity of the contact surface 204*d* in the direction 202 in which the blade advances, and the reaction force of the orifice plate 101 is only the one at 204*a* against the slidably rubbing force exerted by the blade.

Here, in contrast, the present embodiment enables the orifice plate 101 to be bonded to the front plate portion 102*b*, and the surface and backside of the adjacent recording head main body 100, that is, bonded on three surfaces in total with respect to the recording head main body 100. In this way, in addition to the reaction force at 204*a* against the slidably rubbing force exerted by the blade, reaction forces at 204*b* and 204*c* are exerted to act upon the extended portions which are folded, hence obtaining greater reaction force altogether. Also, if some external force is exerted on the contact surface 204*d* that may result in peeling off at this portion, such force should need a force good enough to shear the orifice plate at the folded portion 110*a*, because the orifice plate 101 is folded. Usually, on the orifice plate 101, the breaking force in the shearing direction thereof is much greater than the pressure exerted by the wiping blade on the surface 110*d* of the orifice plate. In practice, therefore, there is no peeling off that may be caused by use of the blade.

Also, when the wiping blade advances in the advancing direction 203, the blade begins to be in contact with the orifice plate in the folded portion 111*a*, thus making the peeling-off possibility smaller.

Figure 3:
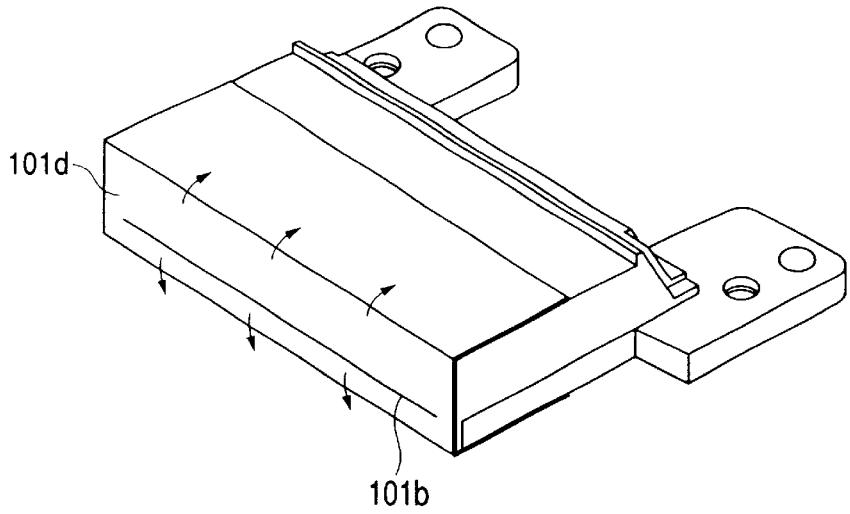
FIG. 3 is a view which shows the tension which is exerted on the orifice plate of the liquid discharge recording head represented in FIG. 1.

Also, when the orifice plate 101 is folded and fixed, both sides of the orifice plate 101 are pulled in the direction orthogonal to the discharge port array 101*b* as shown in FIG. 3 in order to fix it to the recording head main body in a state of being tensioned. Flatness of the surface 110*d* of orifice plate is enhanced more to eliminate the floating of the orifice plate 101 from the recording head main body, hence making it possible to prevent the occurrence of peeling off. If this tension is made greater excessively than needed, the discharge port array 101*b* is deformed and broken. Therefore, the strength and configuration of material should be considered for appropriate setting.

Figure 4:
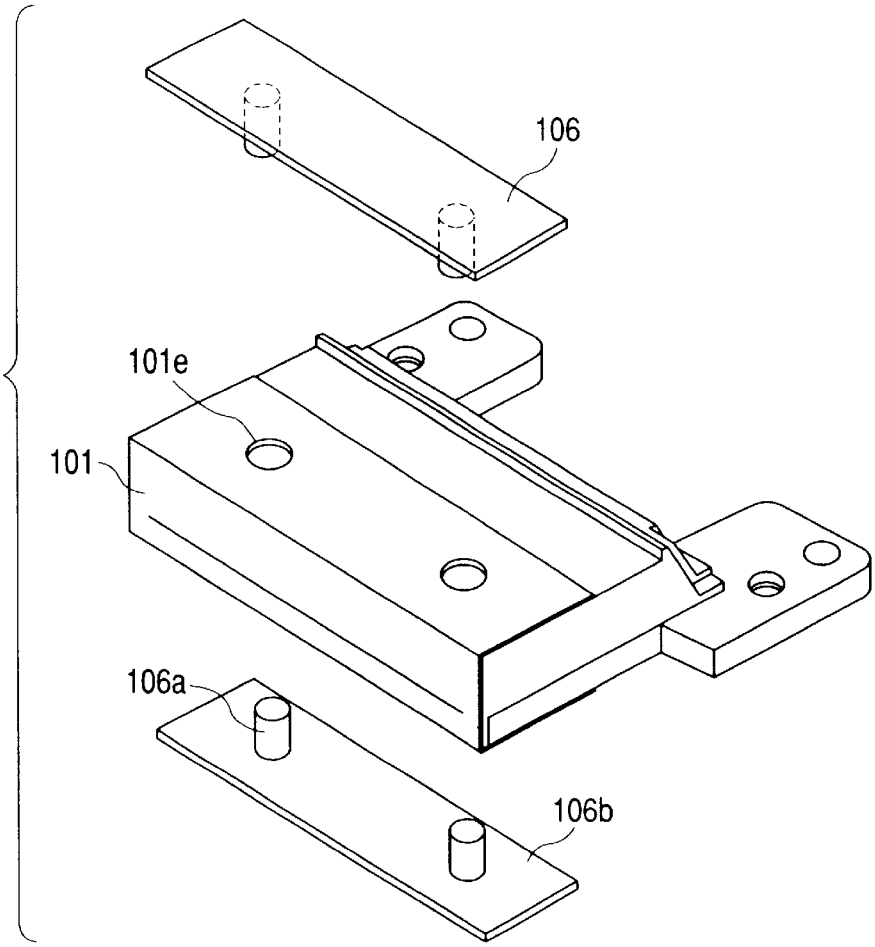
FIG. 4 is a perspective view which shows the structure for fixing the extended portion of the orifice plate to the recording head.
Figure 5:
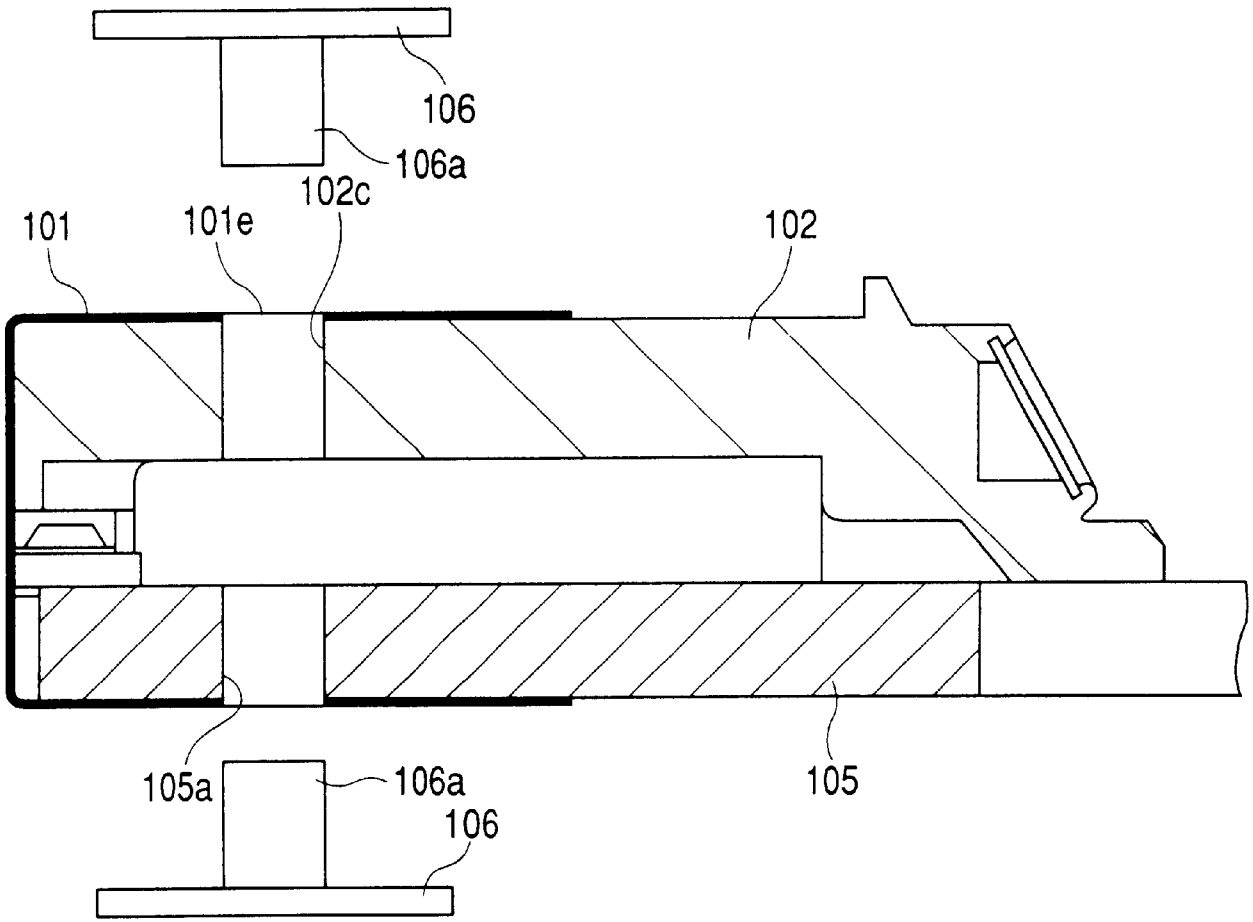
FIG. 5 is a cross-sectional view which shows the structure for fixing the extended portion of the orifice plate to the recording head.

FIG. 4 and FIG. 5 are views which illustrate the structure whereby to fixe the extended portion of the orifice plate to the recording head.

The orifice plate 101 has its own bending robustness. For that mater, it has a resorting force to the flat condition. It is therefore necessary to fix the orifice plate 101 so as to enable the folded state thereof to be maintained. In accordance with the present embodiment, the structure is arranged to use the pressure plate 106 to put the orifice plate 101 between the pressure plate and the surface adjacent to the front face of the recording head main body. This pressure plate 106 comprises the holding portion 106*b* that presses uniformly the entire surface of the extended portion of the orifice plate 101 for fixation; and bosses 106*a* for fixing the pressure plate 106 to the chip tank of the recording head or to the base plate. Then, on the orifice plate 101, escape holes 101*e* are formed for the bosses 106*b* to pass through.

The pressure plate 106 is incorporated after the orifice plate 101 is folded, and the folded faces are in contact with the surface and backside of the recording head 100. Then, the bosses 106*a* are fixed to the chip tank holes 102*b* or base plate holes 105*a* by means of fitting or bonding. The orifice plate 101 is fixed to the recording head by putting the extended portion of the orifice plate 101 between the chip tank 102 or base plate 105, and the pressure plate holding portion 106*b*. In this case, it may be possible to arrange a structure so that the positional relations between the escape holes 101*e* of the orifice plate 101, and bosses 106*a* and holes 102*b* and 105*a* are adjusted appropriately to exert tension on the front portion 110*d* of the orifice plate when the orifice plate 101 is fixed by incorporating the pressure plate 106.

As described above, the orifice plate 101 is folded so as to make the dimension of the front portion 101*d* equal to that of the front plate portion 102*d*, and then, the extended portion thus folded is fixed to the recording head. In this way, it becomes possible to obtain the fixing strength of the orifice plate 101 firmly, and prevent the edge portion of the orifice plate from being peeled off by use of the wiping blade.

Also, the orifice plate 101 is folded along the ridge lines 102*a* of the front plate portion 102*b* to make the area of the front surface 110*d* of orifice plate 101 almost equal to that of the front plate. In this way, the front surface 110*d* of orifice plate 101 provides a larger smooth area to make the smooth area of the front 110*d* wider still. As a result, it becomes possible to secure a wider capping area, and also, it becomes easier to set a desired capping surface.

Further, the front surface 101*d* of orifice plate 101 becomes flat entirely to make it possible to reduce the amount of residual liquid and wiping unevenness significantly when blade wiping is carried out. Also, with the flat wiping surface, it becomes possible to reduce any damage that may be caused by the blade operation to enhance reliability. The freedom of designing is increased accordingly to make a recording head or a recording apparatus itself, as well as to promote cost reduction. It also becomes possible to provide a liquid discharge recording head having a longer life thus implemented.

Second Embodiment

Figure 6:
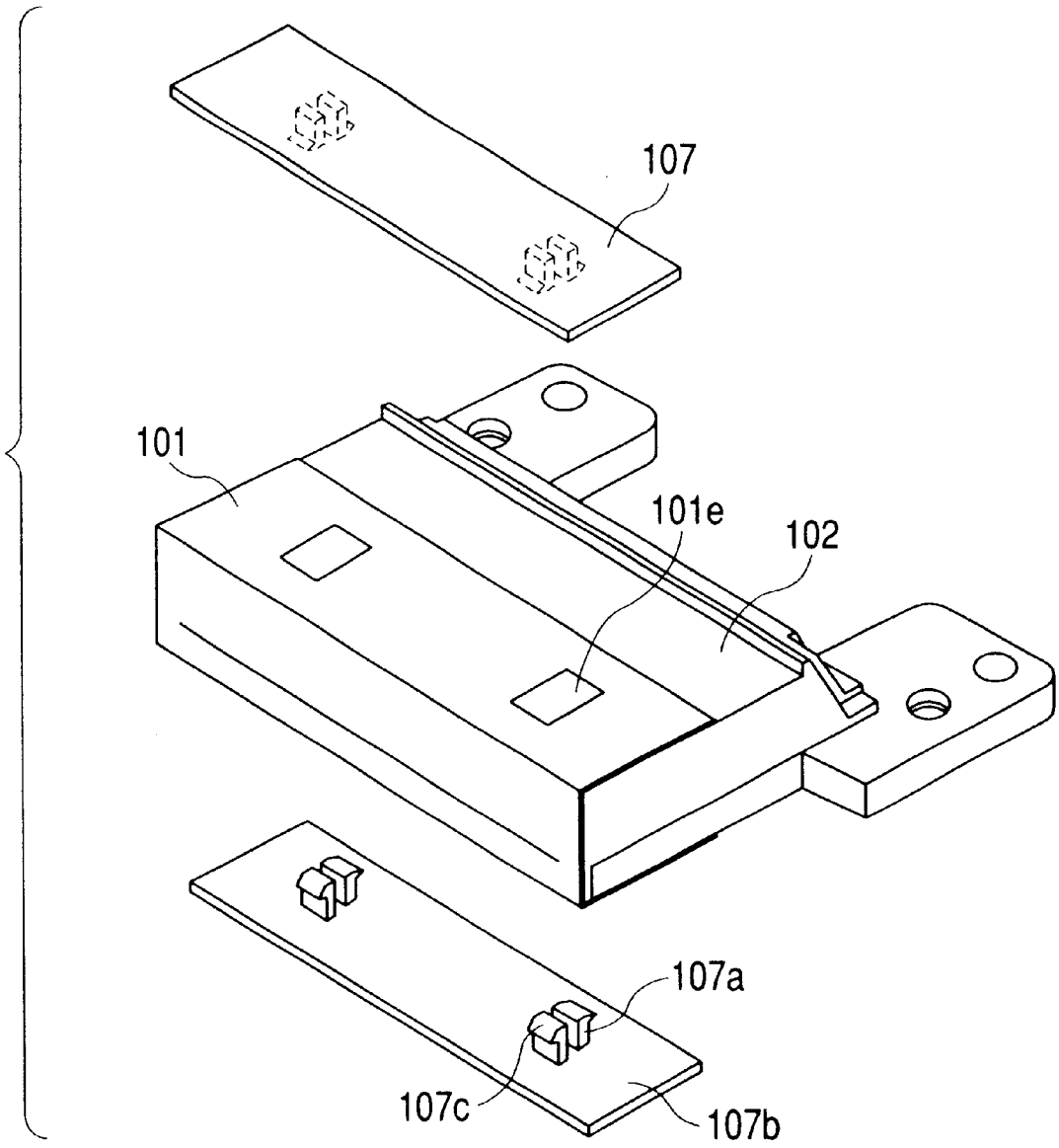
FIG. 6 is a perspective view which shows the liquid discharge recording head in accordance with a second embodiment of the present invention in a state where the pressure plate thereof is separated.
Figure 7:
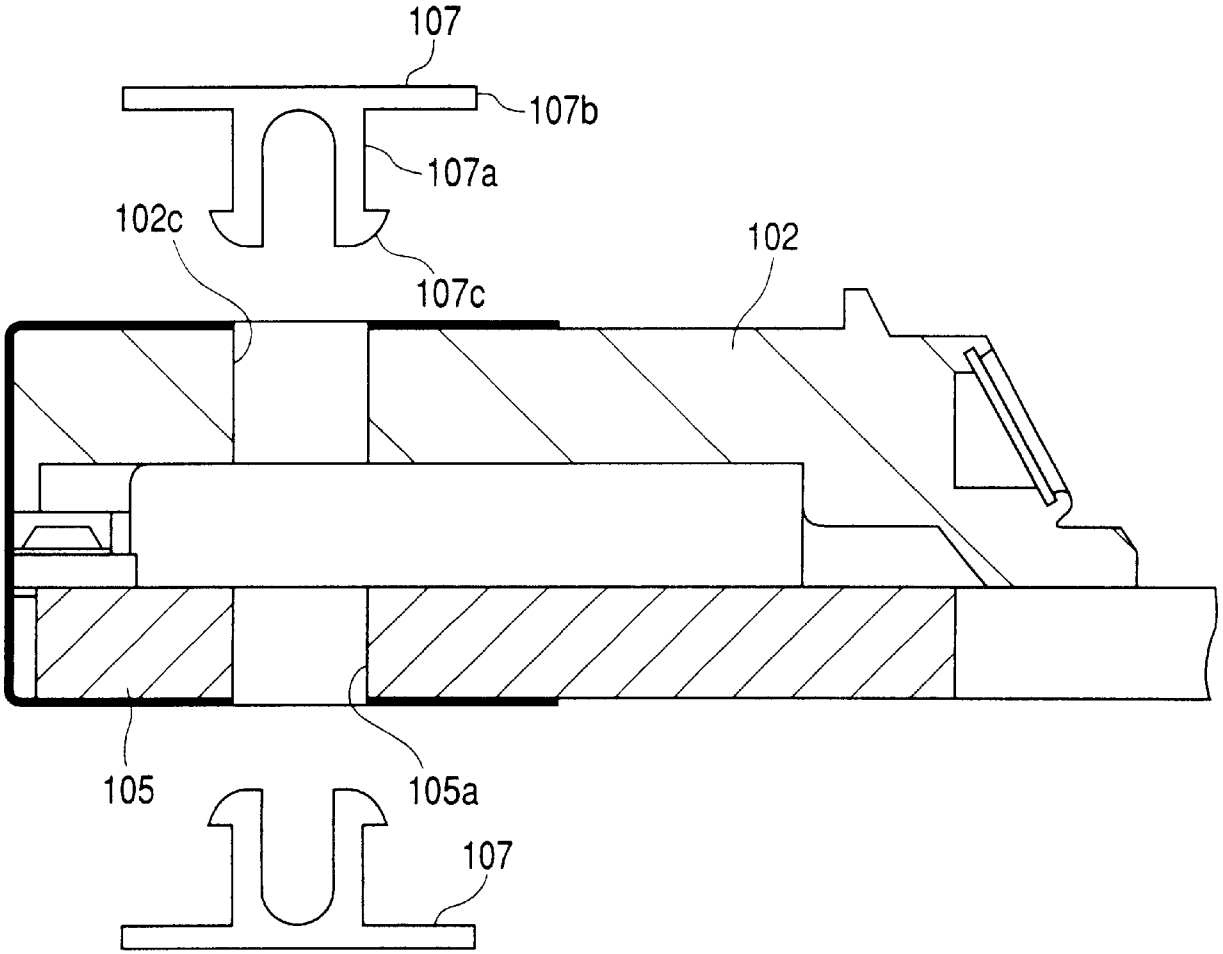
FIG. 7 is a cross-sectional view which shows the liquid discharge recording head represented in FIG. 6.

FIG. 6 is a perspective view which shows the liquid discharge recording head in accordance with a second embodiment of the present invention in the state where the pressure plate is separated. FIG. 7 is a cross-sectional view which shows the liquid discharge recording head represented in FIG. 6.

In accordance with the present embodiment, the pressure plate 107 is arranged in such a manner that each of the bosses 107*a* has a fitting nail 107*c* at the leading end thereof. When bosses 107*a* of the pressure plate 107 are inserted into the holes 102*c* and 105*a*, each nail 107*c* at the leasing ends of bosses 107*a* is fitted into the chip tank 102 or the base plate 105 which is the component to be fixed. When fitting is completed, the pressure plate 107 is immediately fixed to the recording head easily. There is also an excellent advantage, besides this easiness, in carrying out assembly that the completion of fitting is easily confirmed by means of fitting sound of the nails 107*c* or it is easily sensed physically. Further, with the provision of escape holes 101*e* that penetrate the orifice plate, it becomes possible to fix the orifice plate 101 to the recording head in the state where tension is exerted on it so that the fixation of the orifice plate becomes firmer.

As described above, in accordance with the present embodiment, the orifice plate 101 can be fixed to the recording head immediately after it has been folded, and also, the fixing process is complete just by incorporating the pressure palate 107. Therefore, as compared with the case where the pressure plate is fixed using bonding agent or the like, it becomes possible to reduce the number of preparatory products more. Also, should there be any failure in carrying out incorporation, the pressure plate 107 can be removed once, and another pressure plate is incorporated again. With these advantages, the present embodiment contributes to the enhancement of productivity of recording heads significantly.

Third Embodiment

Figure 8:
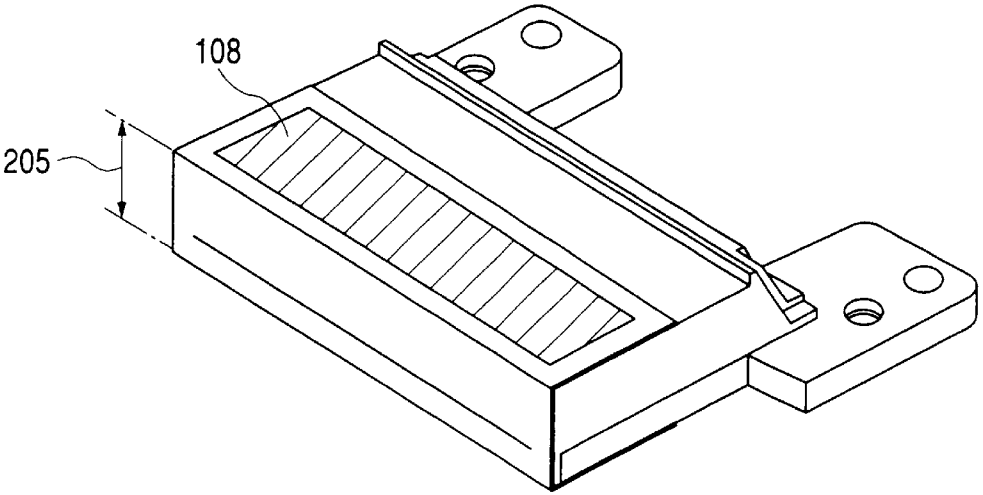
FIG. 8 is perspective view which shows the liquid discharge recording head in accordance with a third embodiment of the present invention.
Figure 9:
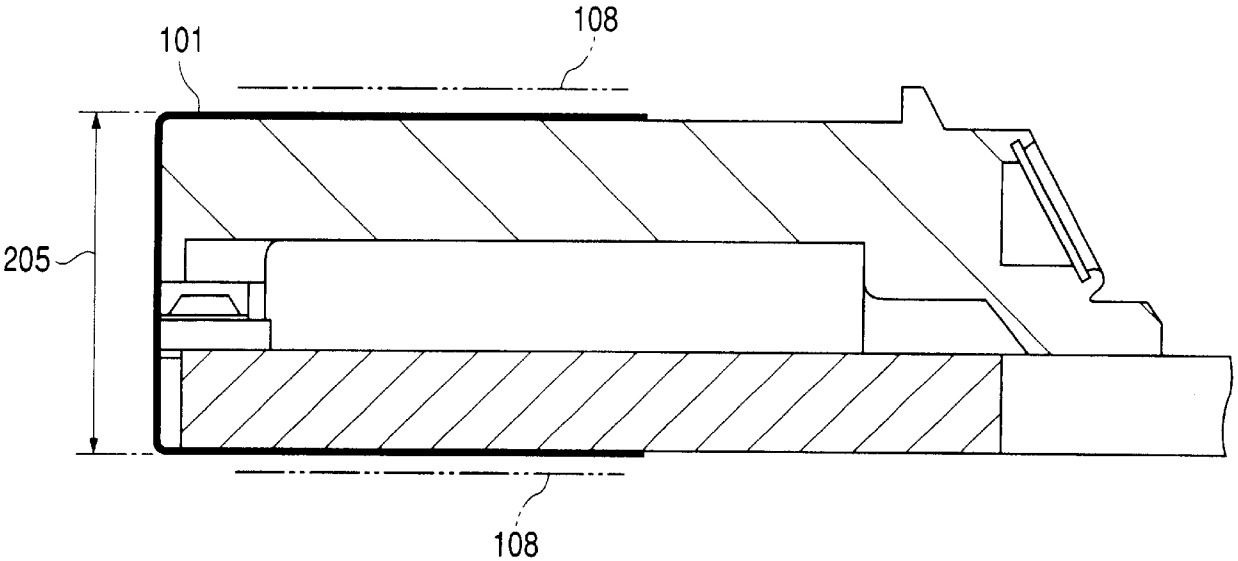
FIG. 9 is a cross-sectional view which shows the liquid discharge recording head represented in FIG. 8.

FIG. 8 is a perspective view which shows the liquid discharge recording head in accordance with a third embodiment of the present invention. FIG. 9 is a cross-sectional view which shows the liquid discharge recording head represented in FIG. 8.

For the liquid discharge recording head of the present embodiment, the folded portions of the orifice plate 101, that is, the extended portions thereof, are bonded to the recording head main body by use of bonding agent. When the orifice plate is bonded to the recording head main body, bonding agent is coated on the contact faces of the folded portions of the orifice plate, and the contact faces on the recording head side. Then, the orifice plate 101 is folded to execute bonding.

With the structure thus arranged in accordance with the present embodiment, there is no need for use of the pressure plate described earlier. As a result, it is possible to reduce the thickness equivalent to that of two pressure plates each on the chip tank side and the base plate side. Thus, space saving and reduction of part numbers are possible to implement the cost down. Usually, the thickness of one pressure plate is 0.5 mm or more. With the arrangement of this structure, the thickness can be reduced by 1 mm or more. The thickness of head 205 thus obtained exerts influence on the assembling density, and particularly when a plurality of heads are arranged, the reduction of 1 mm in thickness per head demonstrates excellent effect.

Also, in accordance with this structure, the folded portions of the orifice plate are fixed by bonding entirely, thus obtaining greater fixing strength to make it easier to secure a firm fixation.

In this respect, when the bonding method thus structured is used, the selection of bonding agent is important. Particularly, the hardening shrinkage and hardening time are the items that should be taken into account when bonding agent is selected. If the hardening shrinkage is great, wrinkles may be created on the orifice plate 101 due to shrinkage. Therefore, it is necessary to select the bonding agent the shrinkage of which is as small as possible. Also, if the harding time is long, it becomes necessary to hold the folded portions longer after the completion of folding. This deteriorates productivity. However, if this hardening process is executed simultaneously with the pouring process and delay time process for pouring and hardening bonding agent or sealant in the gap formed between the area around the discharge ports on the backside of the orifice plate 101 and the front plate portion 102*b*, there is no need for taking longer delay time for hardening the folded portions, hence making it possible to solve the problem that may affect the productivity.

Figure 10:
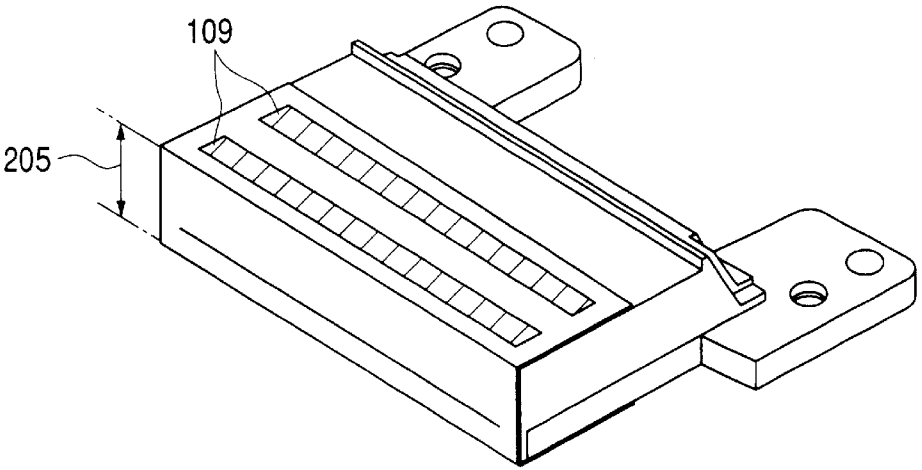
FIG. 10 is a perspective view which shows the variational example of the liquid discharge recording head represented in FIG. 8.
Figure 11:
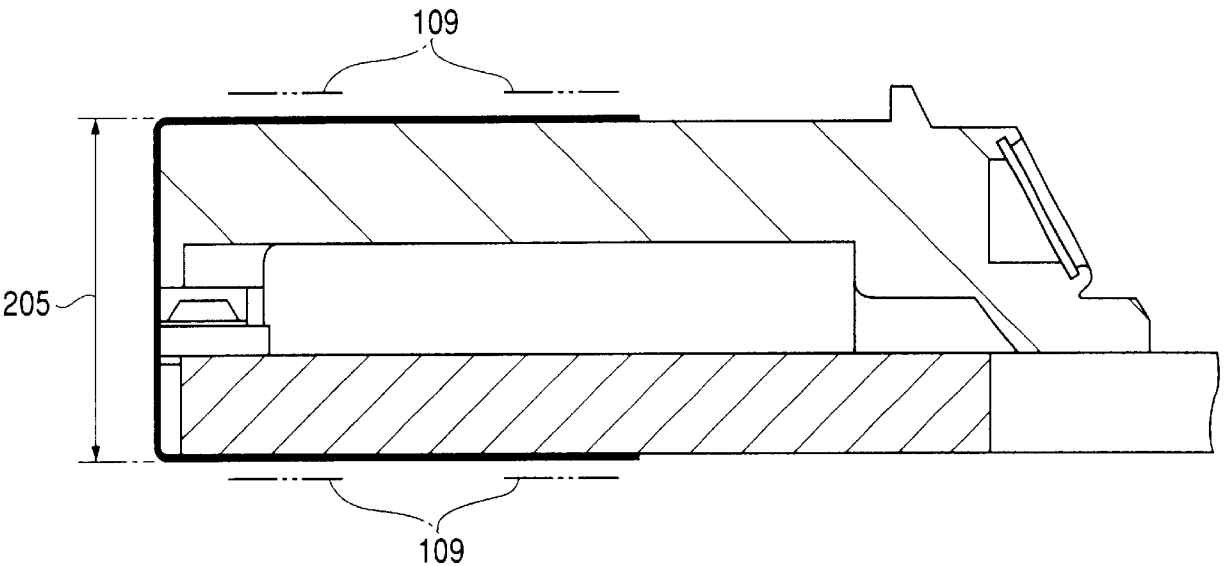
FIG. 11 is a cross-sectional view which shows the liquid discharge recording head represented in FIG. 10.

FIG. 10 is a perspective view which shows the variational example of the liquid discharge recording head of the present embodiment. FIG. 11 is a cross-sectional view which shows the liquid discharge recording head represented in FIG. 10.

The liquid discharge recording head of this variational example is such that the folded portions, that is, the extended portions, of the orifice plate 101 are bonded to the recording head main body by means of welding. When the orifice plate is bonded to the recording head main body, the orifice plate 101 is folded, and welding means is arranged to abut against each of the designated welding portions. As welding means, there is a heat bar for performing thermal welding, a ultrasonic horn for performing ultrasonic welding, or the like.

As advantages of the structure that uses welding, the most significant one is that as in the previous method that uses bonding agent, the head thickness 205 can be made smaller. Also, fixation is possible immediately after the orifice plate is folded. However, the material of orifice plate is limited only to weldable resin or the one that has weldability to chip tank or base plate, and also, the material and configuration which can be used for the orifice plate are confined with the result that the selection of material becomes important for the orifice plate when it is designed.

Fourth Embodiment

Figure 12:
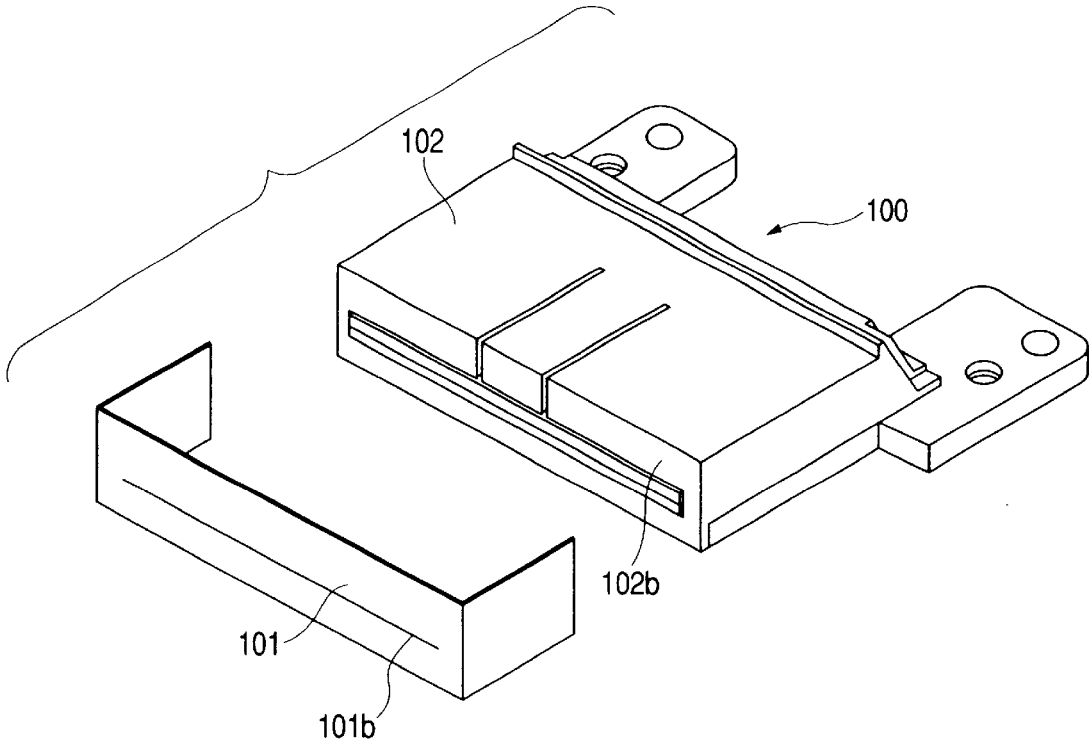
FIG. 12 is a perspective view which shows the liquid discharge recording head in accordance with a fourth embodiment of the present invention in a state where the orifice plate thereof is separated.
Figure 13:
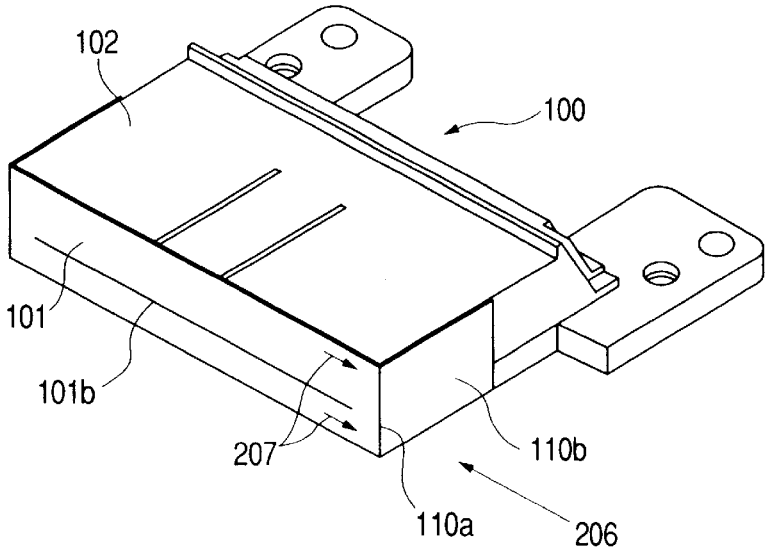
FIG. 13 is a cross-sectional view which shows the liquid discharge recording head represented in FIG. 12 in a state where the orifice plate thereof is bonded.

FIG. 12 is a perspective view which shows the liquid discharge recording head in accordance with a fourth embodiment of the present invention in the state where the orifice plate is separated. FIG. 13 is a cross-sectional view which shows the liquid discharge recording head represented in FIG. 12 in the state where the orifice plate is bonded.

The orifice plate 101 of the present embodiment is such that the extended portion, which is made longer than the side width (width in the direction X in FIG. 12) of the front plate portion 102*b*, is formed in the alignment direction of discharge port array 101*b*. The orifice plate 101 is, therefore, provided with bonding faces to both side faces of the recording head main body 100 in addition to the bonding face to the nozzle opening surface (front plate portion 102*b*) of the recording head main body 100. The orifice plate 101 bonded to the recording head main body 100 is folded along edge lines on both sides of the front plate portion 102*b* to form each folded portion 110*a* as shown in FIG. 13.

As described above, in accordance with the present embodiment, too, the orifice plate 101 is bonded to the recording head main body on a total of three faces, the front plate portion and both side faces of recording head 100 which are adjacent thereto. As a result, even when the wiping blade (not shown) advances onto the surface of orifice plate in any directions, it is possible to prevent the orifice plate 101 from floating from the front plate portion by means of reaction forces that act upon the three bonded faces, as well as by the shearing stress that acts upon the folded portions of the orifice plate 101.

Particularly, when the wiping blade (not shown) advances onto the surface of orifice plate in the direction (direction indicated by a reference numeral 206 in FIG. 13) which is along with the alignment direction of discharge port array 101*b* as in the case of the present embodiment, the blade is received by the folded portion 110*a* of the orifice plate 101. As a result, unlike the structure in which the blade abuts against the edge face of orifice plate, there is no force that may work to cause the edge face of the orifice plate to float. Therefore, it becomes possible to prevent the orifice plate from floating more reliably.

Here, in accordance with the present embodiment, too, the recording head can be assembled in the same process as described in the previous embodiments. Also, as to the method for fixing the orifice plate, any one of the methods described earlier is adaptable. Therefore, the structure of recording head can be determined depending on designing conditions, such as the advancing direction of blade, the positional relations with recording head in the interior of the recording apparatus, material of each part, among some others.

Fifth Embodiment

Figure 14:
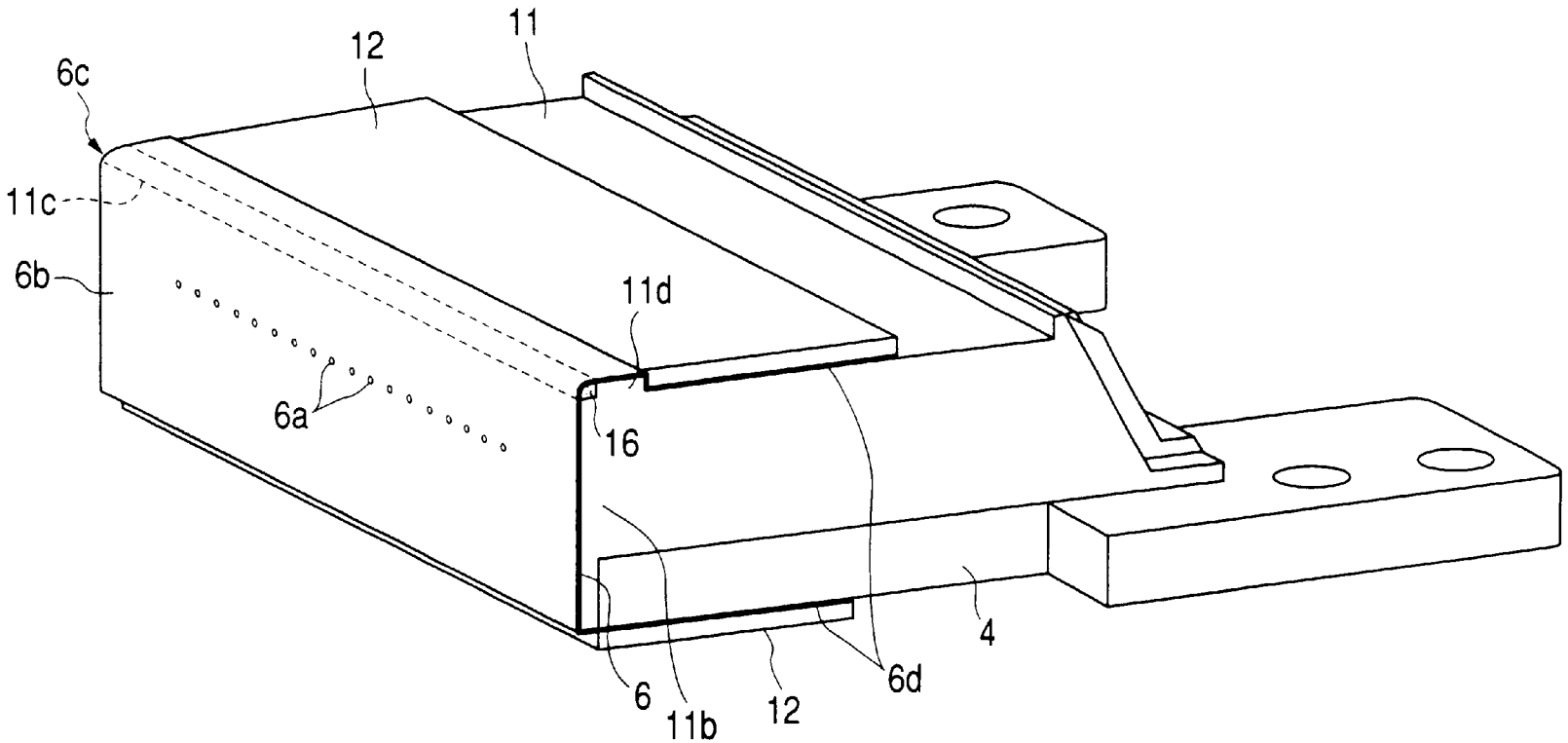
FIG. 14 is a perspective view which shows the liquid discharge recording head in accordance with a fifth embodiment of the present invention.
Figure 15:
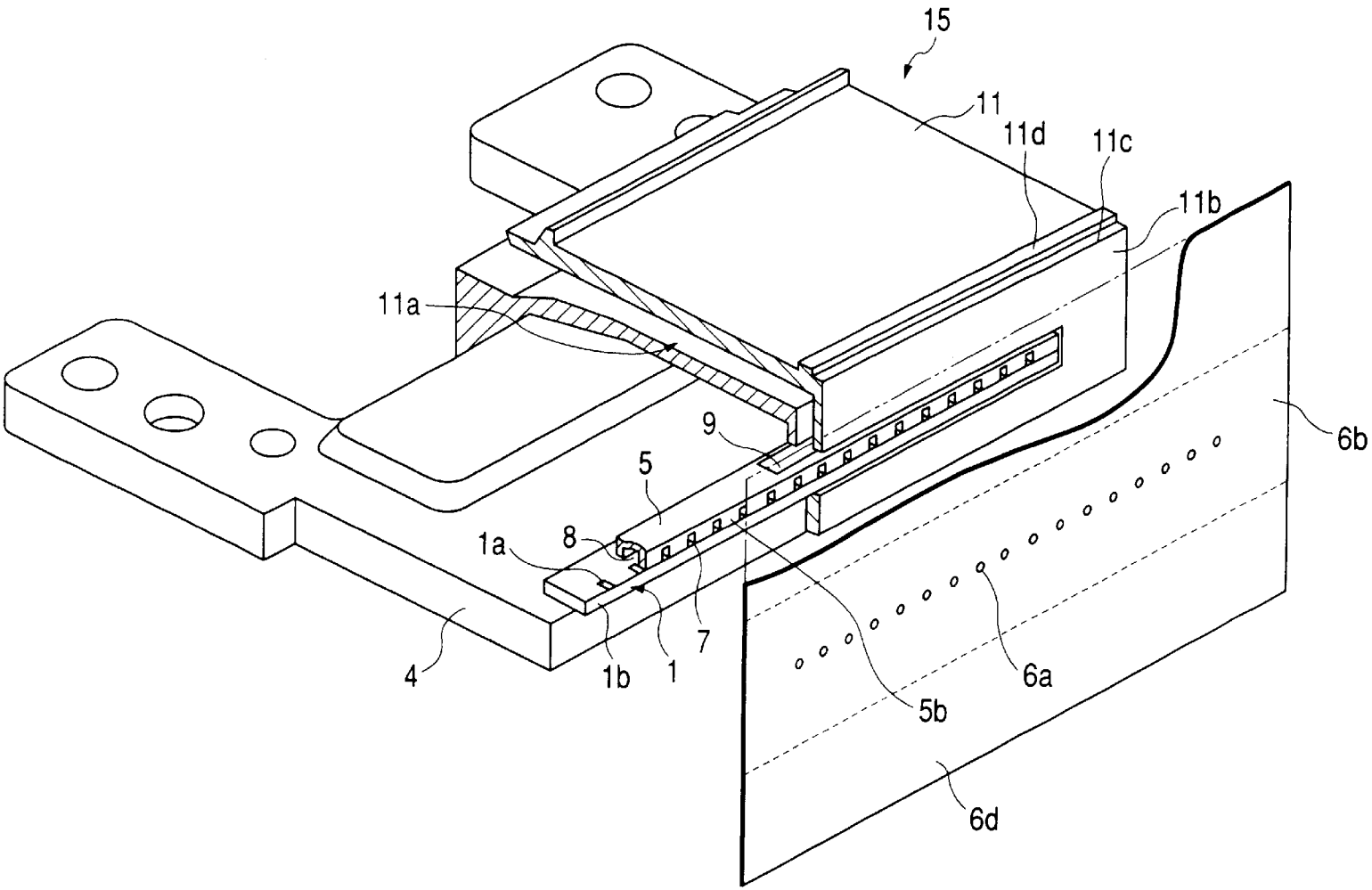
FIG. 15 is a partially cut off perspective view which shows the liquid discharge recording head represented in FIG. 14.
Figure 16:
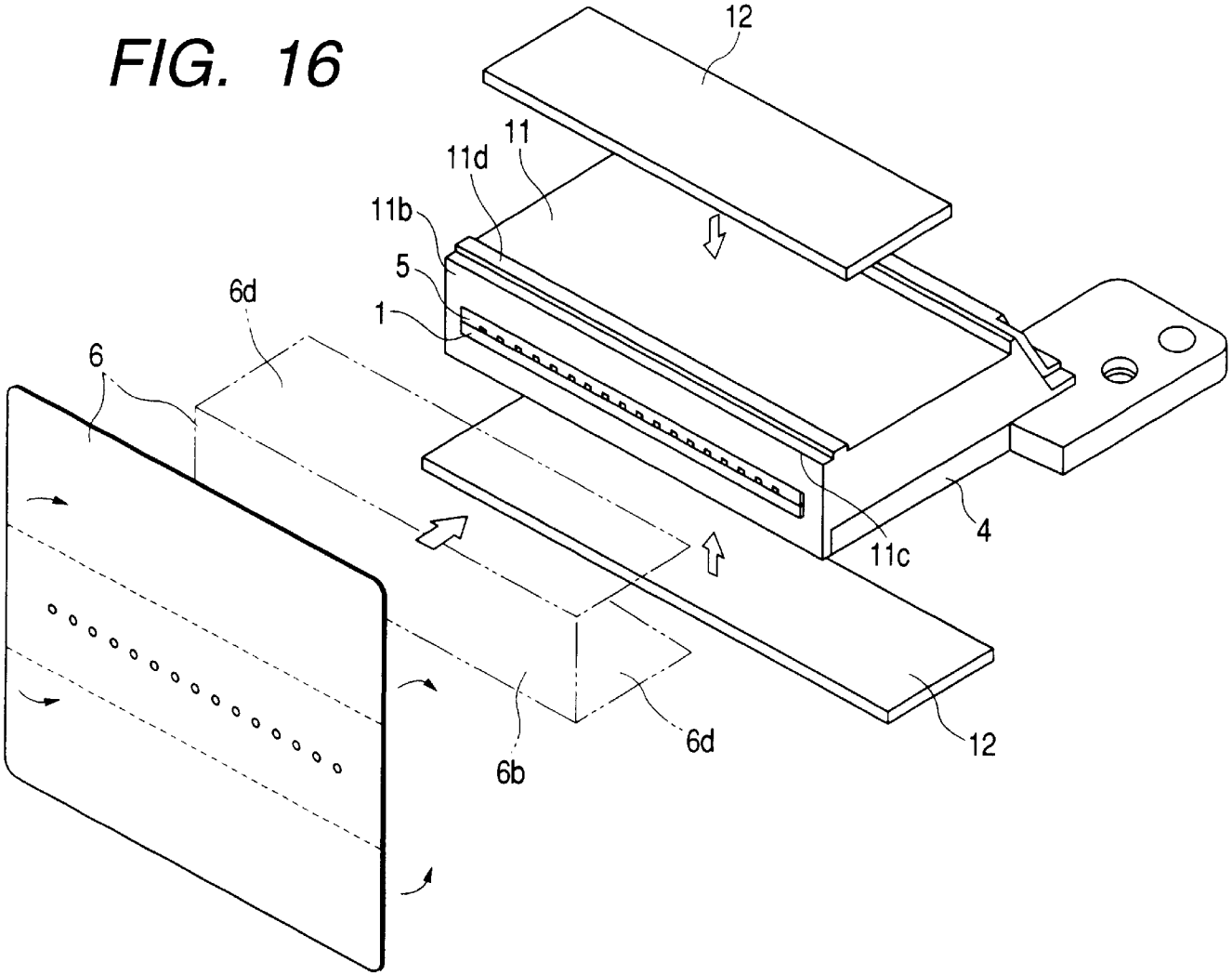
FIG. 16 is an exploded perspective view which shows the liquid discharge recording head represented in FIG. 14.
Figure 17:
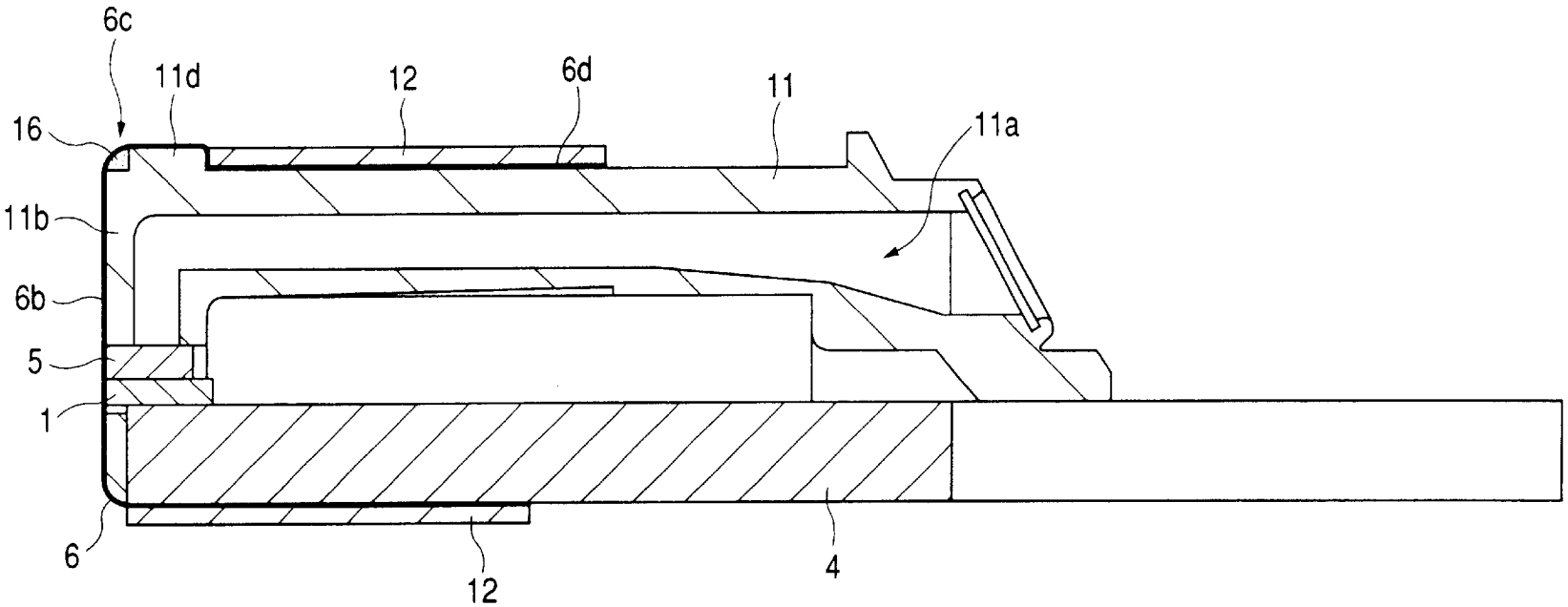
FIG. 17 is a cross-sectional view which shows the liquid discharge recording head represented in FIG. 14.
Figure 18:
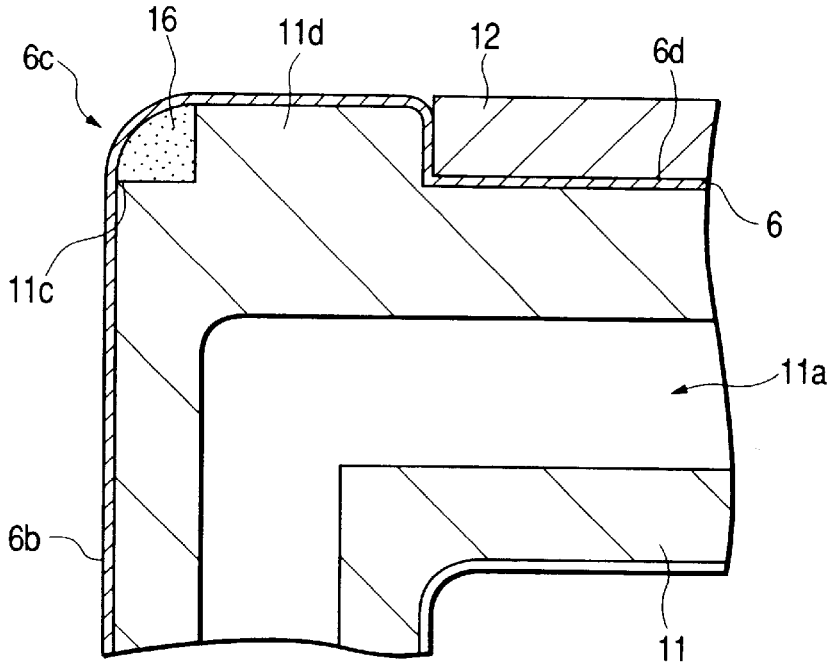
FIG. 18 is an enlarged view which shows the principal part represented in FIG. 17.

FIG. 14 is a perspective view which shows the liquid discharge recording head in accordance with a fifth embodiment of the present invention. FIG. 15 is a partially cut off perspective view which shows the state where the orifice plate is separated with the omission of the pressure plate. FIG. 16 is a further exploded perspective view. FIG. 17 is a cross-sectional view which shows this liquid discharge recording head, and FIG. 18 is an enlarged view which shows the principal part thereof represented in FIG. 17, respectively.

The head main body of liquid discharge recording head of the present embodiment is essentially the same as the conventional example with the exception of extrusion 11*d*. In other words, as shown in FIG. 15, the heater board (element substrate) 1 is structured by the silicon base plate provided with electrothermal converting elements (discharge heaters) 1*a* serving as energy generating means, as well as with the wiring which is formed thereon. The heater board is die bonded to the base plate 4. The base plate 4 functions as the heat sink which radiates heat of the heater board 1 and cools it. To the heater board 1, is bonded the ceiling plate 5 which is provided with nozzles 7 that form liquid flow paths, the common liquid chamber 8 serving as the sub-tank, and the ink supply port 9. The ceiling plate 5 is formed by resin, such as polysulfone, polyether sulfone, polypropylene, denatured polyphenylene oxide, polyphenylene sulphide, or liquid crystal polymer or formed by such material as ceramics, silicon, nickel, or carbon. Then, the chip tank 11 is fixed to the base plate 4, the ceiling plate 5, the heater board 1 to structure the head main body 15. For the chip tank 11, ink passage 11*a* is formed to conduct ink to the ink supply port 9. Also, for the chip tank 11, the front plate portion 11*b* and the extrusion lid are provided.

To the head main body 15, more specifically, to the front plate portion 11*b*, the orifice plate 6 having a plurality of discharge ports 6*a* formed therefor is fixed. The discharge ports 6*a* of orifice plate 6 are arranged in the same number as that of the nozzles 7 of the head main body in the positions to face each other. The orifice plate 6 is a flexible film member which is formed by metallic plate, such as SUS (stainless steel), Ni, Cr, or Al, or by a resin mold, resin film material, or the like, such as polyimide, polysulfone, polyether sulfone, polyphenylene oxide, polyphenylene sulphide, or polypropylene.

The outer portion of the discharge ports 6*a* of orifice plate 6 are bonded to the front plate portion 11*b*. Then, the front plate portion 11*b* holds the orifice plate 6 so as to support the orifice plate 6 to be able to withstand sufficiently the attaching or detaching force and pressure holding forces that may be exerted by the capping member (not shown) arranged for the recording apparatus main body when capping operation is carried out. The orifice plate 6 has a larger area than the front plate portion 11*b* of chip tank 11, and folded at the edge portions 11*c* of chip tank 11. At this juncture, the folded portion 6*d* of orifice plate 6 is in a state of riding over the extrusion 11*d*. Further, the folded portions 6*d* is fixed by the pressure plate 12 (see FIG. 16) in back of the extrusion 11*d*.

Now, the description will be made of the outline of assembling process of the liquid discharge recording head of the present embodiment.

At first, the heater board 1 is die bonded onto the base plate 4. Then, the heater board 1 and the ceiling plate 5 are positioned in high precision so that a plurality of discharge heaters 1*a* face nozzles 7 each other, respectively. After that, using bonding means, such as bonding agent, or pressure means, such as pressure spring (not shown), the heater board 1 and the ceiling plate 5 are set to be closely in contact. In this manner, liquid flow paths are formed on the contact surface between the heater board 1 and ceiling plate 5.

Next, the chip tank 11 is fixed to the base plate 4 to cover the ceiling plate 5 and heater board 1 to connect the ink supply port 9 of ceiling plate 5 with the ink passage 11*a* of chip tank 11. The front plate portion 11*b* encircles the outer sides of the edge faces (front face 1*b* of heater board and the front face 5*b* of ceiling plate) on which the opening ends of liquid flow paths are positioned. At this juncture, the edge faces 1*b* and 5*b* are structured to protrude from the front face of the front plate portion 11*b* by approximately several tens of $\mu$m to several hundreds of $\mu$m.

Then, the orifice plate 6 is bonded by bonding means, such as bonding agent, to the edge faces 1*b* and 5*b* of heater board 1 and ceiling plate 5. As described earlier, the front face of the front plate portion 11*b* is retracted from the edge faces 1*b* and 5*b* so as not to hinder bonding the orifice plate 6 and the liquid flow path edge faces 1*b* and 5*b*.

In continuation, the orifice plate 6 is folded at the edge portions 11*c* of front plate portion 11*b* of chip tank 11, and closely in contact with the upper face and lower face of the chip tank 11 along the outer shape thereof. Here, since the chip tank 11 is provided with the extrusion 11*d*, the folded portion 6*d* of orifice plate 6 is in a state of riding over the extrusion 11*d*. Further, with the pressure plate 12 being fixed to the head main body 15 on the position in back of the extrusion lid, the folded portions 6*d* of orifice plate 6 are fixed. In this way, the orifice plate 6 is bonded to the head main body 15. In this respect, between the edge faces 1*b* and 5*b* and the front plate portion 11*b*, there is created a step of several tens of $\mu$m to several hundreds of $\mu$m, and in some cases, therefore, a slight gap is formed on the backside of orifice plate 6 at a location where the orifice plate 6 is not allowed to be firmly in contact along such step. In such case, bonding agent or sealant is poured into the gap to seal it.

Figure 70:
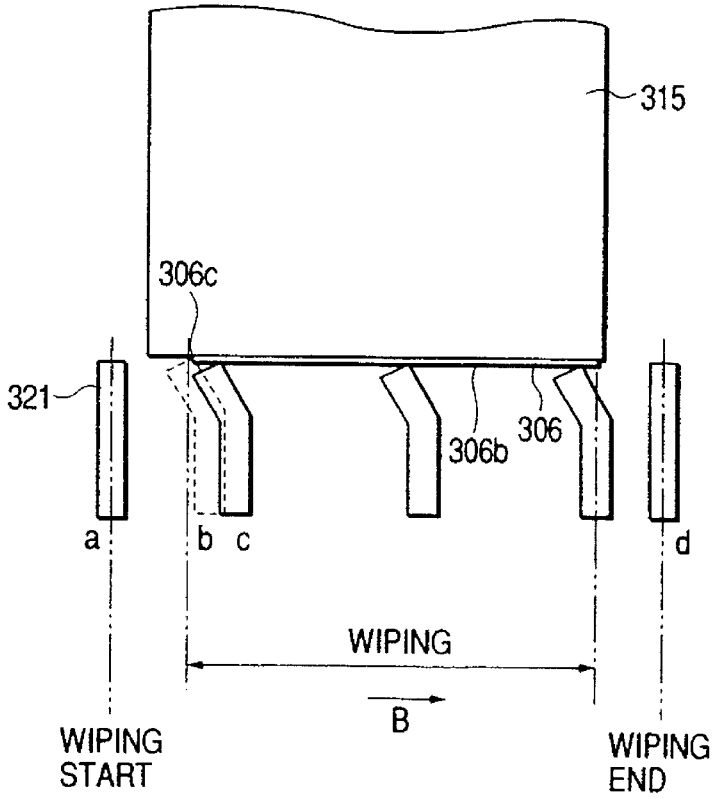
FIG. 70 is a view which illustrates the cleaning operation for the ink discharge surface of a recording head by the wiping operation of a recover device.
Figure 69:
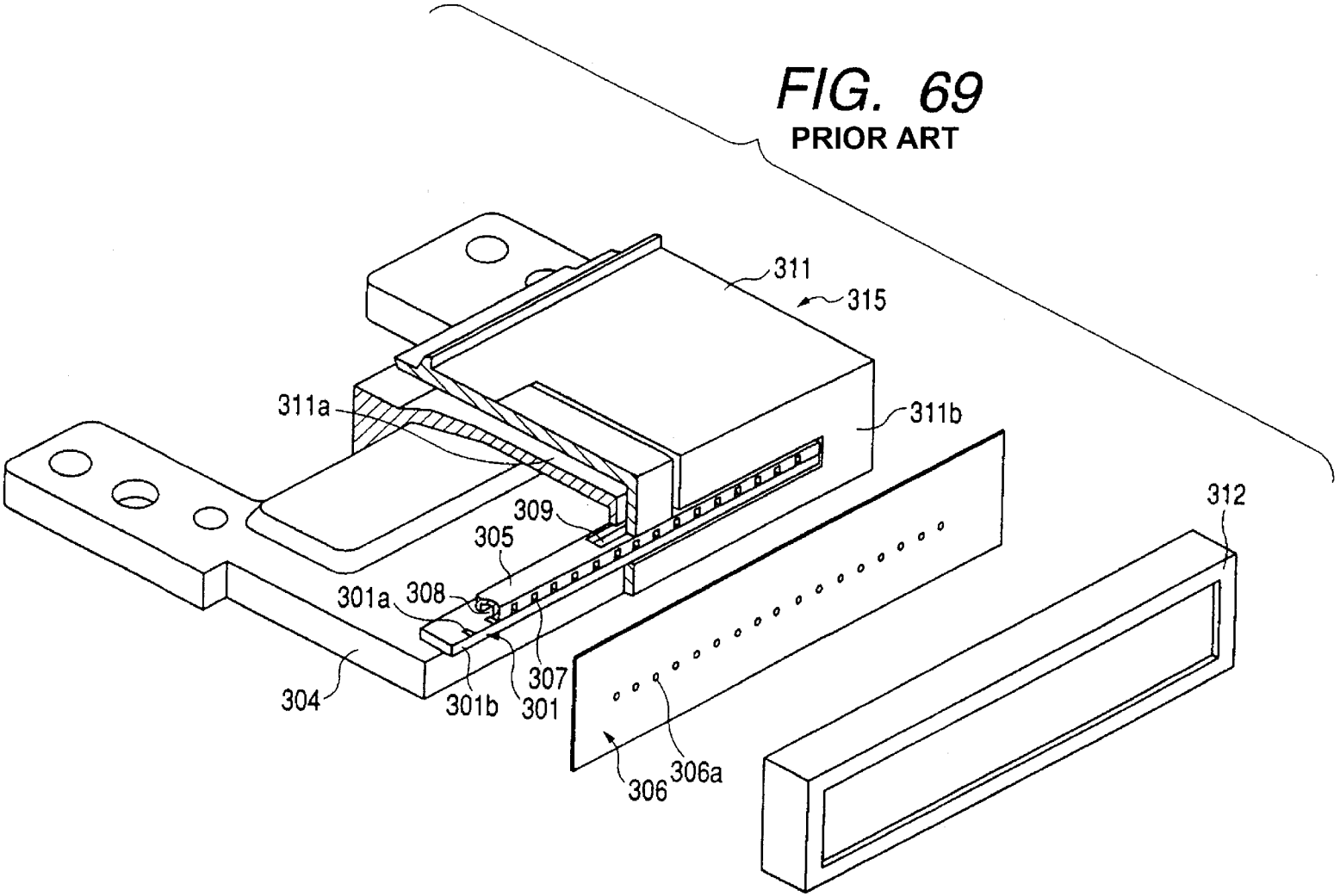
FIG. 69 PRIOR ART
FIG. 69 is a perspective view which shows another conventional liquid discharge recording head in the state where a part thereof is cut off, and also, in the state where the orifice plate and orifice cover are separated.

As described earlier, when the wiping operation is carried out by use of the recovery device as shown in FIG. 70 to clean the discharge surface of liquid discharge head, the problem has been encountered conventionally that peeling-off is liable to occur, because the edge portion of wiping blade 121 abuts against the edge portion 106*c* of orifice plate 106 as if to drag it in a state shown at b in FIG. 70.

To counteract this, therefore, the present embodiment provides the stature whereby to fold the orifice plate 6 at the edge portions 11*c* of front plate portion 11*b* of chip tank 11. With the orifice plate 6 being folded at the edge portions 11*c* of front plate portion 11*b* of chip tank 11 and fixed, the contact area (bonded area) of orifice plate 6 becomes larger with respect to the chip tank 11 to make fixation firmer. As a result, peeling-off can hardly occur even if force is exerted by the wiping blade at the time of wiping. Further, with the orifice plate 3 being fixed to the three faces of chip tank (front face, upper face, and lower face thereof), fixation is much firmer than the case where the orifice plate is fixed to only one face. Thus, peeling-off is not easily allowed to take place not only by force exerted in a specific direction, but by the external force that may be exerted in various directions.

Further, if the wiping direction is perpendicular to the folded lines (and the edge portions 11*c* of front plate portion 11*b*) of orifice plate 6, there is no fear at all that peeling-off occurs due to force exerted by the wiping blade, because no edge portions of orifice plate 6 exist on the facing end 6*b* which should be wiped then. Depending on a case, there is a possibility that the edge portion of wiping blade in the direction parallel to the direction of the relative movement of wiping blade is positioned in the vicinity of the edge portions of front plate portion, but this case does not cause any peeling-off. Further, in such case, if only the edge portions are arranged to be positioned outside the moving region of wiping blade, the peeling-off can be easily prevented more assuredly.

On the other hand, even in the case where the wiping direction is parallel to the folded lines (and the edge portions 11*c* of front plate portion 11*b*) of orifice plate 6, there is no fear of peeling off even if the wiping blade abuts against the edge portions to exert external force thereon, thus causing them to peel off, unless force is exerted to shear the orifice plate 6 at the folded portions thereof, because the orifice plate 6 is folded. In this case, too, the orifice plate 6 can hardly be peeled off. Actually, it is beyond thought that any force may be exerted to be great enough to shear the orifice plate 6.

As described above, with the orifice plate 6 being held in the folded condition, it becomes possible to prevent the orifice plate 6 from being peeled off at the time of wiping irrespective of the positional relations between the wiping direction and the folded lines of orifice plate.

Also, the facing end 6*b* is formed not by the combination of faces of plural members, but only by the orifice plate 6.

Therefore, there is no stepping portion on the facing end 6*b* to secure flatness for the enhancement of the durability of wiping blade. This may lead to the attainment of a longer life for the liquid discharge recording apparatus. Further, with the orifice cover and the like being absent, there is no possibility that the entire body of the liquid discharge recording head becomes larger even if the capping area is made in the same size as the area of the facing end 6*b* in order to make the capping precision higher. This may contribute to making the apparatus smaller.

Next, the description will be made of the technical meaning of the extrusion 11*d* provide for the chip tank 11 in accordance with the present embodiment.

Figure 19:
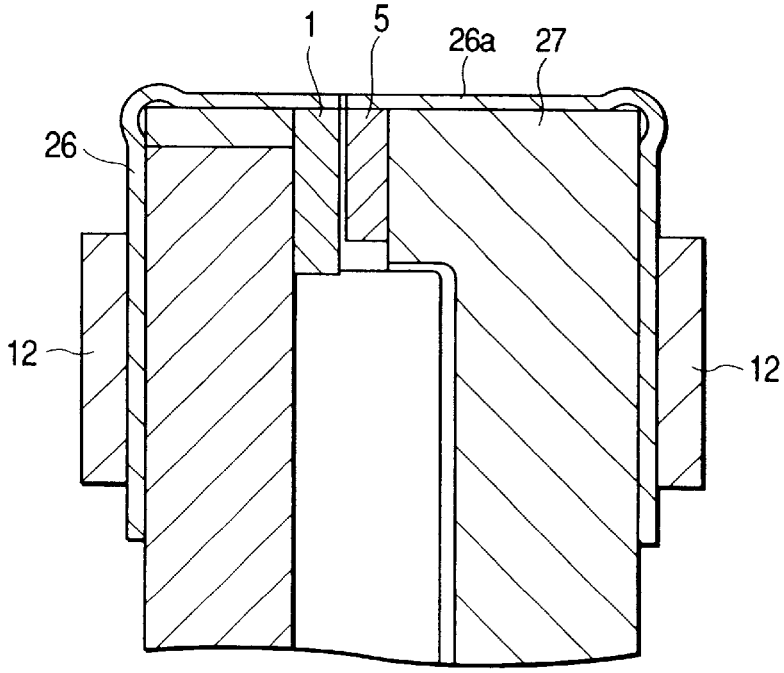
FIG. 19 is an enlarged sectional view which shows the principal part of the liquid discharge recording head in accordance with a first referential example.
Figure 20:
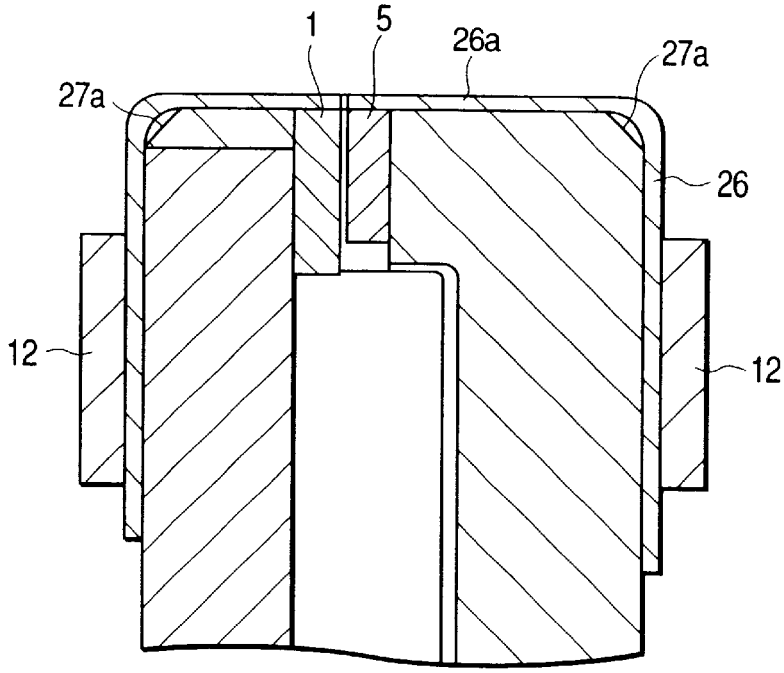
FIG. 20 is an enlarged sectional view which shows the principal part of the liquid discharge recording head in accordance with a second referential example.
Figure 21:
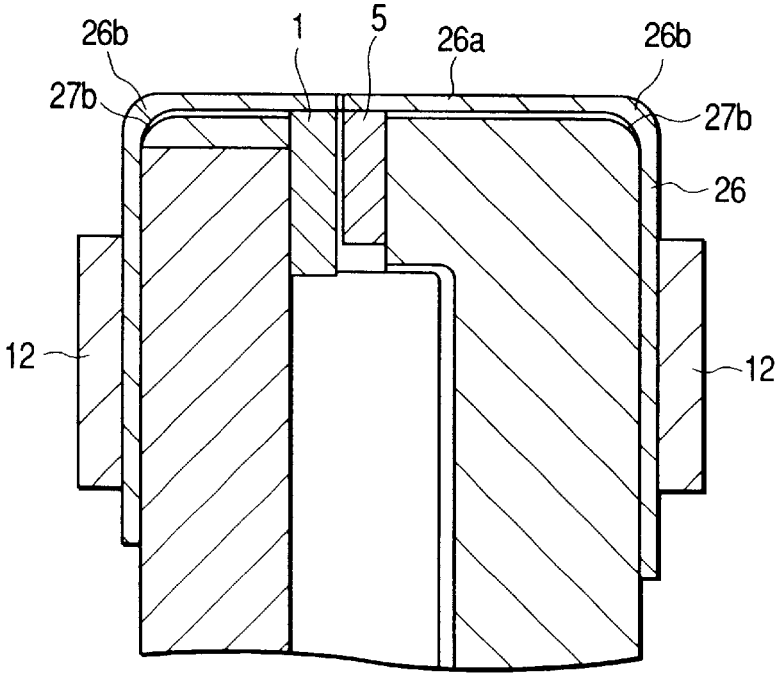
FIG. 21 is an enlarged sectional view which shows the principal part of the liquid discharge recording head in accordance with a third referential example.

At first, the case where no extrusion is present will be described. Depending on the material, thickness, and size of the orifice plate, the folding characteristics may vary. In some cases, when an orifice plate is folded, it becomes impossible to obtain a desired configuration that folding is made at ridge lines along the edge portions of front plate portion of chip tank. Then, as shown in FIG. 19, the folded portions of orifice plate 26 should present a circular shape accompanied by a large curvature. In this case, the folded portions are allowed to protrude largely to the front side (surface 26*a* side), too, to make it difficult to secure the flatness of the surface 26*a*. Here, therefore, the structure may be arranged to chamfer each of the edge portions 27*a* as shown in FIG. 20 or round it as shown in FIG. 21, where the edge portions of the front plate portion 27, which are the part at which each of the folding portions of orifice plate 26 is folded, are configured so as not to allow any definite ridge lines to exist by the front face that intersects with the side face at right angles. However, unless the angle of chamfered portion 27*a* or the radius curvature of rounded portion 27 are appropriate, none of them is in agreement with each of the circular portions 26*b* of orifice plate 26 to make the circular portion 26*b* instable eventually. For that matter, the front plate portion 27 should be processed in good precision, which necessitates the manufacturing steps to be complicated. In either cases, in order to stabilize each circular portion 26*b* of orifice plate 26, there is a need for making the head main body thicker, and the spatial arrangement of a recording apparatus, and the distance between heads used in parallel are inevitably affected. Also, when a pressure plate is used for fixing the folded portions of orifice plate 26, the pressure plate should be made thick in order to provide robustness good enough to effectuate fixation, and this provision further affects the spatial arrangement and distance between heads inevitably.

In contrast, the present embodiment provides steps by the formation of extrusion lid on the head main body 15 in order to stabilize each of the circular portions 6*c* of orifice plate 6 by means of each stepped portion, respectively, without deteriorating the flatness by allowing them to protrude toward the front side (facing end 6*b* side). Also, the extrusion lid is arranged locally, while the head main body 15 is kept thinner as a whole. Therefore, this arrangement is possible without affecting the spatial arrangement and the distance between heads. Particularly when the pressure plate 12 is arranged outside the extrusion 11*d*, the thickness of the head main body 15 is not increased so much even if a thicker pressure plate 12 is used for obtaining higher robustness. Also, each of the folded portions of orifice plate 6 is made wider, hence making the curvature smaller by dispersing stress, which produce a favorable effect in making the head main body thinner.

In this respect, with bonding agent or sealant 16 having bonding power, which is injected into each stepped portion created by the presence of extrusion 11*d* in order to bond the backside of orifice plate 6, and the front plate portion 11*b* as well, folding stress is held down to make it possible to obtain the flatness of surface 6*d* assuredly with higher reliability.

The height of extrusion 11*d* is determined by selection of the material used for the orifice plate 6, folding robustness, thickness, configuration, and others, and also, the presence or absence of bonding agent or sealant 16 in the gap (stepped portion) between the backside of orifice plate 6 and the front plate portion 11*b* as described earlier. Generally, the larger the height of extrusion 11*d*, the better becomes the folded configuration of orifice plate 6. In contrast, if the height of each extrusion 11*d* is smaller, the orifice plate 6 is not allowed to be in contact with the faces of the head main body 15 to reduce the portion which is made instable more easily. Further, if the thickness of the pressure plate 12 is made smaller than the height of the extrusion 11*d*, the thickness of the pressure plate 12 does not affect the thickness of the head main body 15 at all. Now, if the thickness of the pressure plate 12 is larger than the height of the extrusion 11*d*, the portion of the head main body 15 where the pressure plate 12 is fixed is arranged to be recessed so as not to allow the thickness of the pressure plate 12 to affect the thickness of the head main body at all.

Now, with the thickness of the head main body 15 being kept thinner, the size of each component can be made smaller to implement cost reduction. Also, with the capability of making the head main body 15 smaller, it becomes possible to implement making the entire body of liquid discharge recording apparatus smaller and reduce costs. With the possibility to make the liquid discharge recording head smaller and thinner, the arrangement pitches of nozzles 7 (heads) for the respective colors can be made smaller when liquid discharge recording heads are aligned in parallel for the multiple color printing which is more in demand from now on, hence producing effect on the appropriate color representation. Also, with the structure whereby not only to enable the pressure plate 12 and orifice plate 6 to be in contact on surfaces with each other, but to enable the corners 16*a* of pressure plate 12 to pressurize the orifice plate 6 in the radial direction, that is, with the structure being arranged as shown in FIG. 18 to put the orifice plate 6 between the extrusion 11*d* and the pressure plate 12, it becomes possible to fix the orifice plate 6 more firmly with reliability.

Figure 22:
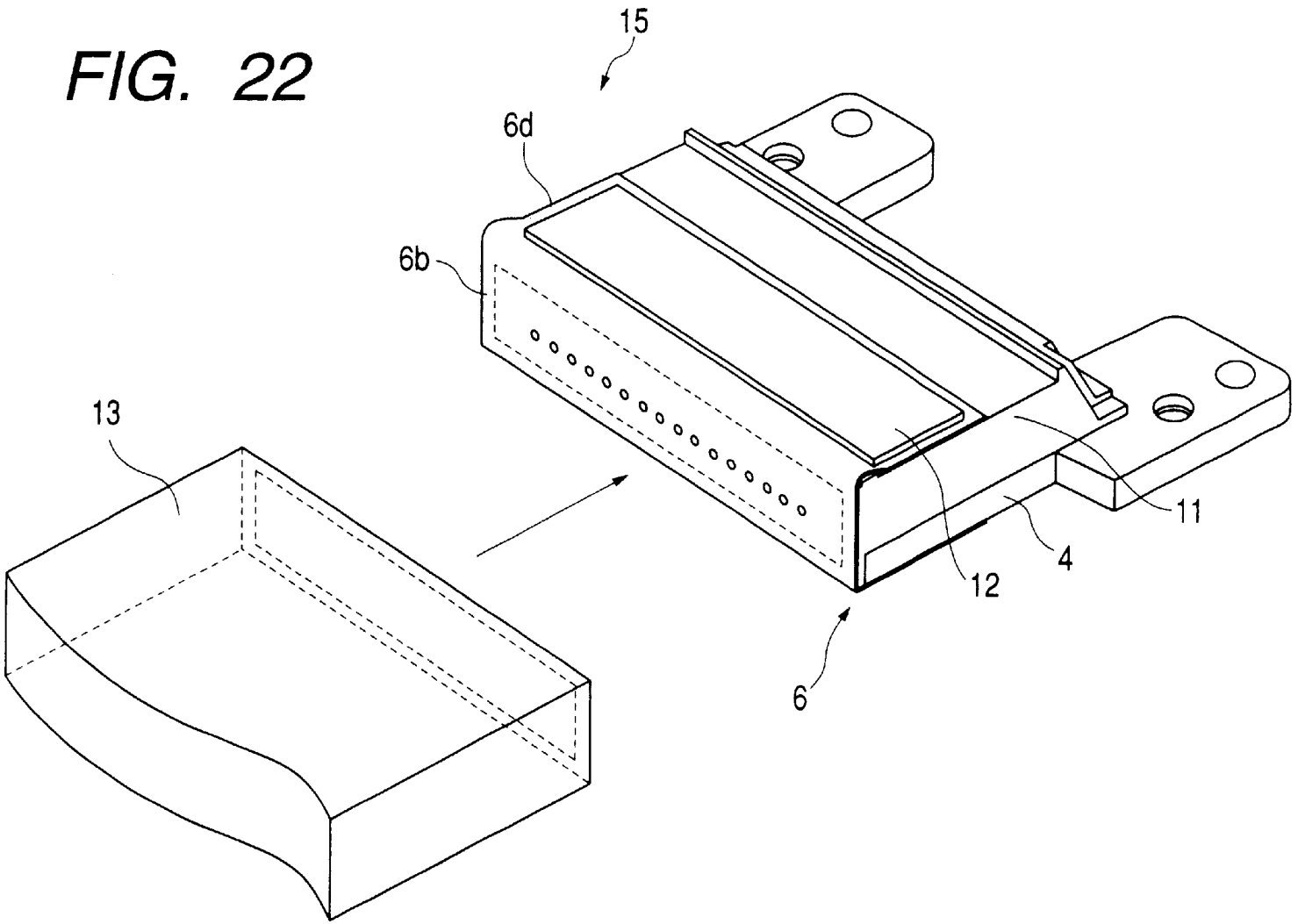
FIG. 22 is a view which schematically shows the capping operation of the liquid discharge recording head represented in FIG. 14.

When the recovery operation is carried out in operating liquid discharge recording, the recovery cap 13 is in contact with the facing end 6*b* of orifice plate 6 as shown in FIG. 22 to close the space that includes nozzles 7 airtightly. In accordance with the present embodiment, the facing end 6*b* of orifice plate 6 is flat without any steps. Therefore, it is possible to secure airtightness when the cap 13 is in contact with any portion of the facing end 6*b* of orifice plate. Thus, the positional precision of the cap 13, and the operational accuracy of cap driving means (not shown) can be relaxed to a certain extent. The recording apparatus is made simpler accordingly.

In accordance with the present embodiment, the orifice plate 6 is folded to provide the structure in which the orifice plate 6 and chip tank 11 are bonded on three faces, that is, the front face, and upper and lower faces. With the structure thus arranged, when the wiping operation is carried out after capping, continuous discharges, or the like, reaction force can be exerted on the wiping blade not only on the front plate portion 11*b* on the backside of the orifice plate 6, but it is exerted from the faces (upper and lower faces) on the folded side, thus obtaining greater reaction force. Also, as described earlier, with the orifice plate 6 being folded, there is no fear that peeling-off occurs even if external force is exerted on the contact face to peel it off unless such force is great enough to shear the folded portions of orifice plate or the like. Usually, breaking force of orifice plate 6 in the shearing direction is much greater than the pressure exerted by the wiping blade on the facing end 6*b* of orifice plate 6. Essentially, therefore, there is no possibility that the orifice plate 6 is peeled off by the wiping blade.

With the structure thus arranged in accordance with the present embodiment described above, it is possible to hold the folded portions of orifice plate stably. The flatness of the surface of orifice plate is high. Also, it is possible to avoid the presence of edge portions of orifice plate on the surface, thus making it difficult to cause the peeling-off. Further, the provision of extrusion is localized so as not to make the thickness of the entire body of the head greater.

With the structure in which the pressure plate is provided to hold the folded potions of orifice plate in back of the extrusion on the wall faces of head main body where the folded portions of orifice plate abut against, it becomes possible to fix the orifice plate more reliably. Also, the folded condition of orifice plate can be kept by the corners of pressure plate to make it possible to fix the orifice plate assuredly with firmer strength in addition to the friction force exerted by the contact faces of the pressure plate and orifice plate. Also, the exertion of such force can be selectively determined by setting the clearance between the extrusion and pressure plate appropriately.

The head main body comprises the element substrate having energy generating means therefor, the ceiling plate laid on the element substrate, and the chip tank fixed to the laminated body of the element substrate and ceiling plate. Then, the front of the head main body is the front portion of chip tank, and the wall faces of head main body are the side faces of chip tank, thus the structure being formed simply.

Sixth Embodiment

Figure 23:
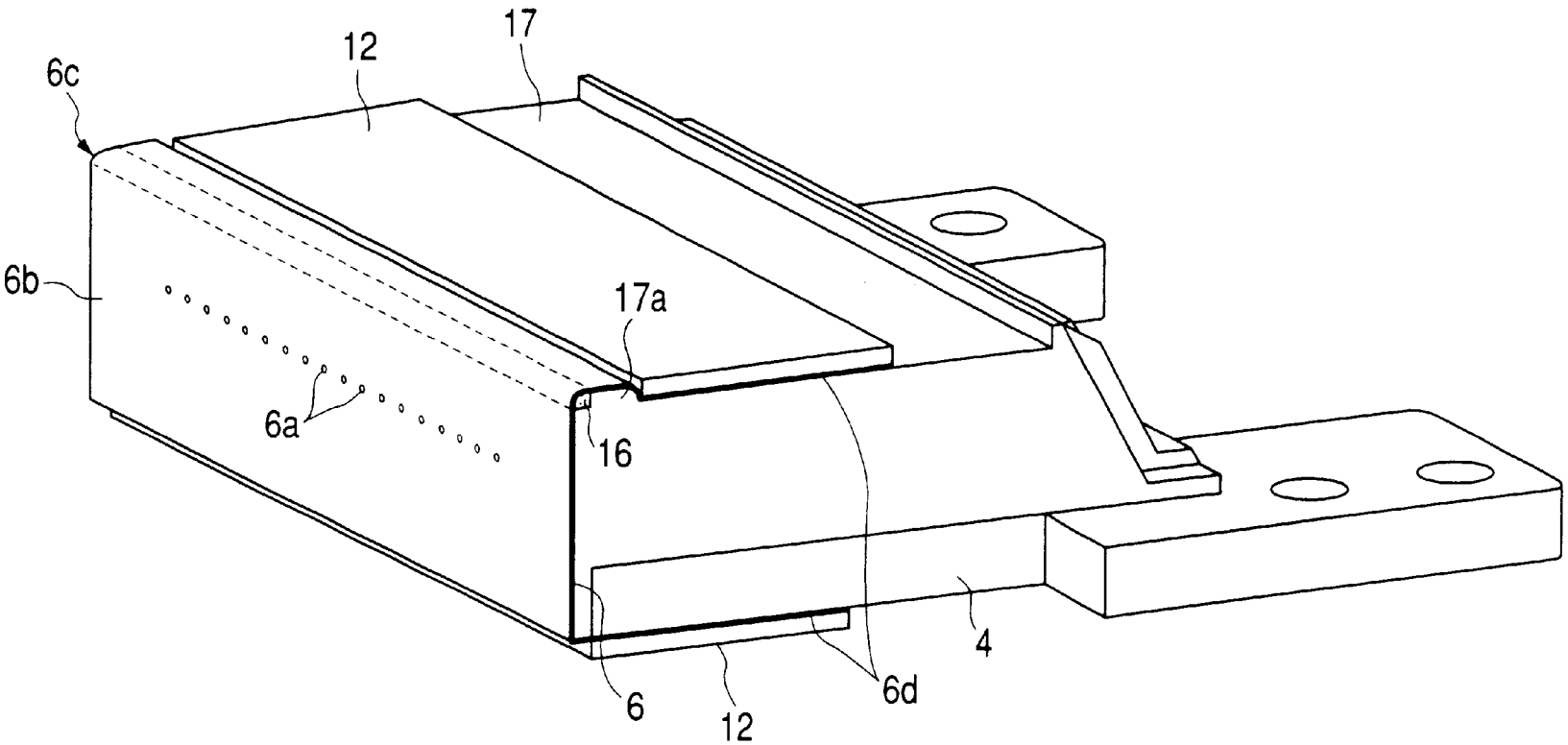
FIG. 23 is a perspective view which shows the liquid discharge recording head in accordance with a sixth embodiment of the present invention.
Figure 24:
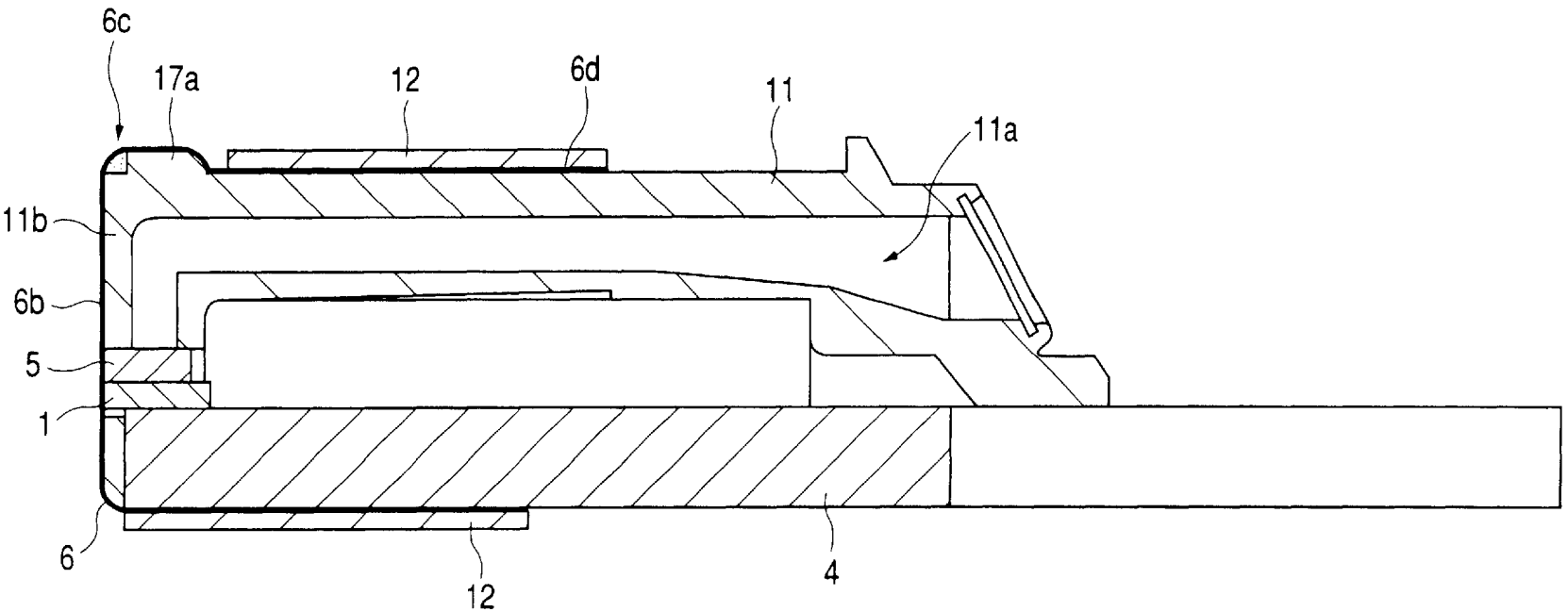
FIG. 24 is a cross-sectional view which shows the liquid discharge recording head represented in FIG. 23.
Figure 25:
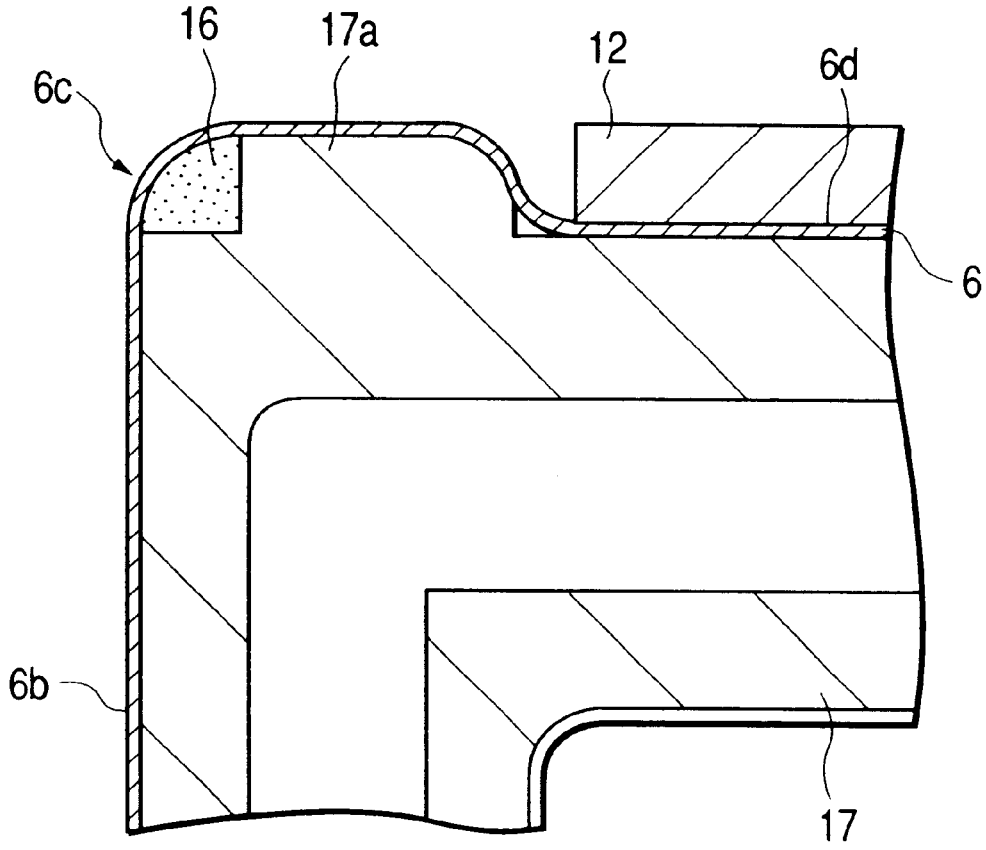
FIG. 25 is an enlarge view which shows the principal part represented in FIG. 24.

FIG. 23 and FIG. 24 illustrate the liquid discharge recording head in accordance with a sixth embodiment of the present invention, the structure of which is different from that of the fifth embodiment only in the configuration of extrusion and the arrangement position of the pressure plate. Hereunder, only the structure of these portions will be described. The description of all the other structures will be omitted.

In accordance with the present embodiment, the gap between the extrusion 17*a* of chip tank 17 and the pressure plate 18 is wider, while the rear portion of extrusion 17*a* is rounded. In this way, the orifice plate 6 is positioned smoothly from the upper face of extrusion 17*a* to the lower face of pressure plate 18. Therefore, unlike the fifth embodiment which provides the structure to put the orifice plate 6 between the extrusion 11*d* and the pressure plate 12, there is no need for any highly precise arrangement work on the pressure plate 12. It is still possible to provide the wide area for the orifice plate 6 to contact with the chip tank 17, and fix the orifice plate 6 reliably.

Seventh Embodiment

Figure 26:
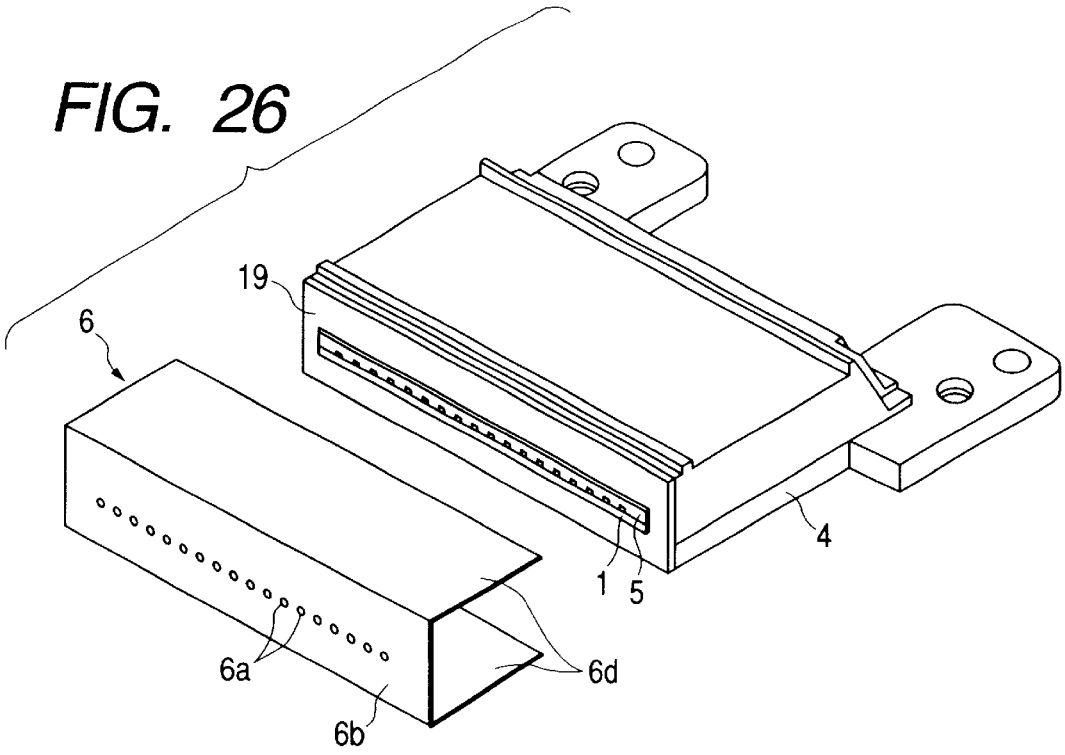
FIG. 26 is a perspective view which shows the liquid discharge recording head in accordance with a seventh embodiment of the present invention.

Also, a seventh embodiment shown in FIG. 26 is such that instead of the front plate portion 11*b* of chip tank 11 of the fifth embodiment, a receiving plate 19 is provided to serve as a member dedicated to receiving the orifice plate 6.

Eighth Embodiment

Figure 27:
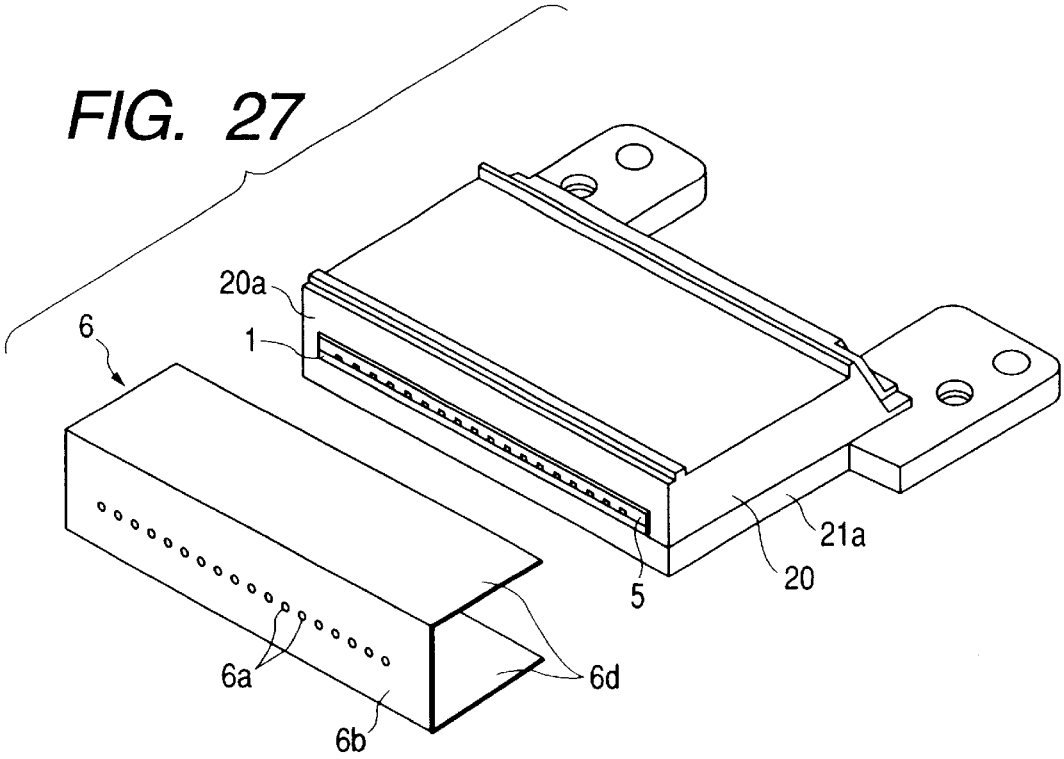
FIG. 27 is a perspective view which shows the liquid discharge recording head in accordance with an eighth embodiment of the present invention.

Also, an eighth embodiment shown in FIG. 27 provides the structure in which the receiving face for the orifice plate 6 is formed by the front plate 20*a* of chip tank 20, and the front portion 21*a* of base plate 21.

These sixth to eighth embodiments can demonstrate the same effect as the fifth embodiment.

Also, for the fourth to eighth embodiments described above, the description has been made of the structure having each of the extrusions 11*d* and 17*a* only on the upper side of chip tank 11 and 17 as shown in FIGS. 18 and 24. However, even if the structure is arranged to provide the same extrusion only for the lower face side (base plate side), the same effect can be obtained. Further, it is effective, too, to arrange the structure so that the extrusions are provide both for the upper and lower sides.

In this respect, for each of the embodiments, the extrusion may be formed integrally with the chip tank together or the structure may be arranged so that the extrusion is arranged separately, and adhesively bonded to the chip tank.

Ninth Embodiment

Figure 28:
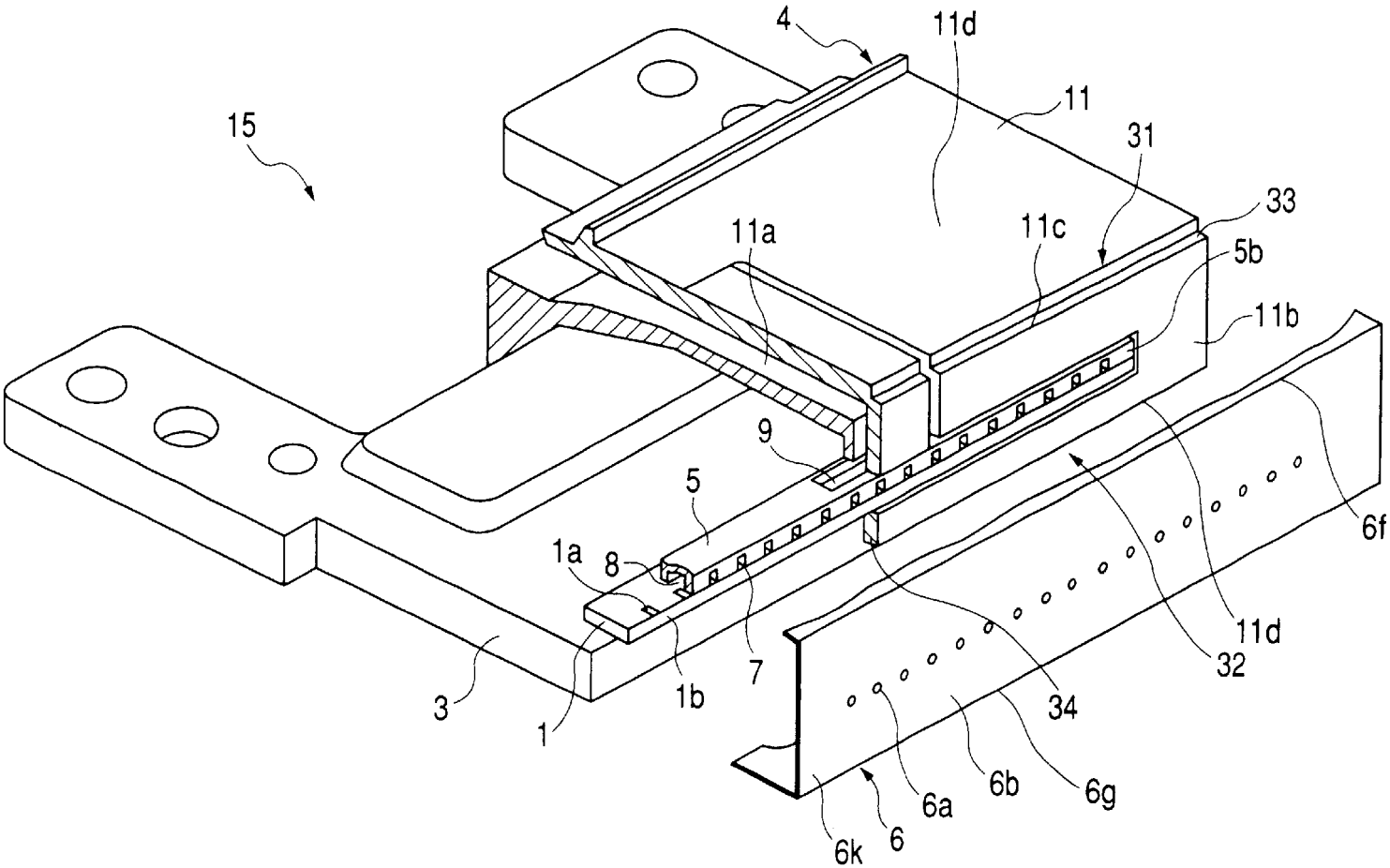
FIG. 28 is an exploded perspective view which illustrates the structure of the liquid discharge recording head in accordance with a ninth embodiment of the present invention.
Figure 29:
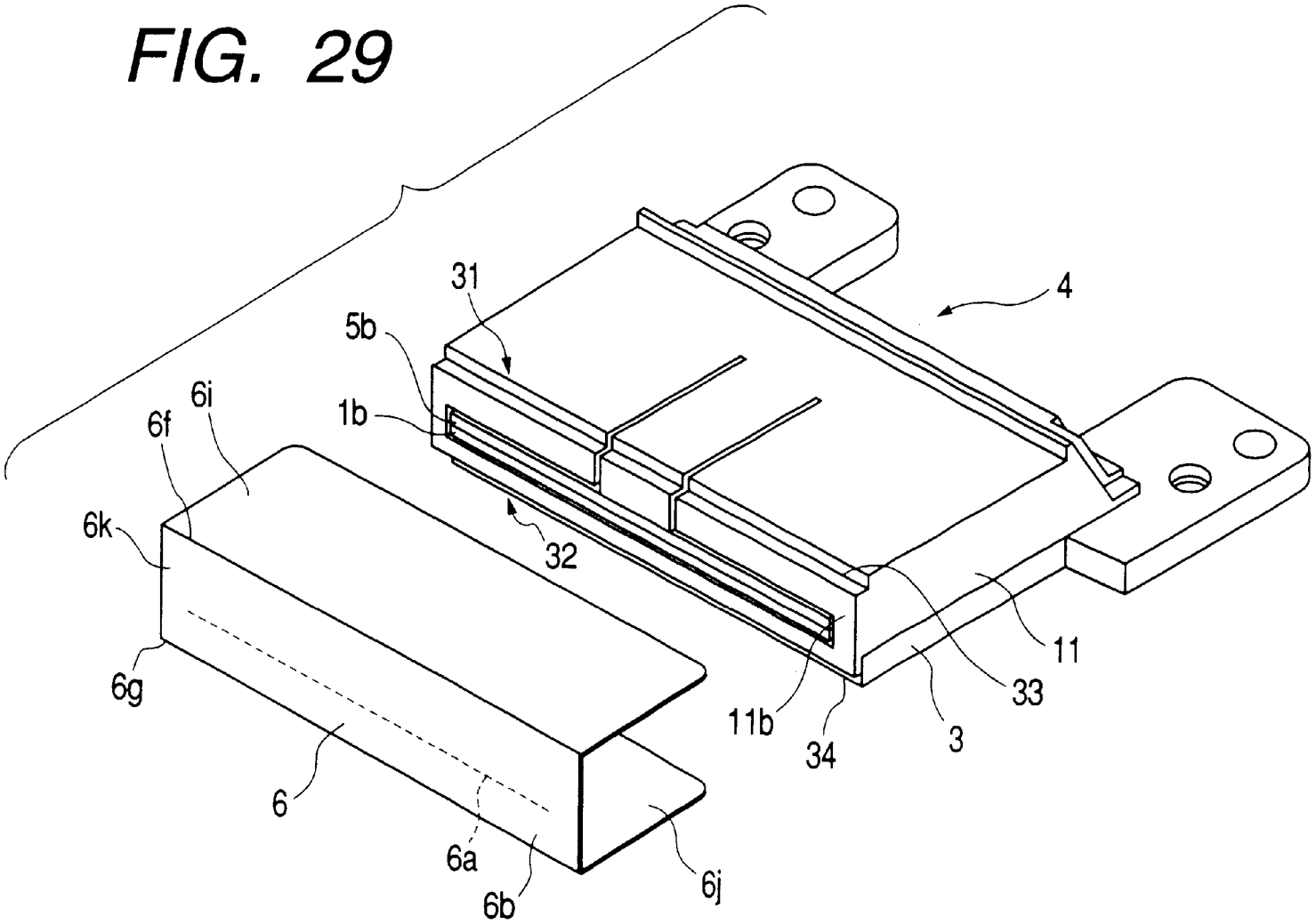
FIG. 29 is an exploded perspective view which illustrates the structure of the liquid discharge recording head in accordance with a ninth embodiment of the present invention.
Figure 30:
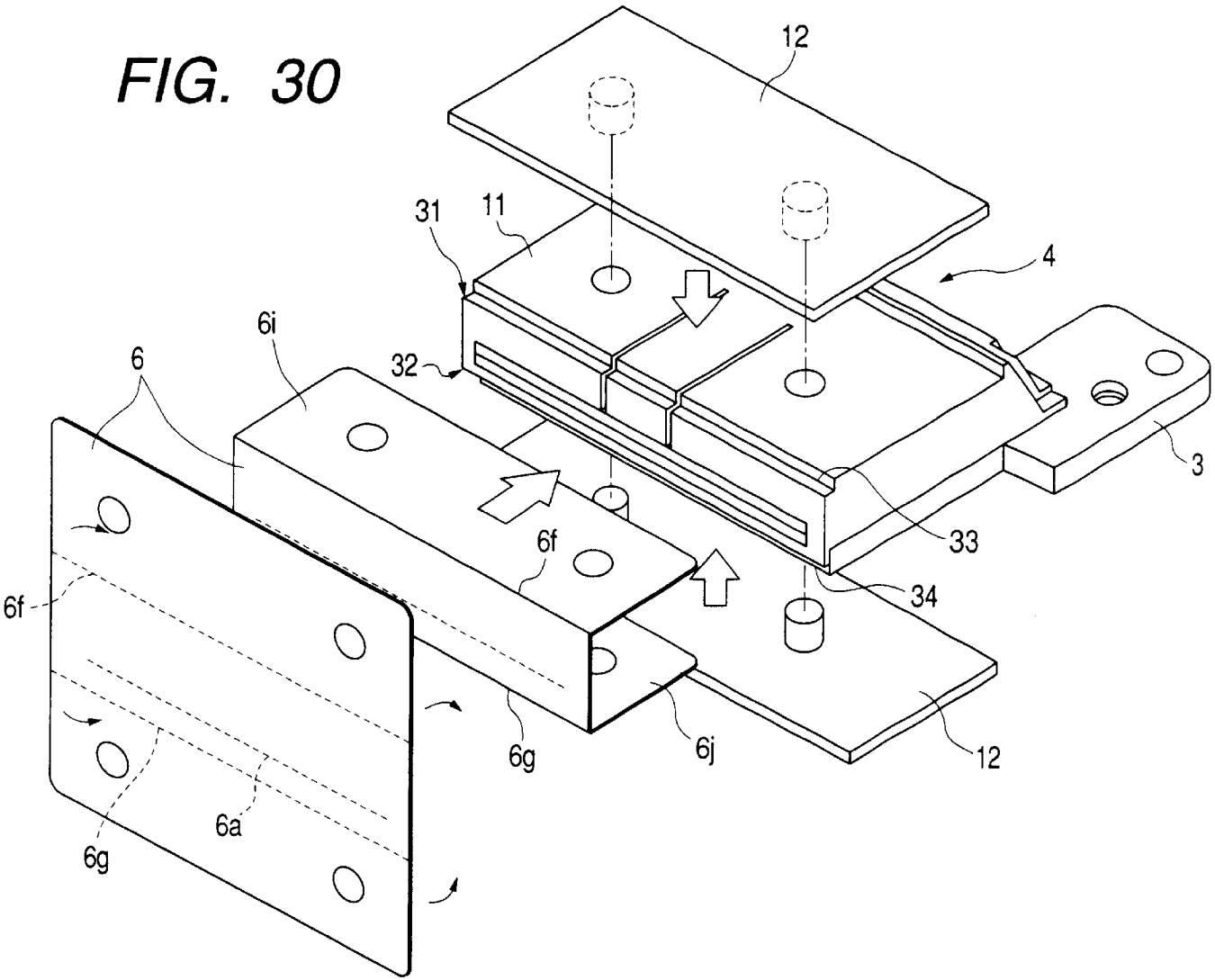
FIG. 30 is an exploded perspective view which illustrates the structure of the liquid discharge recording head in accordance with a ninth embodiment of the present invention.

FIG. 28 to FIG. 30 are exploded perspective views which illustrate the structure of the liquid discharge recording head in accordance with a ninth embodiment of the present invention. FIG. 28 sectionally shows the base plate of the liquid discharge recording head. Also, FIG. 30 represents the state where the orifice plate of liquid discharge recording head is folded.

As shown in FIG. 28, in accordance with the present embodiment, the heater board 1 is die bonded onto the base plate 3 serving as the supporting substrate of the liquid discharge recording head 15. The heater board 1 is formed in such a manner that electrothermal converting elements (hereinafter referred to as discharge heaters) 1*a* serving as energy generating means to generate thermal energy for discharging liquid ink, and wiring to supply electric power to the discharge heaters 1*a* are formed on a silicon base plate by means of silicon film formation process. As the material for the base plate 3, aluminum, ceramics, or the like is used. The base plate 3 also functions as heat sink to cool the heater board 1 by radiating the heat of heater board 1, which is generated along with the driving of the discharge heaters 1*a*.

On the surface of the heater board 1 on the discharge heaters 1*a* side, the ceiling plate 5 is bonded to form ink flow paths. On the surface of ceiling plate 5 on the heater board 1 side, there are formed a plurality of grooves for forming nozzles 7 serving as liquid flow paths, and the recessed portion for forming the common liquid chamber 8 communicated with each of the nozzles 7. The grooves and recessed portion on the ceiling plate 5 may be formed by photosensitive resin, for example. The plural ink flow path grooves, each becoming the nozzle 7, are arranged on the ceiling plate 5 to be in agreement with the arrangement of the discharge heaters 1*a* of heater board 1. Thus, when the heater board 1 and the ceiling plate 5 are bonded, a plurality of nozzles 7 aligned on one straight line, and the common liquid chamber 8 are formed, and then, each of the discharge heaters 1*a* is arranged for each of the nozzles 7.

The grooves that form plural nozzles 7 may be formed on the heater board 1, not on the ceiling plate 5 side. In this case, photosensitive resin layer, such as epoxy resin, is laminated on the upper face of heater board 1, and then, partition walls are formed by photolithographic process, such as etching, to separate each of the nozzles 7. In this manner, the grooves that becomes nozzles 7 are formed. Then, the ceiling plate is bonded onto the heater board 1 with the intervention of the partition wall layer on the heater board 1. The grooves on the heater board 1 are then covered by the ceiling plate to form nozzles 7 serving as ink flow paths.

Also, in the mode of the ceiling plate 5 being formed by resin, it may be possible to form the grooves for use of nozzles 7 integrally with the ceiling plate 5 on the lower face thereof by means of injection molding without any problem or form the grooves for use of nozzles 7 by means of excimer laser processing subsequently to the injection molding. Further, it may be possible to form the ink flow path grooves by means of anisotropic etching when the ceiling plate 5 is produced using silicon or the like.

In either case, the mode, in which the grooves for use of nozzles 7 are provided for the upper face of heater board 1, necessities the arrangement of the grooves for use of nozzles 7 and the discharge heaters 1*a* by means of the semiconductor film formation technologies after the relative positions thereof are aligned in high precision. On the other hand, the mode, in which the grooves for use of nozzles 7 are provided for the lower face of the ceiling plate 5, the relative positions of both grooves for use of nozzles 7 and the discharge heaters 1*a* are arranged after highly precise adjustment by means of mechanical alignment process.

Also, the ceiling plate 5 is provided with the ink supply port 9 to receive ink supplied form an ink tank (not shown) and induce ink into the common liquid chamber 8, thus ink in the common liquid chamber 8 being supplied to each of the nozzles 7. The common liquid chamber 8 functions as a tank to retain ink provisionally before being supplied to each of the nozzles 7.

Also, the liquid discharge recording head 15 is provided with the chip tank 11 to which the base plate 3, the ceiling plate 5, and the heater board 1 are bonded. Inside the chip tank 11, the ink passage 11*a* is formed to guide ink to the ink supply port 9 of ceiling plate 5 from the ink storage tank, sub-tank, or the like (not shown) which is arranged on the upstream position of the liquid discharge recording head 15 in the ink supply passage of the ink jet recording apparatus. The chip tank 11 is provided with the front plate portion 11*b* which is arranged around the front edge face 1*b* of the heater board 1 on the opening edge side of the nozzles 7, as well as around the ceiling plate 5 on the opening edge side of the front edge face 5*b* of the nozzles 7.

The head main body 4 is formed by the base plate 3, the heater board 1, the ceiling plate 1 and the chip tank 11. Then, the orifice plate 6 made in the form of film is bonded to the head main body 4. The orifice plate 6 is bonded to the chip tank 11 and the base plate 3 to cover the surface of front plate portion 11*b* of the chip tank 11, the front face 1*b* of the heater board 1, and the front face 5*b* of the ceiling plate 5, that is, the front faces of plural nozzles 7 on the opening edge side on the head main body 4. For the orifice plate 6, desired numbers of discharge ports 6*a* are formed corresponding to the number of nozzles 7 in order to discharge ink in the nozzles 7 toward a recording medium. Each of the discharge ports 6*a* is communicated with each of the nozzles 7 between the heater board 1 and the ceiling plate 5. Therefore, the discharge ports 6*a* are arranged to be aligned on one straight line as the plural nozzles 7. The plural discharge ports 6*a* are formed by the irradiation of excimer laser beams onto the orifice plate 6, which penetrate the orifice plate 6 from the backside of the orifice plate 6, that is, on the side which becomes the face on the head main body 4 side.

The upper face of chip tank 11, that is, the face of chip tank 11 on the side opposite to the base plate 3 side, is the flat bonding surface lie substantially perpendicular to the surface of front plate portion 11*b*. One edge portion of orifice plate 6 is bonded to this bonding surface lie and fixed. Also, the face of the base plate 3 on the side opposite to the chip tank 11 side is substantially the same size as the bonding surface 11*e* of chip tank 11, which becomes the flat bonding surface substantially perpendicular to the surface of front plate portion 11*b*. The other edge portion of orifice plate 6 is bonded and fixed to that bonding surface.

On the edge portion 31 of front plate portion 11*b* of chip tank 11 on the bonding surface 11*d* side, the cut-off portion 33 is formed extendedly along the edge portion 31 in order to bond the orifice plate 6 to the head main body 4 in good condition by folding the orifice plate 6 to be described later. Also, on the edge portion 32 of front plate portion 11*b* of chip tank 11 on the base plate 3 side, the cut-off portion 34 is formed extendedly along the edge portion 32 in order to bond the orifice plate 6 to the head main body 4 in good condition by folding the orifice plate 6. In this way, each of the cut-offs 33 and 34 is formed on edge portions 31 and 32 to configure the edge portions 31 and 32 with steps, respectively.

As shown in FIG. 28 to FIG. 30, the area of orifice plate 6 is made larger than the area of front plate portion 11*b* of chip tank 11. The orifice plate 6 is folded at two locations of folding ridge lines 6*f* and 6*g* so as to make each of the sectional shapes thereof the laying U-letter form in the direction perpendicular to the alignment direction of discharge ports 6*a*, and bonded to the chip tank 11 and the base plate 3. The folding ridge line 6*f* is the folding line along the edge portion 31 of head main body 4. The folding ridge line 6*g* is the folding line along the edge portion 32 of heat main body 4. One edge portion of orifice plate 6 becomes the fixing portion 6*i* to be bonded to the bonding surface 11*e* of chip tank 11. The other edge portion of orifice plate 6 becomes the fixing portion 6*j* to be bonded to the surface of base plate 3 on the side opposite to the heater board 1 side.

In accordance with the present embodiment, the structure is arranged to fold the orifice plate 6 in the alignment direction of discharge ports 6*a*, but for the present invention, the structure may be such that the orifice plate 6 is folded in the direction at right angles to the alignment direction of discharge ports 6*a*.

Then, the discharge ports 6*a* are aligned on the surface portion 6*k* of orifice plate 6 between the fixing portions 6*i* and 6*j*. This surface portion 6*k* is bonded to the surface of front plate portion 11*b*, that is, the front edge faces of plural nozzles 7 of head main body 4 on the opening edge side. Therefore, the front plate portion 11*b* functions to hold the circumferential portion of discharge ports 6*a* on the orifice plate 6 by being bonded to that portion, and also, functions to support the orifice plate 6 so that the orifice plate 6 can withstand sufficiently the attaching or detaching force and pressure holding force exerted on by the cap member when the capping operation is carried out by the cap member provided for the main body of the recording apparatus. Here, for supporting the orifice plate 6, the front edge face of base plate 3 is used as described later, but, in some cases, the base plate 3 directly supports the orifice plate 6. The plane of the surface portion 6*k* of the orifice plate 6 on the side opposite to the head main body 4 side becomes the facing end 6*b* which is the discharge port formation surface of the liquid discharge recording head 15.

As shown in FIG. 29, the structure is arranged to fix the folded orifice plate 6 to the head main body 4 in such a manner that by use of connecting means, such as the pressure plate 12 or pins (not shown) or by means of adhesion using bonding agent, welding, or the like, the fixing portions 6*i* and 6*j* of orifice plate 6 are fixed to the head main body 4.

As the material of ceiling plate 5, it is possible to use resin, such as polysulfone, polyether sulfone, polypropylene, denatured polyphenylene oxide, polyphenylene sulphide, or liquid crystal polymer or such material as ceramics, silicon, silicon nitride, nickel, carbon, or glass.

For the orifice plate 6, it is possible to use metallic plate, such as SUS (stainless steel), Ni, Cr, or Al, or a resin mold, resin film material, or the like, such as polyimide, polysulfone, polyether sulfone, polyphenylene oxide, polyphenylene sulfide, or polypropylene Now, the description will be made of the outline of assembling process of the liquid discharge recording head 15 described above.

At first, the discharge heaters 1*a* on the heater board 1, and the grooves that become the nozzles 7 on the ceiling plate 5, which face the discharge heaters 1, respectively, are aligned so as to be in agreement in high precision. After that, using bonding means, such as bonding agent, or pressure means, such as pressure spring (not shown), the heater board 1 and the ceiling plate 5 are set to be closely in contact. In this manner, the nozzles 7 that become ink flow paths are formed between the heater board 1 and ceiling plate 5.

Next, the chip tank 11 is incorporated on the heater board 1 having the ceiling plate 5 set to be closely in contact therewith, which is fixed to the base plate 3, thus connecting the ink supply port 9 of ceiling plat 5 with the ink passage 11*a* of chip tank 11. In this way, the front plate portion 11*b* of chip tank 11 covers the front edge face 1*b* of heater board 1 and the circumference of the front edge face 5*b* of ceiling plate 5. At this juncture, the edge faces 1*b* and 5*b* are structured to protrude forward from the front face of the front plate portion 11*b* by approximately several tens of $\mu$m to several hundreds of $\mu$m.

Then, the orifice plate 6 is bonded by bonding means, such as bonding agent, to the edge faces 1*b* and 5*b* formed to protrude from the front plate portion 11*b* by the close contact of the heater board 1 and ceiling plate 5.

At this juncture, the front face of the front plate portion 11*b*is retracted from the edge faces 1*b* and 5*b* so as not to hinder bonding the orifice plate 6 and the edge faces 1*b* and 5*b* of orifice plate 6.

Figure 31:
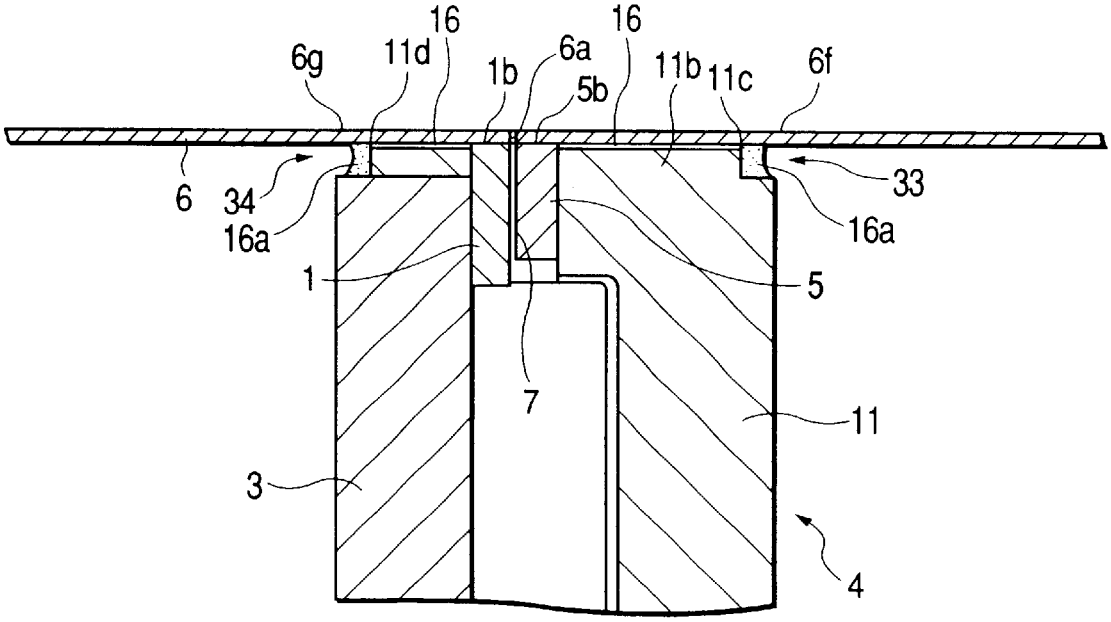
FIG. 31 is a cross-sectional view which illustrates the process for bonding the orifice plate to the head main body.
Figure 32:
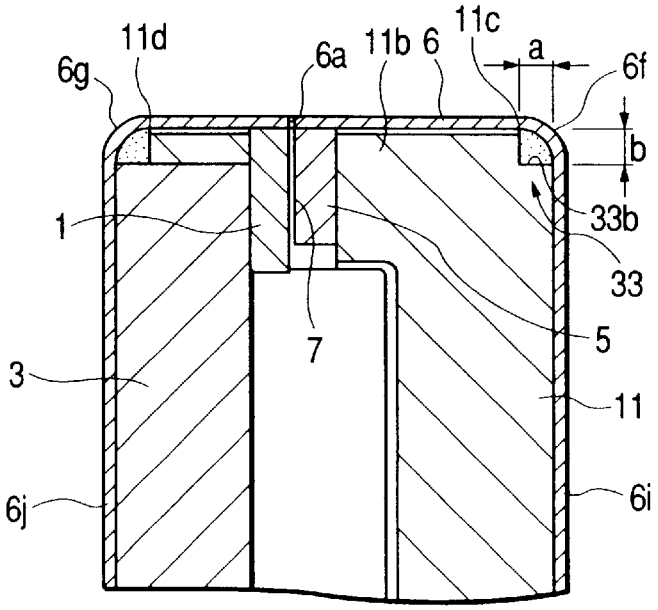
FIG. 32 is a cross-sectional view which shows the face portion of a liquid discharge recording head.

FIG. 31 is a cross-sectional view which illustrates the process of bonging the orifice plate 6 to the head main body 4. FIG. 31 is a cross-sectional view which shows the portion of head main body 4 on the nozzle 7 side. Also, FIG. 32 is a cross-sectional view which shows the portion of liquid discharge recording head 15 of the present embodiment on the discharge port 6*a* side, that is, the surface portion of liquid discharge recording head 15.

As shown in FIG. 31, when the orifice plate 6 is bonded to the head main body 4, the orifice plate 6 is at first positioned to the front edge faces 1*b* and 5*b*, which protrude from the front plate portion 11*b*, so that the discharge ports 6*a* are communicated with the nozzles 7 in the state where the orifice plate 6 is not folded, thus fixing the orifice plate 6 by use of fixing means, such as bonding agent. Then, bonding agent, sealant having boding power, or the like is poured into the gap 16 formed between the backside of orifice plate 6 on the head main body 4 side, and the front plate portion 11*b*.

For bonding the backside of orifice plate 6 and the front plate portion 11*b*, epoxy bonding agent having excellent characteristic of ink resistance is used in general. The bonding by use of epoxy bonding agent adopts UV irradiation or heating to promote the hardening of bonding agent, but in order to maintain the alignment of discharge ports 6*a* in high precision, the influence of bonding agent, such as hardening shrinkage, thermal expansion, should be reduced. It is therefore preferable to adopt a hardening method using both UV irradiation and low-temperature curing treatment.

Now, after the circumferential portion of discharge ports 6*a* of orifice plate 6, that is, the surface portion 6*k* of orifice plate 6, is fixed to the head main body 4, the orifice plate 6 is folded in the vicinity of edge portions of front plate portion 11*b* of chip tank 11, that is, each near at the edge portions 31 and 32 of head main body 4. Lastly, the fixing portions 6*i* and 6*j* of the folded orifice plate 6 are fixed to the head main body 4 by means of the pressure plate 12 or the like as described above.

When the orifice plate 6 is folded, stress is exerted on the orifice plate 6 by the bending elasticity owned by the material of orifice plate 6 itself to return it to the flat surface with the result that the folded portions of orifice plate 6 draw an arc, respectively. However, as described above, with the provision of cut-off portions 33 and 34 for the edge portions 31 and 32, respectively, it is possible to form the arc corresponding to the bending stress of orifice plate 6 at each of the folding portions of orifice plate 6, because, as shown in FIG. 32, each of the front edge portion ridge lines 11*c* and 11*d* of front plate portion 11*b*is positioned inside the folding ridge lines 6*f* and 6*g* of orifice plate 6, respectively. In this way, the orifice plate 6 can be folded without causing the folding ridge lines 6*f* and 6*g* of orifice plate 6 to float from the surface of front plate portion 11*b*.

Further, with bonding agent or sealant having bonding power to be poured into the gap 16 between the backside of orifice plate 6 and the front plate portion 11*b*, the sealant pool 16*a* is formed each in the cut-off portions 33 and 34. When the orifice plate 6 is folded, the sealant pools 16*a* flow into the gap between the inner wall of cut-off portion 33 and the orifice plate 6, and the gap between the cut-off portion 34 and the orifice plate 6, respectively, and deformed. As a result, there is no possibility that the sealant pools 16*a* cause the orifice plate 6 to be extruded or protruded.

Also, as shown in FIG. 32, with the appropriate setting of the distance a between the folding ridge line 6*f* of orifice plate 6 and the front portion ridge line 11*c* of front plate portion 11*b*, and also, the distance between the folding ridge line 6*g* and the front edge portion ridge line 11*d*, it becomes possible to absorb the variation of the amounts of sealant pools 16*a*, thus making margins larger in the manufacturing steps.

As described above, when the backside of orifice plate 6 and the front plate portion 11*b* are bonded by use of bonding agent or sealant having bonding power, the folding stress exerted on the orifice plate 6 is put down to obtain the flatness of the facing end 6*b* of orifice plate 6, namely, the flatness of the discharge port formation surface of liquid discharge recording head 15, more assuredly with higher reliability. In order to reliably obtain the flatness of facing end 6*b* more assuredly, it is desirable to effectuate bonding the orifice plate 6 and the front plate portion 11*b* after the orifice plate is folded.

The distance between the folding ridge line of orifice plate 6 and the front portion ridge line of front plate portion 11*b* is set at a designated value depending on the material of orifice plate 6 and bending robustness, thickness, shape, and others thereof. Also, the range of choice therefor is made greater depending on whether or not the orifice plate 6 is bonded to the front plate portion 11*b*. It is of course better to set the distance a greater between the folding ridge line 6*f* and the front portion ridge line 11*c* in order to make the folding configuration favorable for the orifice plate 6. However, the area of the front plate portion 11*b* to receive the orifice plate 6 becomes smaller to that extent. On the contrary, if the distance a is too small, the folded configuration becomes unfavorable for the orifice plate 6. Therefore, it is necessary to set the distance a, and the distance b from the folding ridge line 6*f* to the stepped surface 33*b* of edge portion 33 shown in FIG. 32 each at an appropriate value in consideration of the property of material used for the orifice plate 6 and others.

Figure 33:
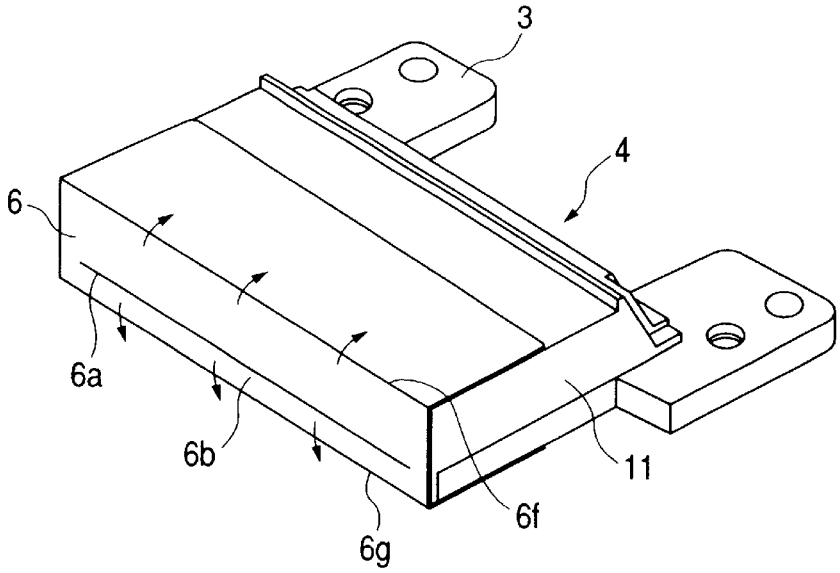
FIG. 33 is a view which illustrates the method for fixing the orifice plate to the head main body by folding it.

FIG. 33 is a view which illustrates the method for folding and fixing the orifice plate 6 to the head main body 4.

When the orifice plate 6 is folded and fixed to the head main body 4, it is preferable to fix the orifice plate 6 while exerting tension on the orifice plate 6 as shown in FIG. 33 by pulling both edge portions of orifice plate 6 in the direction in which each of both edge portions of orifice plate 6 is caused to part from the surface 6*a*, and also, in the direction perpendicular to the alignment direction of discharge ports 6*a*. In this way, the flatness of the facing end 6*b* of orifice plate 6 is enhanced more, and also, the orifice plate 6 is prevented from floating from the chip tank 11. As a result, the preventive effect becomes greater to protect the orifice plate 6 from being peeled off. However, if the tension that should be exerted on the orifice plate 6 is made larger than necessary, the discharge ports 6*a* are deformed and broken. It is required to set tension at an appropriate value in consideration of the material used for the orifice plate 46, as well as the strength and shape thereof.

Figure 34:
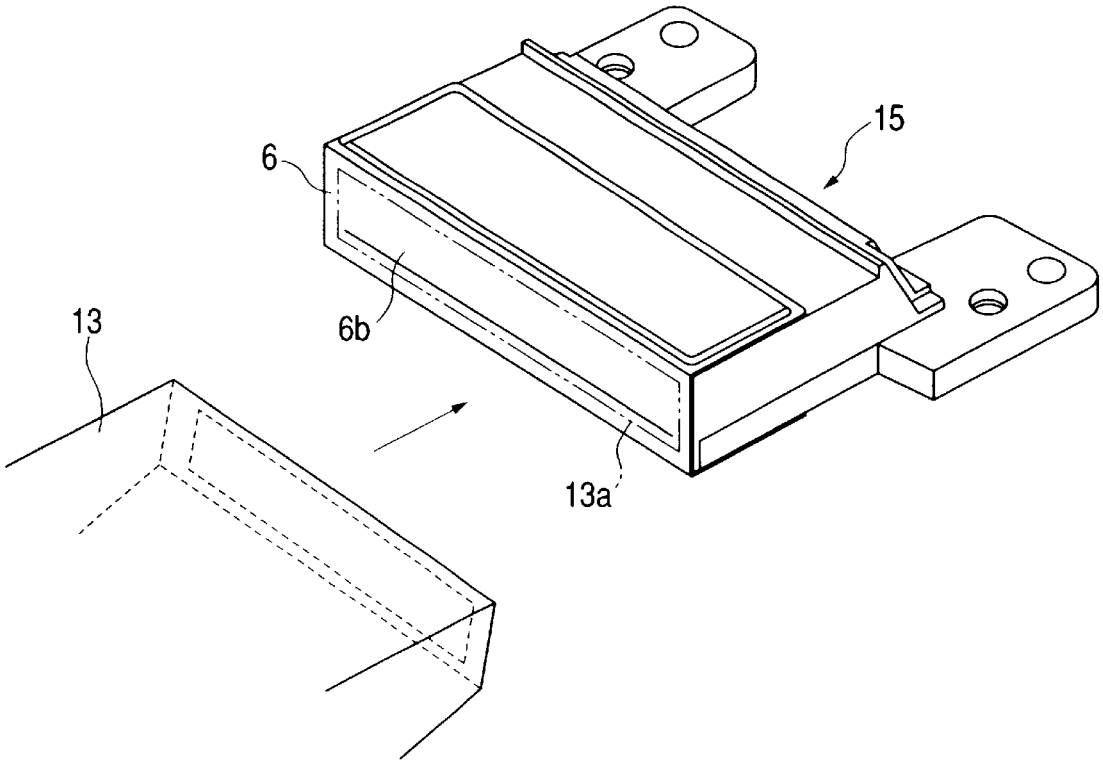
FIG. 34 is a perspective view which illustrates the capping operation for a liquid discharge recording head.
Figure 35:
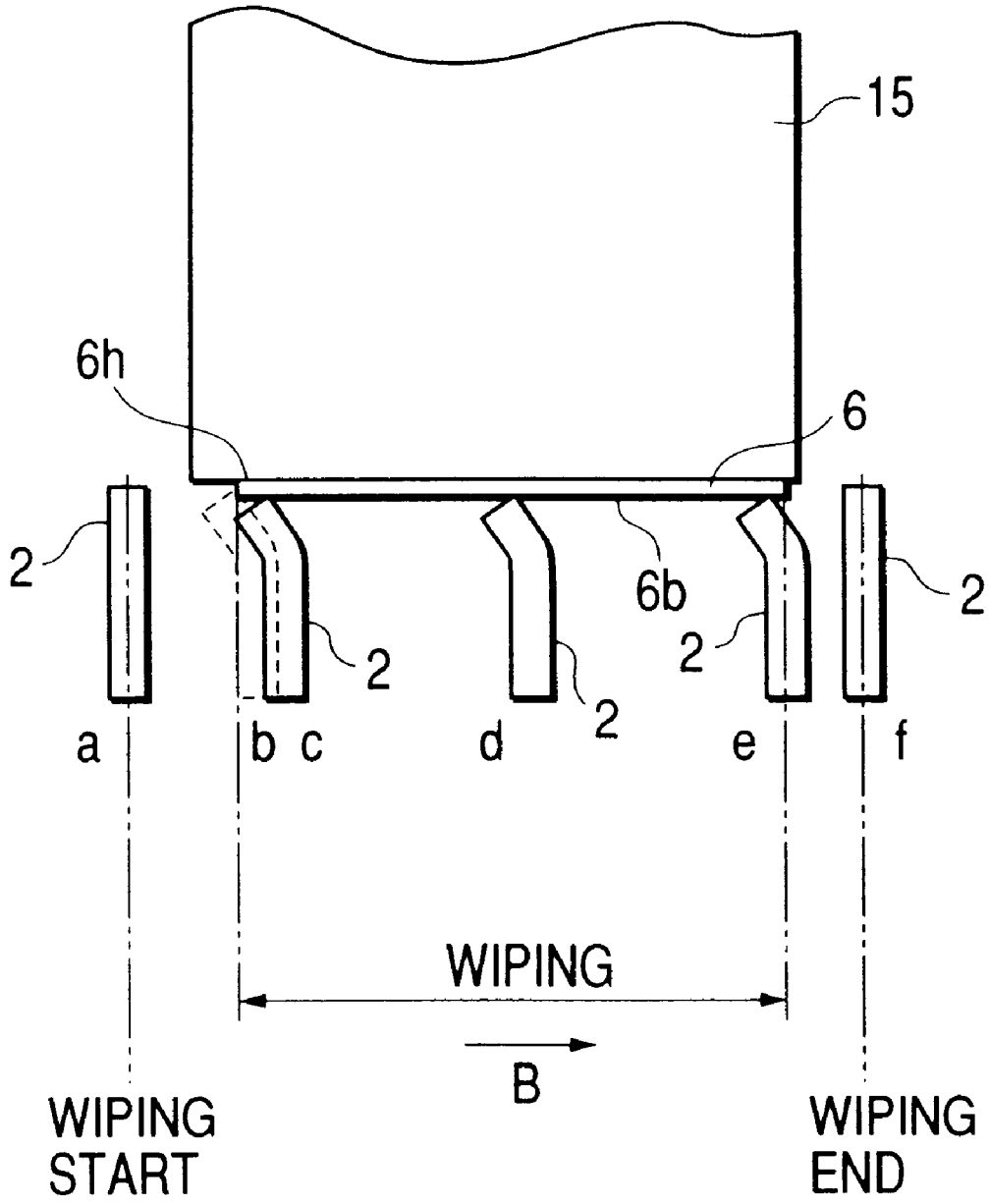
FIG. 35 is a view which schematically illustrate the wiping operation for a liquid discharge recording head.

FIG. 34 is a perspective view which illustrates the capping operation for the liquid discharge recording head 15. FIG. 35 is a view which shows the wiping operation schematically for the liquid discharge recording head 15.

The liquid discharge recording head 15 of the present embodiment is mounted on an ink jet recording apparatus which is a liquid discharge recording apparatus for recording on a recording medium. The ink jet recording apparatus discharges liquid ink from the liquid discharge recording head 15 toward the recording medium. Then, with the adhesion of ink on the recording medium, recording is made on the recording medium. Also, for the ink jet recording apparatus having the liquid discharge recording head 15 mounted thereon, is provided with the cap member that airtightly covers the facing end 6*b* of liquid discharge recording head 15 as in the conventional recording apparatus, that is, the area of the discharge port formation surface of liquid discharge recording head 15 where a plurality of discharge ports 6*a* are positioned, including all the discharge ports 6*a* on that surface, and also, provided with the wiping blade that cleans the facing end 6*b* by wiping the facing end 6*b*.

For the liquid discharge recording head 15 of the present embodiment, the cap member 13 advances, as shown in FIG. 34, onto the facing end 6*b* of orifice plate 6 to be in contact with the facing end 6*b* in order to operate the recovery of the liquid discharge recording head 15 when recording operation is carried out by means of liquid discharges. Then, the cap member 13 airtightly covers the capping area 13*a* including the array of discharge ports 6*a* on the facing end 6*b*. In this case, with the structure of liquid discharge recording head 15 of the present embodiment having the facing end 6*b* of orifice plate 6, that is, the flat discharge port formation surface of the liquid discharge recording head 15 which presents no stepping portion, the portion of facing end 6*b* that contacts with the cap member 13 is able to secure good airtightness on any part of the facing end 6*b* area. As a result, there is no need for defining the accuracy of components used for the cap member 13, as well as the accuracy of advancing position of the cap member 13 onto the facing end 6*b* of orifice plate 6, in high precision to make it possible to simplify the recovery device, and the recording apparatus on which the liquid discharge recording head 15 is mounted, and manufacture the recording apparatus at lower costs.

Next, the description will be made of the wiping operation to be carried out after having capped the facing end 6*b* of orifice plate 6 using the cap member 13 or after the operation of continuous discharges. FIG. 35 shows the state a of the wiping blade which is before wiping operation, the state b, the initiation of wiping operation, the states c, d, and e, during wiping operation, and the state f, after wiping operation, respectively.

As shown in FIG. 35, the wiping blade 2 advances onto the facing end 6*b* of orifice plate 6 when wiping operation is carried out, and wipes the facing end 6*b* by use of the wiping blade 2 to clean it. This operation is necessary for obtaining good recording. Here, the wiping blade 2 moves from the state a in the direction indicated by arrow B in parallel to the alignment-direction of discharge ports 6*a*. Then, when the wiping blade 2 advances onto the facing end 6*b* in the state b, the wiping blade 2 is in contact with the edge portion 6*h* of orifice plate 6 in the alignment direction of discharge ports 6*a*. As a result, there is a fear that the orifice plate 6 is peeled off by the wiping blade 2. This is because the wiping blade 2 hooks the edge portion 6*h* of orifice plate 6 when the wiping blade 2 advances onto the orifice plate 6, and also, because the bonding strength for the orifice plate 6 is insufficient, among some other reasons. In either case, it is impossible to obtain sufficient bonding strength for the orifice plate in the mode of one-face bonding as in the conventional liquid discharge recording head that the orifice plate is bonded to the head main body only through the surface thereof.

In contrast, the liquid discharge recording head 15 of the present embodiment has three bonding faces, that is, the bonding face of orifice plate 6 with the head main body 4, and the fitting faces provided for bonding, because the orifice plate 6 is folded. In other words, the bonding mode of the orifice plate 6 here provides the three-face holding that includes bonding between the fixing portion 6*i* of orifice plate 6 and the bonding face 11*d* of chip tank 11, bonding between the surface 6*k* of orifice plate 6 and the front plate portion 11*b*, and bonding between the fixing portion 6*j* of orifice plate 6 and the backside of base plate 3. In this manner, the reaction force of orifice plate 6 against the wiping blade 2 is not only the one created on the backside of surface portion 6*k* of orifice plate 6, but also, those created on the backsides of fixing portions 6*i* and 6*j* of orifice plate 6, that is, two face on the folded portions thereof, thus obtaining the larger reaction force altogether. As a result, with the three-face holding mode of the kind, the bonding strength of orifice plate 6 is enhanced significantly to enable the orifice plate 6 to obtain a great reaction force against the slidably rubbing of wiping blade 2.

Also, if external force is exerted on the contact surface of orifice plate 6 with the wiping blade 2 so as to cause the orifice plate 6 to be peeled off, such force should be strong enough to shear the orifice plate 6 at the folded portion or the like, because the orifice plate 6 is held. Usually, the breaking force in the shearing direction of orifice plate 6 is much greater than the pressure exerted by the wiping blade 2 on the surface of orifice plate 6. Substantially, therefore, there is no possibility that the orifice plate 6 is peeled off by the wiping blade 2.

When the advancing direction of wiping blade 2 is perpendicular to the direction shown in FIG. 35, that is, if such direction is set to be perpendicular to the alignment direction of discharge ports 6*a*, the wiping blade 2 is in contact with the folding ridge line 6*f* or 6*g* of orifice plate 6 eventually. As a result, in this case, there is almost no possibility that the wiping blade 2 hooks the edge portion of orifice plate 6 so as to cause the orifice plate 6 to be peeled off.

Figure 36:
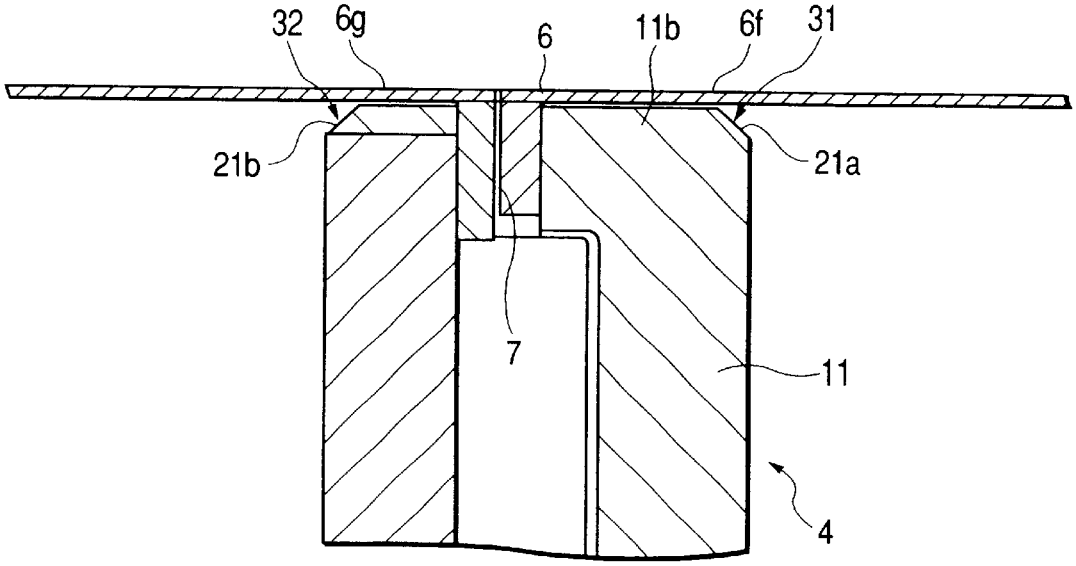
FIG. 36 is a cross-sectional view which illustrates the variational example of the liquid discharge recording head.
Figure 37:
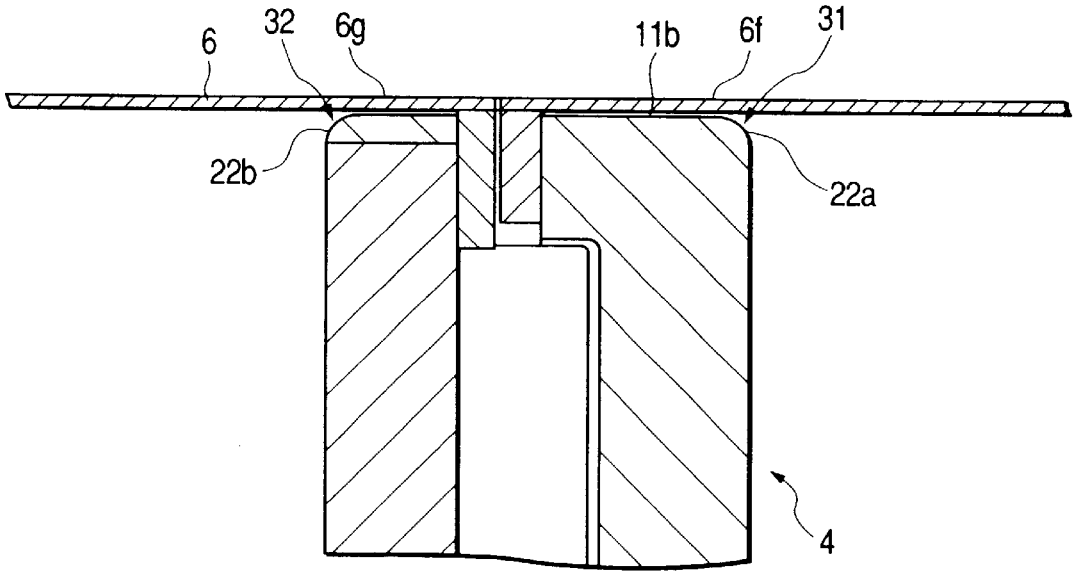
FIG. 37 is a cross-sectional view which illustrates the variational example of the liquid discharge recording head.

Next, with reference to FIG. 36 and FIG. 37, the description will be made of the variational examples of the liquid discharge recording head 15 of the present embodiment. FIG. 36 and FIG. 37 are cross-sectional views which illustrate the variational examples of the liquid discharge recording head 15. FIG. 36 and FIG. 37 illustrate the section of surface portion of liquid discharge recording head 15, respectively. Also, FIG. 36 and FIG. 37 illustrate the state before the orifice plate 6 is folded and bonded to the head main body 4.

For the variational example of liquid discharge recording head 15 shown in FIG. 36, each of the edge portions 31 and 32 of head main body 4 is chamfered. For the variational example of liquid discharge recording head 15 shown in FIG. 37, each of the surfaces of edge portions 31 and 32 of head main body 4 is the curved face regulated by the designated radius R.

For these variational examples, too, when the orifice plate 6 is folded along each of the edge portions 31 and 32 as described above, the inclined faces 21*a* and 21*b* of edge portions 31 and 32 or the curved faces 22*a* and 22*b* of edge portions 31 and 32 receive the wide areas of folded ridge lines 6*f* and 6*g*, respectively. As a result, the folding stress of orifice plate 6 can be distributed smoothly along the edge portions 31 and 32, hence eliminating large floating or protrusion of the orifice plate 6 toward the front plate portion 11*b*. Further, irrespective of the presence of bonding between the front plate portion 11*b* and the orifice plate 6, such effect can be obtained. Of these variational examples, the configuration that the surfaces of edge portions 31 and 32 are made curbed faces is most suitably adoptable when the front plate portion 11*b* and the orifice plate 6 are not bonded among those three configurations of the edge portions 31 and 32 described in accordance with the present embodiment.

Tenth Embodiment

Figure 38:
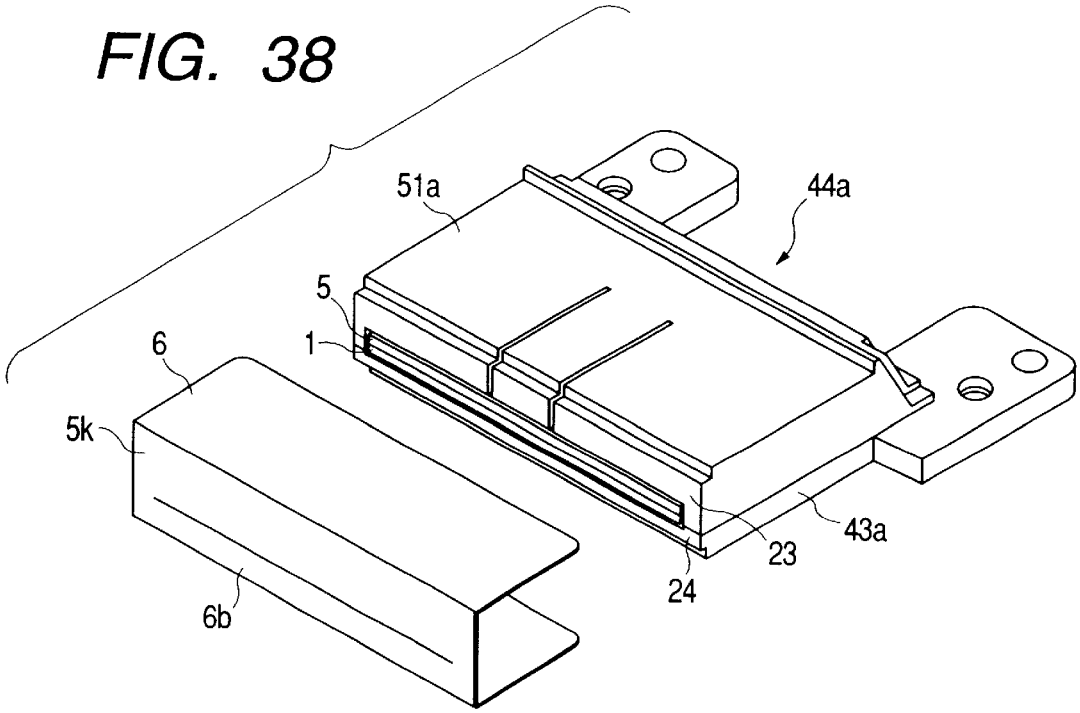
FIG. 38 is an exploded perspective view which illustrates the structure of the liquid discharge recording head in accordance with a tenth embodiment of the present invention.
Figure 39:
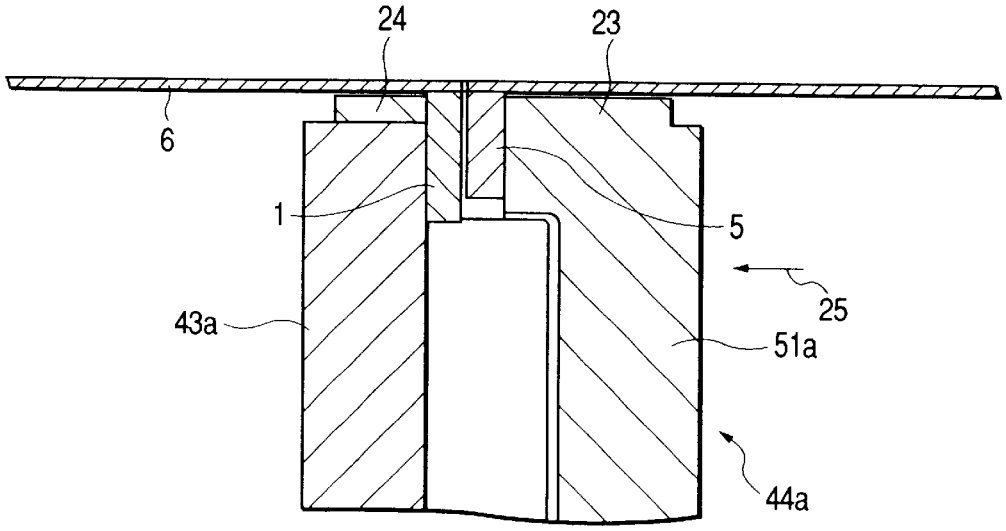
FIG. 39 is a cross-sectional view which shows the face portion of the liquid discharge recording head.

FIG. 38 is an exploded perspective view which illustrates the structure of liquid discharge recording head in accordance with a tenth embodiment of the present invention. FIG. 39 is a cross-sectional view which shows the surface portion of liquid discharge recording head. The liquid discharge recording head of the present embodiment is different from the ninth embodiment in the configurations of chip tank and base plate on the discharge port side. Hereunder, the aspects that differ from those of the ninth embodiment will be described.

As shown in FIG. 38 and FIG. 39, the head main body 44*a* of liquid discharge recording head of the present embodiment comprises the heater board 1, the ceiling plate 5, the base plate 43*a*, and the chip tank 51*a*. Then, the front plate portion of head main body 44*a* comprises the front plate portion 24 of base plate 43*a*, and the front plate portion 23 of chip tank 51*a*. As a result, the plate portion formed by combining the front plate portions 23 and 24 corresponds to the front plate portion 11*b* in the ninth embodiment. The configuration of base plate 43*a* other than the front plate portion 24 is the same as the base plate 3 used for the ninth embodiment, and the configuration of chip tank 51*a* other than the front plate portion 23 is the same as the chip tank 11 used for the ninth embodiment.

Therefore, in accordance with the present embodiment, the front plate portion that receives the surface portion 6*k* of orifice plate 6 is structured by each of the edge portions of two components of chip tank 51*a* and base plate 43*a*. In this manner, with the front plate portion of head main body 44*a* being formed by the front plate portions 23 and 24, it becomes possible to implement the simplification of the part configurations of chip tank 51*a* and base plate 43*a*, respectively. As a result, it becomes possible to implement easier incorporation of components. The chip tank 51*a* to be incorporated with the base plate 43*a*, in particular, demonstrates extremely excellent assembling capability in the direction at 25 in which the chip tank 51*a* is incorporated.

Eleventh Embodiment

Figure 40:
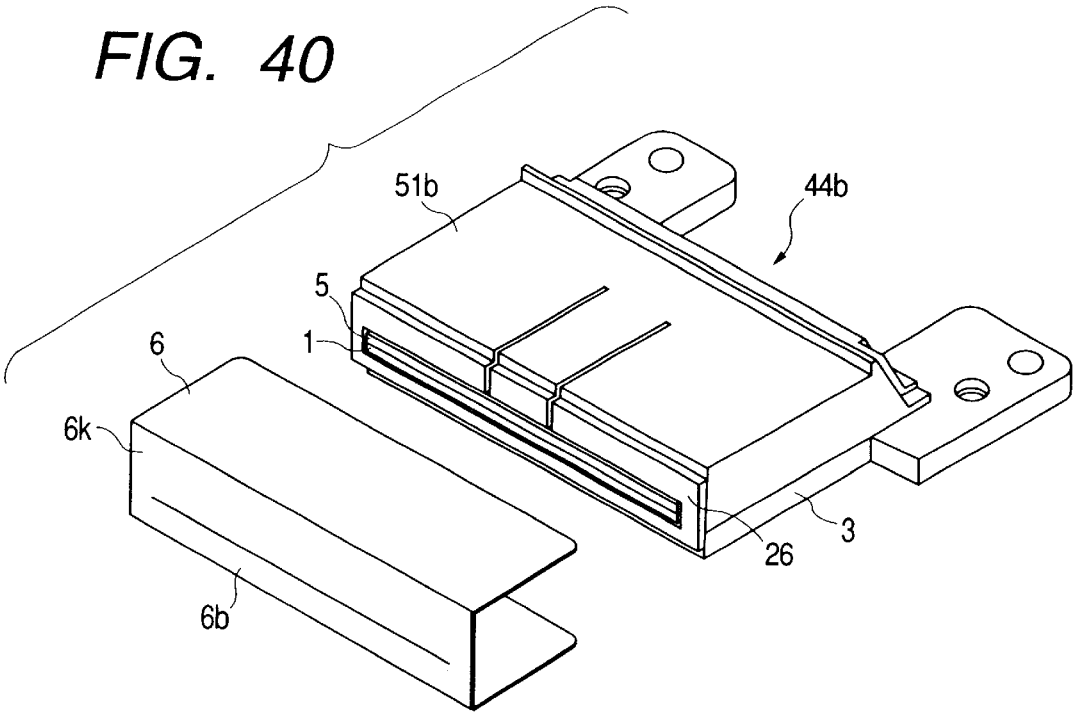
FIG. 40 is an exploded perspective view which illustrates the structure of the liquid discharge recording head in accordance with an eleventh embodiment of the present invention.
Figure 41:
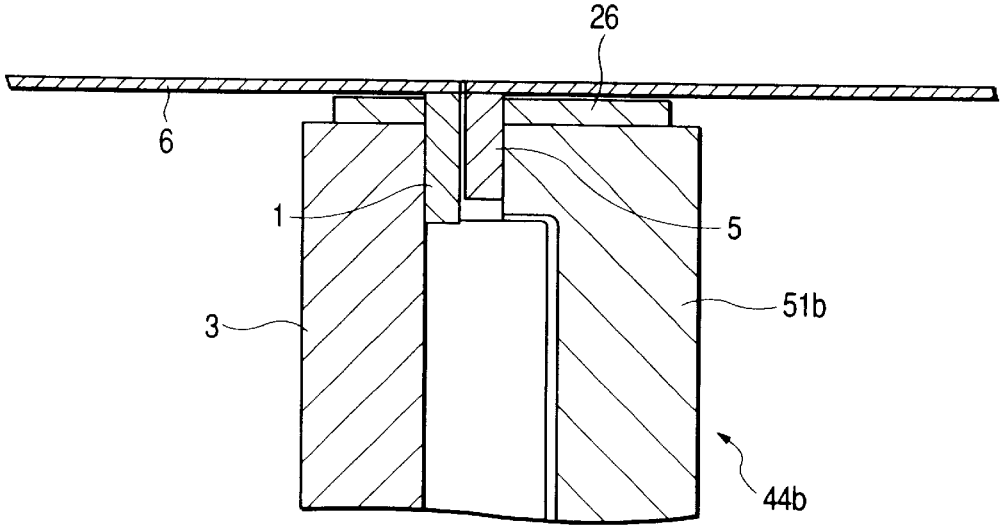
FIG. 41 is a cross-sectional view which shows the face portion of the liquid discharge recording head.

FIG. 40 is an exploded perspective view which illustrates the structure o liquid discharge recording head in accordance with an eleventh embodiment of the present invention. FIG. 41 is a cross-sectional view which shows the surface portion of liquid discharge recording head. The liquid discharge recording head of the present embodiment is different from the ninth embodiment in the configuration of the portion of chip tank on the discharge port side. Also, the aspect that the different members from the chip tank and base plate are used as the front plate portion of head main body is different.

As shown in FIG. 40 and FIG. 41, the head main body 44*b* of the liquid discharge recording head of present embodiment comprises the heater board 1, the ceiling plate 5, the base plate 3, the chip tank 51*a*, and the dedicated front plate member 26. The dedicated front plate member 26 is bonded to the front edge of base plate 3 and chip tank 51*a* on the discharge port 6*a* side. The front plate portion that receives the surface portion 6*k* of orifice plate 6 is structured by the dedicated front plate member 26. In this manner, with the structure formed by the dedicated front plate member 26, the most significant characteristic is demonstrated in that the flatness of the orifice plate receiving portion is easily secured for the head main body 44*b*. Particularly when the nozzle numbers become many to elongate the nozzle array, it becomes difficult to secure the flatness of facing end 6*b* of orifice plate 6. In this case, the flatness of front plate portion that supports the surface portion 6*k* of orifice plate 6 becomes extremely important in particular. Therefore, if the front plate portion of head main body 44*b* is the dedicated front plate member 26 as in the present embodiment, the receiving portion of orifice plate 6 can be formed integrally with such member, and also, the structure thereof becomes comparatively simple. thus making it easier to secure the flatness of the surface of front plate portion.

For the tenth and eleventh embodiments described above, it is possible to configure the edge portions of front plate portion for each of the head main bodies 44*a* and 44*b* to be the one having steps as in the ninth embodiment shown in FIG. 28 to FIG. 32, to be one which is chambered as shown in FIG. 36, or to be the one having curved surfaces as shown in FIG. 37. There is no problem, either, as to the presence or absence of bonding between the orifice plate 6 and the front plate portion of each head main body. In practice, it is implemented to select the optimal structure of liquid discharge recording head from among the three edge portion configurations of front plate portion of the ninth embodiment, each structure of front plate portion of the ninth and tenth embodiments, the presence or absence of bonding between the orifice plate and the front plate portion, and the combination of these structures in consideration of various aspects, such as performance, costs, assembling capability, usage mode, and some others.

Twelfth Embodiment

Figure 42:
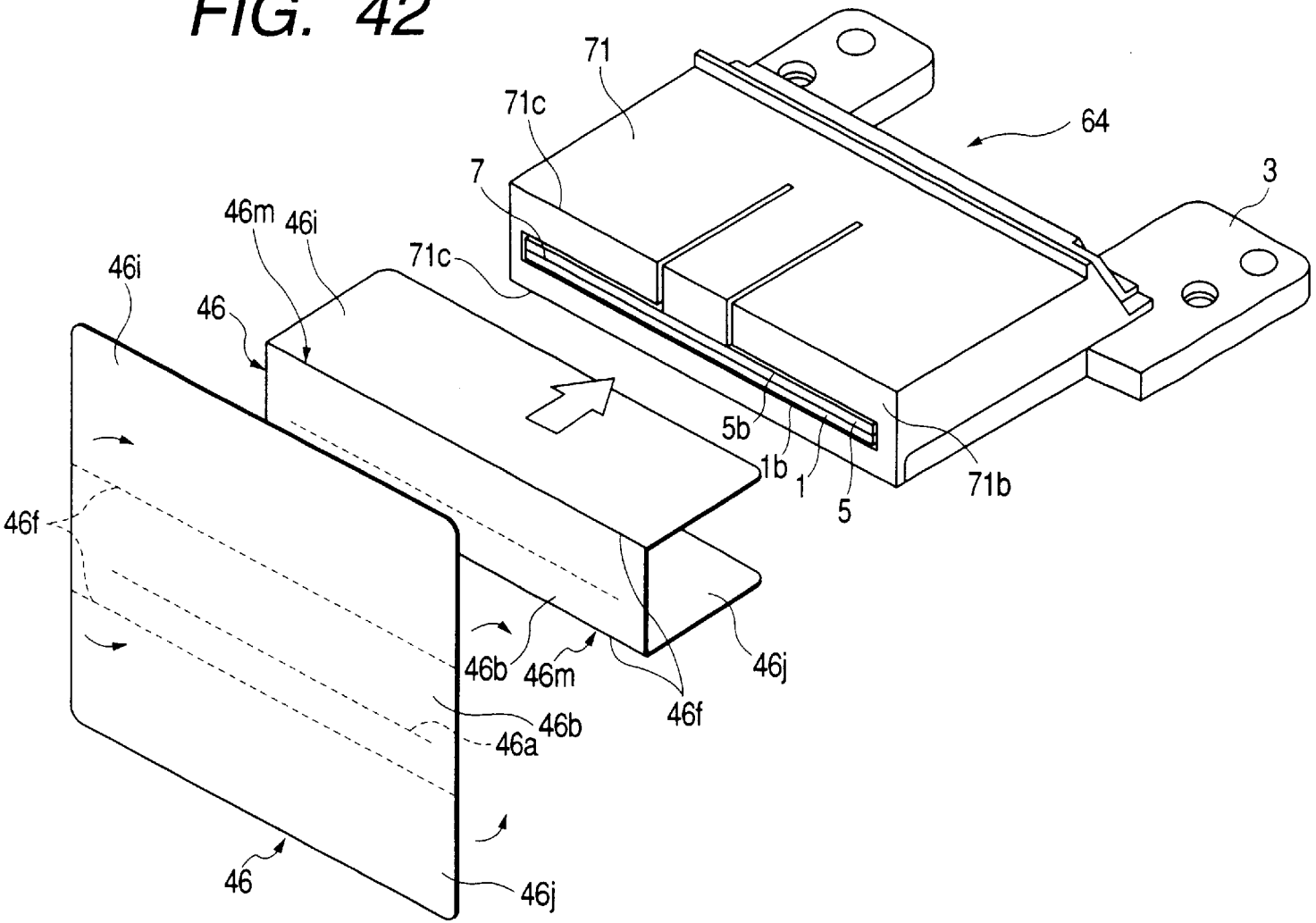
FIG. 42 is an exploded perspective view which illustrates the structure of the liquid discharge recording head in accordance with a twelfth embodiment of the present invention.

FIG. 42 is an exploded perspective view which illustrates the liquid discharge recording head in accordance with a twelfth embodiment of the present invention. As compared with each of the ninth to eleventh embodiments, the liquid discharge recording head of the present embodiment is mainly different in that grooves are formed on the backside of orifice plate in order to bond the orifice plate to the head main body in good condition, instead of configuring the edge portion of head main body to be in the stepped form. In FIG. 42, the same reference marks are applied to the same structural parts as those in the ninth embodiment, and the description will be made centering on the aspects which are different from the ninth embodiment.

As shown in FIG. 42, the head main body 64 of liquid discharge recording head of present embodiment comprises the heater board 1, the ceiling plate 5, the base plate 3, the chip tank 71, and others. The orifice plate 46 is bonded to the head main body 64.

Figure 43:
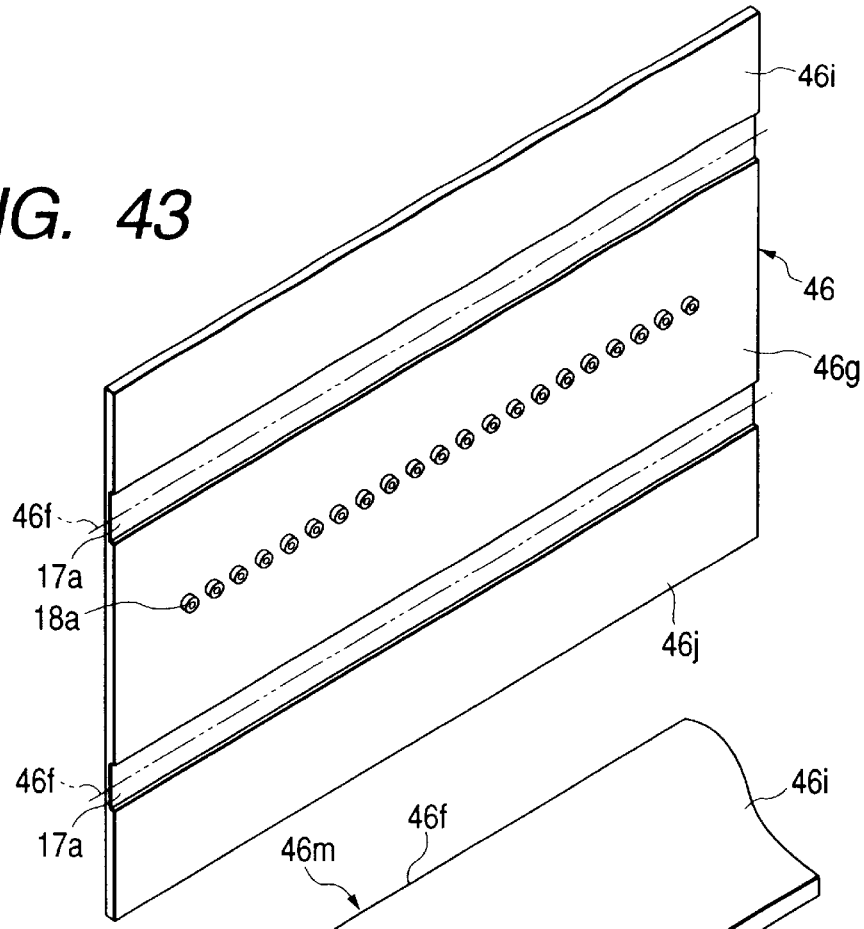
FIG. 43 is a perspective view which shows the state before the orifice plate represented in FIG. 42 is folded.
Figure 44:
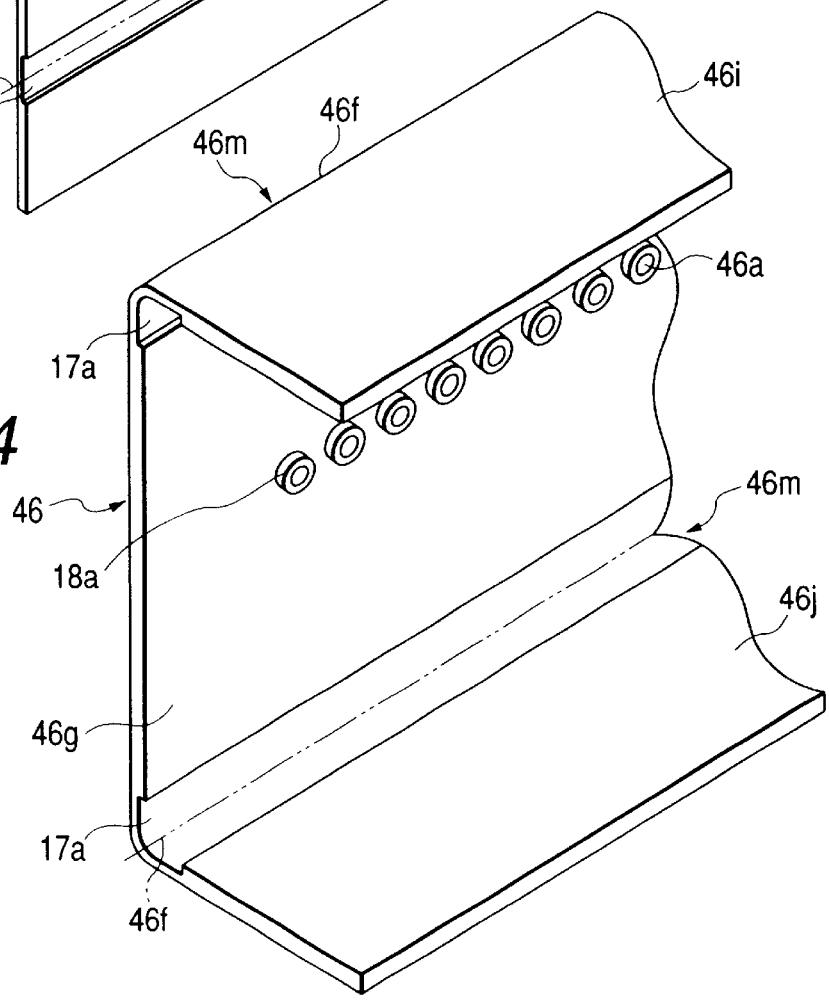
FIG. 44 is a perspective view which shows the state where the orifice plate represented in FIG. 42 has been folded.
Figure 45:
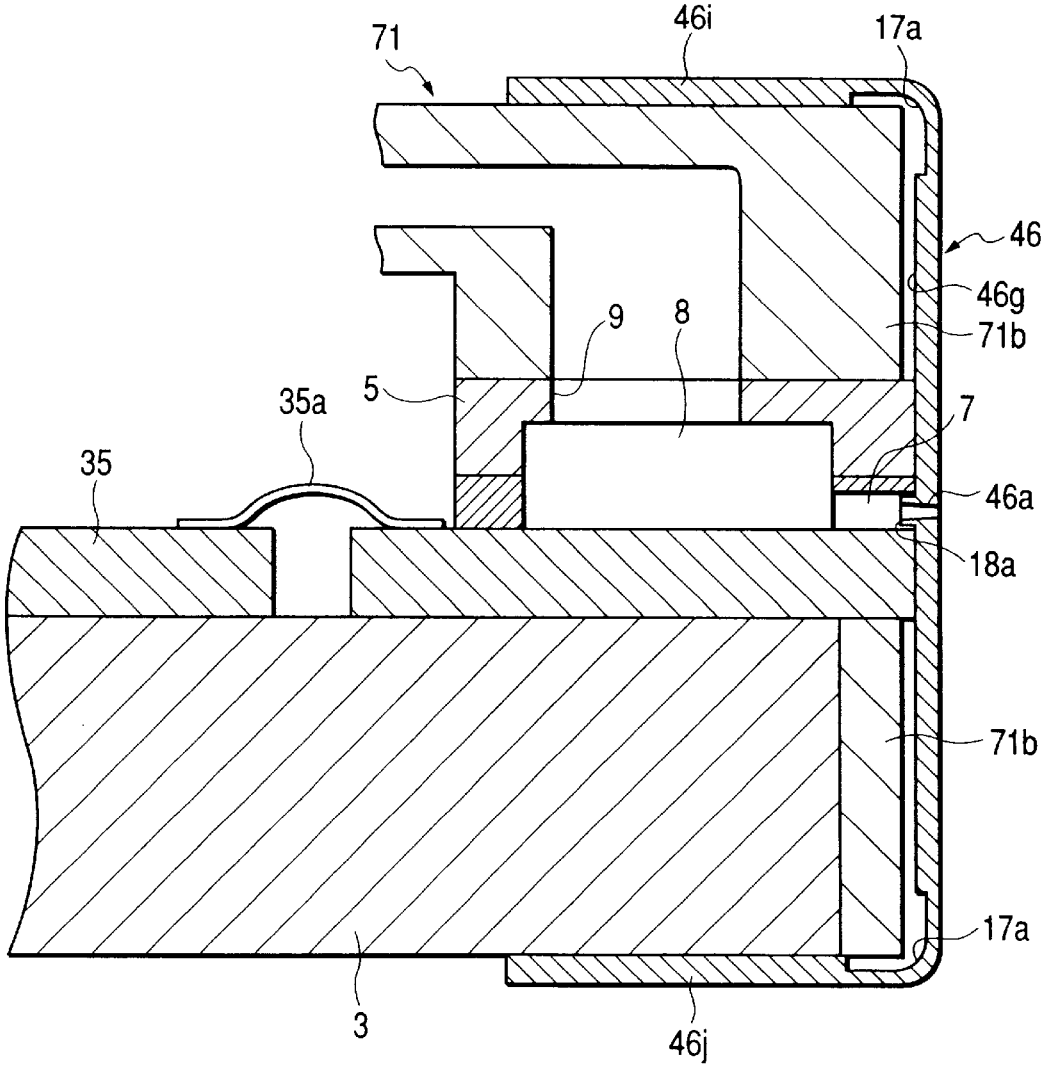
FIG. 45 is a cross-sectional view which shows the portion of the liquid discharge recording head represented in FIG. 42 on the discharge port side.
Figure 46:
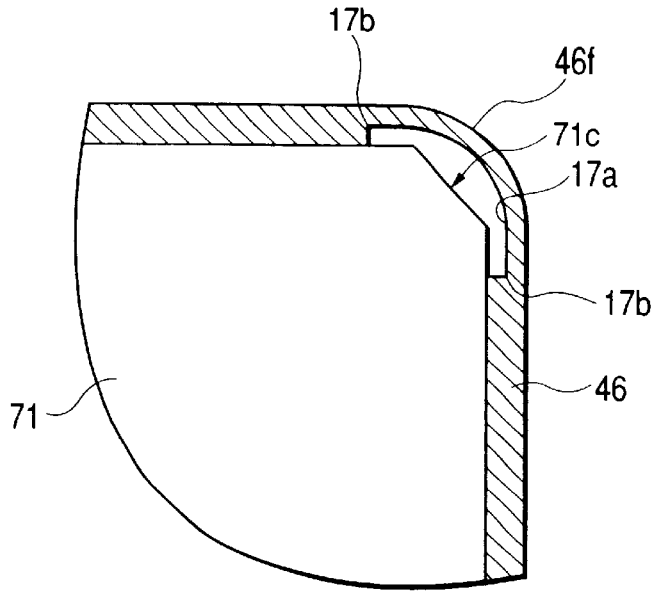
FIG. 46 is an enlarged view which shows the folded portion of the orifice plate.

FIG. 43 is a perspective view which shows the state before the orifice plate represented in FIG. 42 is folded. FIG. 44 is a perspective view which shows the state of the orifice plate represented in FIG. 42 being folded. FIG. 45 is a cross-sectional view which shows the portion of the liquid discharge recording head of the present embodiment on the discharge port side. FIG. 46 is an enlarged view which shows the folded portion of orifice plate.

The outer shape of orifice plate 46 is almost the same as that of orifice plate 6 used for the ninth and eleventh embodiment. As shown in FIG. 43 to FIG. 45, there are formed two grooves 17*a* on the orifice plate 46 on the surface 46*g* side and the backside 46*g* which is opposite thereto, respectively, and each of them extended along the folding ridge line 46*f* of orifice plate 46. Therefore, on the portion on the flat surface of orifice plate 46 on the head main body 64 side, which faces the head main body 64, that is, on the folded portion of orifice plate 46 formed by the inside faces thereof, the grooves 17*a* which are extended in parallel along the front edge ridge lines 71*c* parallel to the alignment direction of discharge ports 46*a* on the front plate portion 71*b* of chip tank 71. In this way, if the grooves 17*a*, each having a desired width, are formed on the folded portions 46*m* of orifice plate 46, the thickness of each folded portion 46 is made smaller than that of the other part, thus reducing the repellent force when being folded. The orifice plate 46 is then folded easily to contribute to the enhancement of the productivity of liquid discharge recording heads.

Further, a designated tension is exerted on the two faces of fixing portions 46*i* and 46*j* of the folded orifice plate 46, and then, each of them is fixed and held on the upper face of chip tank 71 and the backside of base plate 3, respectively. As a result, the orifice plate 46 is fixed on the three faces, the backside of surface (front face) 46*b*, and each backside of the fixing portions 46*i* and 46*j*, hence enhancing the holding strength significantly as compared with the mode in which the orifice plate 46 is fixed only on the backside of facing end 46*b*.

For the present embodiment, the structure is arranged so that the orifice plate 46 is folded along the alignment direction of discharge ports 46*a*, but it may be possible to arrange the structure so as to fold the orifice plate 46 in the direction at right angles to the alignment direction of discharge ports 46*a*.

On the circumference of discharge ports 46*a* on the backside 46*g* of orifice plate 46, a plurality of extrusions 18*a* are formed to protrude per discharge port 46*a* independently from the backside 46*g* of the orifice plate. The configuration of each extrusion 18*a* may be cylindrical, polygonal column, or the like. Also, each of the extrusions 18*a* may be structured with the extruding configuration formed by the wall portion uniformly or structured by the wall portion which is divided into several pieces.

Each of the extrusions 18*a* is formed by means of excimer laser processing in the same manner as the discharge ports 46*a*. Here, the extrusions should be made with this process, and, therefore, the processing is executed in such a manner that the portion other than the extrusions 18*a* is removed by means of excimer laser in a quantity equivalent to the height of each extrusion 18*a*. Also, each of the aforesaid grooves 17*a* is cut by excimer laser processing. In other words, with the plural extrusions 18*a* and two grooves 17*a* being formed by means of excimer laser processing, it is possible to process them in excellent positional precision and surface flatness with an extremely small amount of residual stress. As a result, if the manufacture of orifice plate 46 is arranged to form the extrusions 18*a* and grooves 17*a* either in one and the same cutting process using excimer laser or in one and the same drilling process for the discharge ports 46*a* using excimer laser, it becomes possible to reduce the processing costs of orifice plate 46.

In general, the orifice plate 46 is formed by use of metallic plate, such as SUS (stainless steel), Ni, Cr, or Al, or a resin mold, resin film material, or the like, such as polyimide, polysulfone, polyether sulfone, polyphenylene oxide, polyphenylene sulfide, or polypropylene, or further by silicon, ceramics, or the like. Here, the discharge ports 46*a*, the extrusions 18*a*, and the grooves 17*a* can be formed not only by means of excimer laser, but also, by the adoption of various methods, such as injection molding, transfer molding, electrocasting, sand blasting, etching, among some others, depending on the material to be used.

The configuration and function of the chip tank 71 are the same as those of chip tank 11 used for the ninth embodiment with the exception of the configuration of edge portions of front plate portion 71*b*. Therefore, the function of front plate portion 71*b* is the same as that of the front plate portion 11*b* of chip tank 11 so as to hold the circumference of discharge ports 46*a* on the orifice plate 46 by bonding the front plate portion to it, as well as to support the orifice plate 46 so that the orifice plate 46 can withstand sufficiently the attaching or detaching force and pressure holding force exerted on the cap member when the capping operation is carried out by the cap member arranged for the recording apparatus main body.

Also, the grooves 17*a* of orifice plate 46 described earlier are arranged so that each center in the widthwise direction thereof is almost in agreement with each of the front edge ridge lines 71*c* of front plate portion 71*b*.

In the interior of liquid discharge recording head, the wiring base plate 35 is bonded onto the base plate 3 by use of bonding agent as shown in FIG. 45. The wiring base plate 35 provides wiring for the heater board 1 and electrical connection with the liquid discharge recording apparatus main body. Here, the wiring base plate 35 uses a PWB base plate having wiring pattern formed on a glass epoxy substrate using copper or nickel or a TAB film having wiring pattern formed on flexible film or the like. The heater board 1 and the wiring base plate 35 are electrically connected by use of wire bonding 35*a*.

A Next, the description will be made of the outline of assembling process of liquid discharge recording head.

At first, as in the ninth embodiment, the heater board 1 and the ceiling plate 5 are made closely in contact. After that, the chip tank 71 is incorporated. The ink discharge port 9 on the ceiling plate 5 is connected with the ink passage in the chip tank 71. In this way, the front plate portion 71*b* of chip tank 71 covers the front edge face 1*b* of heater board 1, and the circumference of the front edge face 5*b* of ceiling plate 5. At this juncture, the front edge faces 1*b* and 5*b* are structured to protrude forward form the front face of front plate portion 71*b* by several tens of μm or several hundreds of μm.

Then, with the heater board 1 and ceiling plate 5 being closely in contact, the front faces 1*b* and 5*b* are formed to protrude from the front plate portion 71*b*, to which the orifice plate 46 is bonded by bonding means such as bonding agent. At this juncture, the front face of front plate portion 71*b* is retracted from the front edge faces 1*b* and 5*b* so as not to hinder bonding the orifice plate 46 and the front edge faces 1*b* and 5*b*.

The bonding of the orifice plate 46 to the front plate portion 71*b* is made by fitting the extrusions 18*a* into nozzles 7 when the extrusions 18*a* advance into the nozzles 7 after the extrusions 18*a* on orifice plate 46 and the nozzles 7 facing the corresponding extrusions 18*a* have been aligned in high precision, thus completing it when bonding agent binds both contact faces.

For bonding the backside 46*g* of orifice plate 46 and the front plate portion 71*b*, epoxy bonding agent having excellent characteristic of ink resistance is used in general. The bonding by use of epoxy bonding agent adopts UV irradiation or heating to promote the hardening of bonding agent, but in order to maintain the alignment of discharge ports 46*a* in high precision, it is necessary to reduce the influence of bonding agent, such as hardening shrinkage, thermal expansion. It is therefore preferable to adopt a hardening method using both UV irradiation and low-temperature curing treatment.

When the backside 46*g* of orifice plate 46 is bonded to the edge faces of front plate portion 71*b* under pressure, bonding agent spreads by the nipping pressure exerted by both members, but each of the extrusions 18*a* blocks the flow of bonding agent, thus producing effect to suppress the flow thereof into the inner face of each discharge port 46*a* and nozzle 7. Also, the clearance between the outer circumference of each extrusion 18*a* of orifice plate 46 and the inner face of each nozzle 7 is set at several μm. Therefore, even if bonding agent should flow into the gap between them, it becomes difficult for bonding agent to flow further into the inner face of each nozzle 7 located deeper than the gap owing to surface tension created in the gap then. In this way, bonding agent flows into each gap portion formed by the outer circumference of each extrusion 18*a* of orifice plate 46 and the inner face of nozzle 7, and increases the bonding area of orifice plate 46, thus making it possible to enhance the bonding strength.

Further, even if the members that constitute the orifice plate 46 and nozzles 7 are formed by different materials, the extrusions 18*a* are inserted into the nozzles 7 so as to block physically the relative positions of the discharge ports 46*a* and nozzles 7 to change in the curing process of bonding agent.

Also, with the arrangement of grooves 17*a*, the tension (nerve strength) of orifice plate 46 as a whole is divided with each groove 17*a*, and when bonding the orifice plate 46, the tension of orifice plate 46 that acts upon the circumference of facing end 46*b* as repellent force is reduced. In other words, when executing the bonding process of orifice plate 46, the repellent force, such as waving or rolling that occurs on the facing end 46*b* to react upon the bonding, is reduced so as to make it easier for the extrusions 18*a* to be fitted into the nozzles 7. As a result, the flatness and bonding precision of facing end 46*b* is enhanced.

Further, the shrinking stress acts upon the orifice plate 46 when bonding agent is thermally hardened, but this stress should mainly act only toward the inner side of each groove 17*a* by the effect of the grooves 17*a* thus arranged so as to reduce the shrinking stress that works on the fixing portions 46*i* and 46J of orifice plate 46, respectively. In this manner, it becomes possible to significantly suppress drawback such as waving or rolling that may occur on the orifice plate 46 as a whole following the shrinking stress when bonding agent is hardened.

In the next process, bonding agent, sealant, or the like is poured into the gaps (stepping portions of several tens of μm to several hundreds of μm between the front plate portion 71*b* and front edge faces 1*b* and 5*b*) between the outer circumferential area of discharge ports 46*a* and the front plate portion 71*b* on the backside 46*g* of orifice plate 46, thus completing to bond the outer circumferential area of discharge ports 46*a* on the orifice plate 46 to the front plate portion 71*b*.

Next, the fixing portions 46*i* and 46*j* of orifice plate 46 are folded respectively along the front edge ridge lines 71*c* of front plate portion 71*b* of chip tank 70. As shown in FIG. 46, it is preferable for the folded portions of orifice plate 46 to form curves faces where folding ridge lines 46*f* pass through. This is because stress is concentrated on the folded portions of folding ridge lines when the wiping blade slides to rub for the recovery process or when the cap member is attached or detached, and because such drawback as cracks or cuts should be prevented from being caused to occur on the orifice plate 46.

However, in order not to allow the front portion ridge lines 71*c* of chip tank 71 to intervene with the curved portions of folding ridge lines 46*f* of orifice plate 46, there is a need for chamfering each front portion ridge line 71*c* of chip tank 71 or forming curved face therefor (see FIG. 46).

Figure 47:
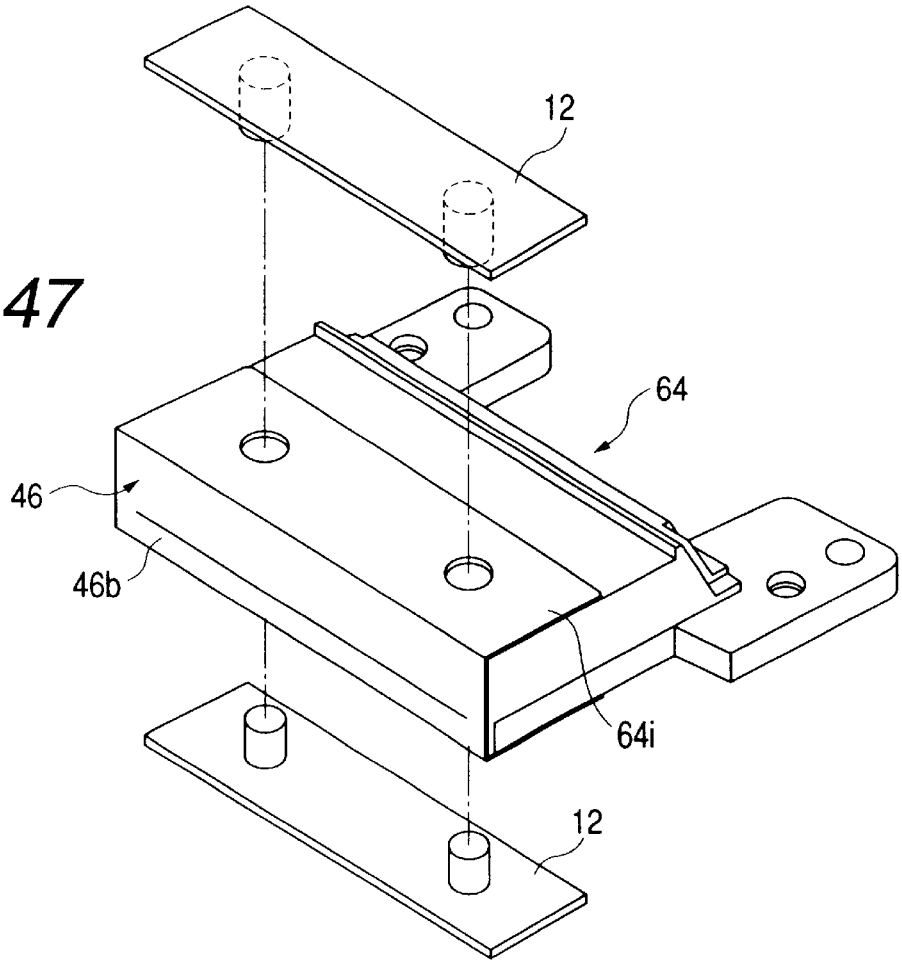
FIG. 47 is a perspective view which shows on example of coupling means for fixing the fixing portion of the orifice plate to the head main body.

The fixing portion 46*i* of orifice plate 46 is folded along the upper face of chip tank 71, and held on the upper face of chip tank 71 to be fixed by bonding means, coupling means, or the like. Likewise, the fixing portion 46*j* of orifice plate 46 is folded along the backside of base plate 3, and held on the backside of base plate 3 to be fixed by bonding means, coupling means, or the like. FIG. 47 is a perspective view which shows one example of bonding means for fixing the fixing portions 46*i* and 46*j* of orifice plate 46 to the head main body 64. For example, as shown in FIG. 47, the pressure plate 12 which is the same coupling means as the one used for the ninth embodiment is adopted for putting down the fixing portions 46*i* and 46*j* of orifice plate 46 to hold and fixe each of the fixing portions 46*i* and 46*j*, respectively.

As the procedure of folding the orifice plate 46, it may be possible to fold the orifice plate 46 after the extrusions 18*a* of orifice plate 46 are fitted into the nozzles 7 and bonded or the structure may be arranged so that the orifice plate 46 is folded in advance along the folding ridge lines 46*f*, and then, the extrusions 18*a* are fitted into the nozzles 7 to be bonded.

In the case of the former method whereby to fold the orifice plate 46 after the extrusions 18*a* are fitted into the nozzles 7, the orifice plate 46 is folded along the outer configuration of chip tank 71. Therefore, even when the individual differences of chip tanks 71 are great, it is possible to deal with them flexibly. Here, in the case of the latter method whereby to fit the extrusions 18*a* into the nozzles 7 after the orifice plate 46 is folded, the orifice plate 46 can be folded more reliably to make it possible to secure the folding ridge lines 46*f* firmly for the orifice plate 46.

Also, for the former method, resin film or thin metallic film or some other material the folding strength of which is weaker, and easier to be folded is suitable as the material of orifice plate 46. For the latter method, on the contrary, the material having larger folding strength is suitable as the material of orifice plate 46. In either case, the method for folding the orifice plate 46 should be appropriately selected in accordance with the material to be used and the configuration to be adopted, among some others.

Also, the pouring process, in which bonding agent, sealant, or the like is poured into the gap between the outer circumferential area of discharge ports 46*a* on the backside 46*g* of orifice plate 46, and the front plate portion 71*b*, may be executed after the orifice plate 46 is folded. If there is some other process in which bonding agent or sealant is used, this pouring process may be executed together with such process at the same time, thus making it possible to reduce delay time for hardening the agent, and also, reduce the number of preparatory products then.

For the liquid discharge recording head of the present embodiment, too, when the recovery operation is carried out, the cap member 13 advances to the facing end 46*b* of orifice plate 46 as in the capping operation described in conjunction with FIG. 34 for the ninth embodiment, and then, airtightly close the discharge ports 46*a* by the cap member 13 which is in contact with the circumferential portion of discharge port 46*a*. At this juncture, the facing end 46*b* of orifice plate 46 is flat without any steps being formed. As a result, the contacting portion of cap member 13 on the facing end 46*b* can secure airtightness in good condition on any part of the area of facing end 46*b*. Thus, there is no need for setting the processing precision high for the component of cap member 13 and the positioning thereof highly accuracy. It is possible to simplify the recovery device, and manufacture the recovery device at lower costs.

Also, regarding the peeling-off of the edge face portions of orifice plate 46 due to the repetition of capping operations of cap member 13, it is possible to prevent such drawback as the peeling off which occurs when the cap member 13 is repeatedly in close contact with or apart from the orifice plate, because the facing end 46*b* of orifice plate 46 is firmly held by the three-face fixation of orifice plate 46 described above.

Also, regarding the wiping operation to be carried out after capping and continuous discharges, among some others, the orifice plate 46 is folded for the liquid discharge recording head of the present embodiment, too in the same manner as described in conjunction with FIG. 35 for the ninth embodiment. Therefore, the fixing portions 46*i* and 46*j* of orifice plate 46 are fixed respectively on the upper and lower faces of head main body 64 to provide the three-face holding mode. As a result, the bonding strength of orifice plate 46 is enhanced significantly, hence making it possible to obtain great reaction force of the orifice plate 46 against the slidably rubbing of wiping plate 2.

Also, even when the advancing direction of wiping blade 2 is set in the direction perpendicular to the alignment direction of discharge ports 46*a*, the wiping blade 2 begins to be in contact at the folding ridge line 46*f* so that the wiping blade 2 does not hook the edge portions of orifice plate 46. There is then almost no possibility that the orifice plate 46 is peeled off.

Also, when the orifice plate 46 is folded and fixed to the head main body 64, the orifice plate 46 is fixed while exerting tension on the orifice plate 46, as described in conjunction with FIG. 33 for the ninth embodiment, by pulling both edge portions of orifice plate 46 in the direction in which each of both edge portions of orifice plate 46 is caused to part from the facing end 46*b*, and also, in the direction perpendicular to the alignment direction of discharge ports 46*a*. In this way, the flatness of the facing end 46*b* of orifice plate 46 is enhanced more, and also, the orifice plate 46 is prevented from floating from the chip tank 71. As a result, the preventive effect becomes greater to protect the orifice plate 46 from being peeled off.

In this case, too, if the tension that should be exerted on the orifice plate is made larger than necessary, the discharge ports 46*a* are deformed and broken. it is required to set tension at an appropriate value in consideration of the material used for the orifice plate 46, as well as the strength and shape thereof. As compared with the structure in which no extrusions 18*a* are arranged, the structure of liquid discharge recording head of the present embodiment where the extrusions 18*a* of orifice plate 46 are inserted into nozzles 7 is able to provide greater resistive force against tension. Therefore, it becomes possible to set the tension exerted on the orifice plate 46 larger.

As described above, the orifice plate 46 is folded along the front edge ridge lines 71*c* of front plate portion 71*b* and fixed in the same dimension as the surface of front plate portion 71*b*, thus obtaining the firm fixation of orifice plate 46. In this manner, flatness is created on the facing end 46*b* to make it possible to provide a wider flat surface required for capping, and also, to make it easier to set a desired area for the facing end 46*b*.

Further, the facing end 46*b* of orifice plate 46 becomes flat entirely. As a result, it is possible to significantly reduce residual liquid and wiping unevenness when wiping is performed by the wiping blade. In addition, the flat wiping surface contributes to reducing of damages that may be caused to the wiping blade, thus making it possible to enhance the durability of wiping blade, as well as the reliability of wiping operation.

Therefore, the freedom of designing is increased for the liquid discharge recording head, and the liquid discharge recording apparatus as well. It becomes possible to implement then making the liquid discharge recording head and liquid discharge recording apparatus smaller, and reducing costs, among some others. Also, the longer life of liquid discharge recording head can be materialized eventually.

Here, the structure, in which grooves 17*a* are formed along the folding ridge lines 46*f* on the backside 46*g* of orifice plate 46 as in the present embodiment, is not necessarily limited to the use for the orifice plate having extrusions provided for the circumference of discharge ports. It is of course possible to apply this structure to the orifice plate for which the extrusions of the kind are not provided.

Also, the orifice plate 46 is not necessarily formed integrally with one and the same material. The present invention is applicable to a laminated structure formed by one and the same material, and also, to a laminated structure formed by different materials. In other words, it may be possible to form the extrusions around the discharge ports with separate layer or form the stepped portion of orifice plate 46 with separate layer. Further, the same effect can be obtained by the orifice plate which is structured to make the thickness of outer area from the folded portions smaller than that of the surface portion of orifice plate 46 so that the entire backside area of the fixing portions 46*i* and 46*j* of orifice plate 46 becomes the same plate as the bottom faces of the grooves 17*a*.

Thirteenth Embodiment

Figure 48:
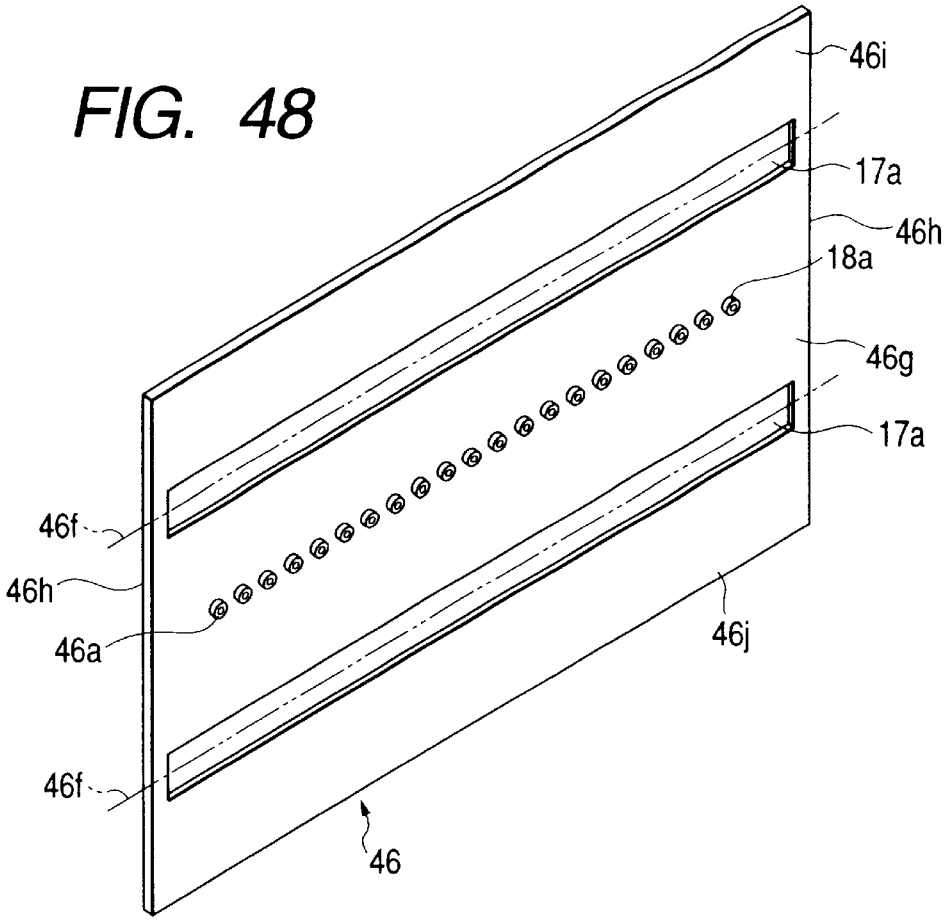
FIG. 48 is a perspective view which shows the orifice plate that forms the liquid discharge recording head in accordance with a thirteenth embodiment of the present invention, observed from the backside thereof.

FIG. 48 is a perspective view which shows the orifice plate that constitutes the liquid discharge recording head in accordance with a thirteenth embodiment of the present invention, observed from the backside thereof.

As in the twelfth embodiment described above, the grooves 17*a* are arranged on the backside of orifice plate 46 to make it easier to fold the orifice plate 46. On the other hand, however, the fixing portions 46*i* and 46*j* of orifice plate 46 tend to be bent downward by its own wight with the portions where the grooves 17*a* are formed as fulcrums. There is a possibility, therefore, that it becomes unfavorable to handle (deal with) the orifice plate 46.

The present embodiment proposes the structure whereby to bend the folding surfaces of the orifice plate 46 easily at the holding ridge lines without deteriorating the handling thereof. Hereunder, with reference to FIG. 48, the description will be made of the orifice plate used for the present embodiment by applying the same reference marks to the same parts appearing in the twelfth embodiment.

As shown in FIG. 48, the orifice plate 46 used for the present embodiment is provided with the grooves 17*a* formed on the backside 46*g* of orifice plate 46 in the longitudinal direction of the orifice plate 46, that is, formed as if cut in the vicinity of both edge portions 46*h* in the alignment direction of discharge ports 46*a*. In other words, the grooves 17*a* are formed on the positions excluding both edge portions 46*h* of orifice plate 46. Then, in this manner, the folding robustness of orifice plate 46 is increased. As a result, unlike the structure in which the grooves 17*a* are penetrated in the longitudinal direction, there is no possibility that the fixing portions 46*i* and 46*j* of orifice plate 46 are allowed to be bent downward with the portions where the grooves 17*a* are formed as fulcrums, hence making the handling capability of orifice plate 46 favorable.

In this respect, the portions where the grooves 17*a* are cut off are narrow areas each on the edge portions 46*h*. Consequently, the resistive force exerted at the time of holding the fixing portions 46*i* and 46*j*, respectively, is small to make it easier to fold each surface portion of the fixing portions 46*i* and 46J.

Fourteenth Embodiment

Figure 49:
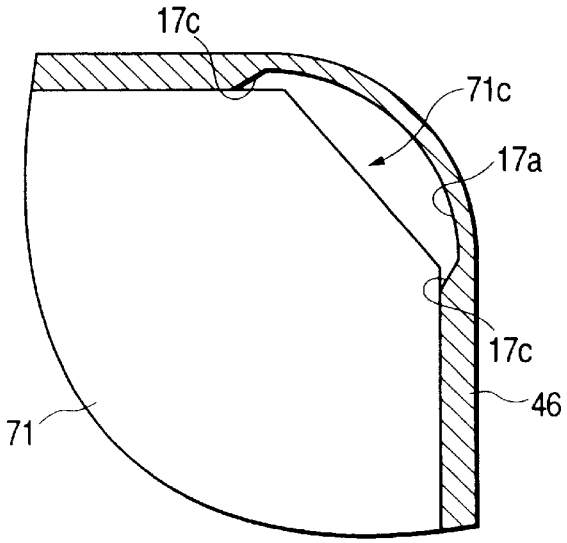
FIG. 49 is an enlarged view which shows the folded portion of the orifice plate of the liquid discharge recording head in accordance with a fourteenth embodiment of the present invention.

FIG. 49 is an enlarged view which shows the folded portion of orifice plate of the liquid discharge recording head in accordance with a fourteenth embodiment of the present invention.

For the facing end 46*b* of orifice plate 46 of the twelfth embodiment and thirteenth embodiment, flatness should be secured for the execution of recovery process. It is also necessary to eliminate the floating of bonding surface of orifice plate 46 as much as possible. The circumference of folded portion of orifice plate is the area where floating is liable to occur. In order to suppress floating in this area, it is effective that the folding ridge line portion 46*f* of orifice plate 46 is formed with a comfortably curved surface or a curved surface having a large curvature so as to reduce the repellent force against folding.

In the process of folding the orifice plate 46 along the upper face of chip tank 71 or along the backside of base plate 3, the folding deformation of orifice plate 46 occurs beginning with the portion which easier to be bent. In such case, as shown in FIG. 46 for the twelfth embodiment, when the bottom face of each groove 17*a* and the side wall faces of groove 17*a* are orthogonal at the intersecting portions 17*b*, the portions near the intersection portions 17*b* on the orifice plate 46 are the areas where the folding robustness is caused to change extremely, respectively. Now, if the groove 17*a* should widen the width of vertical wall as it is as shown in FIG. 46, not only the portions in the vicinity of the intersecting 17*b* areas on the orifice plate 46 become easily folded, but also, there is a fear that folding is concentrated on them. Therefore, if folding should advance, while being concentrated on one location, the curved surface of the folding ridge line portion 46*f* becomes smaller. Also, stress is concentrated on the portions near the intersection 17*b* areas to make the orifice plate 46 susceptible to damages after all.

Now, therefore, in accordance with the present embodiment, the folding ridge line portions 46*f* of orifice plate 46 are formed each with a comfortably curved surface or a curved surface having a large curvature in order not to allow drawback, such as floating, to occur on the circumference of grooves 17*a* of orifice plate 46, that is, the circumference of each folded portion.

Hereunder, with reference to FIG. 49, the description will be made of the orifice plate used for the present embodiment by applying the same reference marks to the same parts as those appearing in the twelfth embodiment.

As shown in FIG. 49, the orifice plate 46 used for the liquid discharge recording head of the present embodiment inclines the inner side walls 17*c* of groove 17*a* to the bottom face of groove 17*a*, and at the same time, widens the opening width of groove 17*a* entirely so as to fold the folding portion of orifice plate 46 comfortably. On the other hand, the front edge portion ridge line 71*c* of chip tank 71 is chamfered or provided with a curved surface so as not to interfere with the folded portion of orifice plate 46. In this way, the inner side walls 17*c* of groove 17*a* are set at an inclined face to enable the folding robustness of the bottom face of groove 17*a* of the side walls 17*c* to change comfortably at the portions in the vicinity of intersecting portions of orifice plate 46. Thus, the folding ridge line 46*f* portion of orifice plate 46 can be folded, while forming a large curved surface.

Fifteen Embodiment

Figure 50:
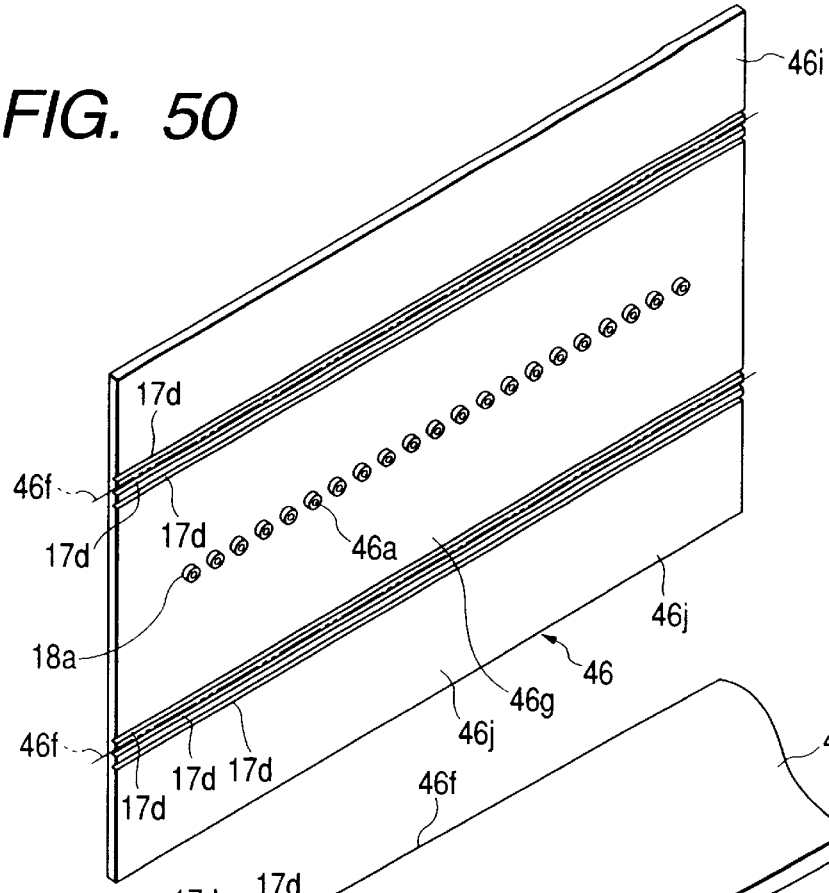
FIG. 50 is a perspective view which shows the orifice plate that forms the liquid discharge recording head in accordance with a fifteenth embodiment of the present invention, observed from the backside thereof.
Figure 51:
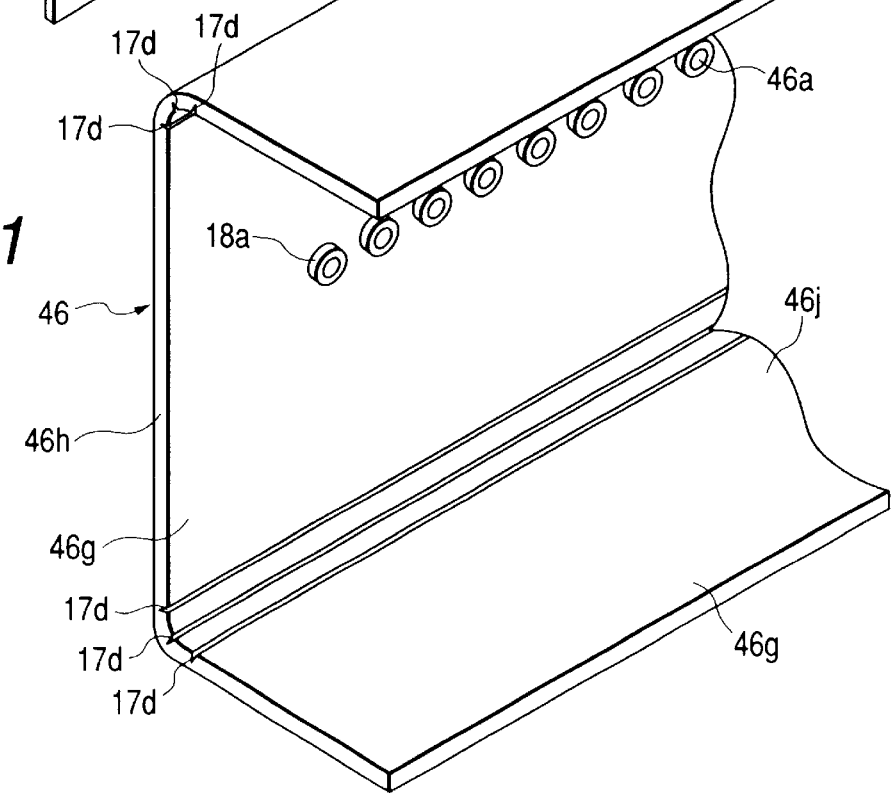
FIG. 51 is a perspective view which shows the state where the orifice plate represented in FIG. 50 is folded.

FIG. 50 is a perspective view which shows the orifice plate that constitutes the liquid discharge recording head in accordance with a fifteenth embodiment of the present invention. FIG. 50 shows the state before the orifice plate is folded. FIG. 51 is a perspective view which shows the state where the orifice plate represent in FIG. 50 is folded.

The processing costs of excimer laser, which is used for forming the discharge ports, the grooves, and extrusions for the orifice plate, are high, and if the cutting area is wide, the irradiation time of laser becomes longer to make unit costs of processing higher accordingly. Therefore, in accordance with the present embodiment, it is intended to narrow the irradiation area of laser beams in order to reduce the cost of processing the grooves of orifice plate. Now, hereunder, with reference to FIG. 50 and FIG. 51, the description will be made of the orifice plate used for the present embodiment by applying the same reference marks to the same parts as those appearing in the twelfth embodiment.

For the orifice plate 46 used for the present embodiment, there are formed as shown in FIG. 50 three wedge type grooves 17*d* along the folding ridge lines 46*f* instead of the grooves 17*a* formed for the twelfth embodiment. Therefore, the sectional shape of each of the grooves 17*d* is of wedge type in the vertical direction to the longitudinal direction thereof, and three pieces of wedge type grooves 17*d* are arranged each for the folding ridge line 46*f* at one location. As shown in FIG. 51, when the orifice plate 46 is folded, each opening angle of the wedge type grooves 17*d* is made smaller to form the curved surface at the folding ridge line 46*f* as desired. The number of grooves 17*d* can be set appropriately depending on the size of curved surface at the folded portion, and the material of orifice plate 46 as well.

Also, the groove 17*d* is not necessary limited to the wedged-shaped one. It may be possible to form the groove in the form of trapezoid, square, or the like. In either case, the structure is arranged so that the groove is formed by dividing it in the vertical direction to the folding ridge line 46*f* on the backside of folded portion of orifice plate 46, thus making it possible to narrow the cutting area for the groove, and shorten the irradiation time of excimer laser beams, as well as to reduce the processing time of the orifice plate 46.

Sixteenth Embodiment

Figure 52:
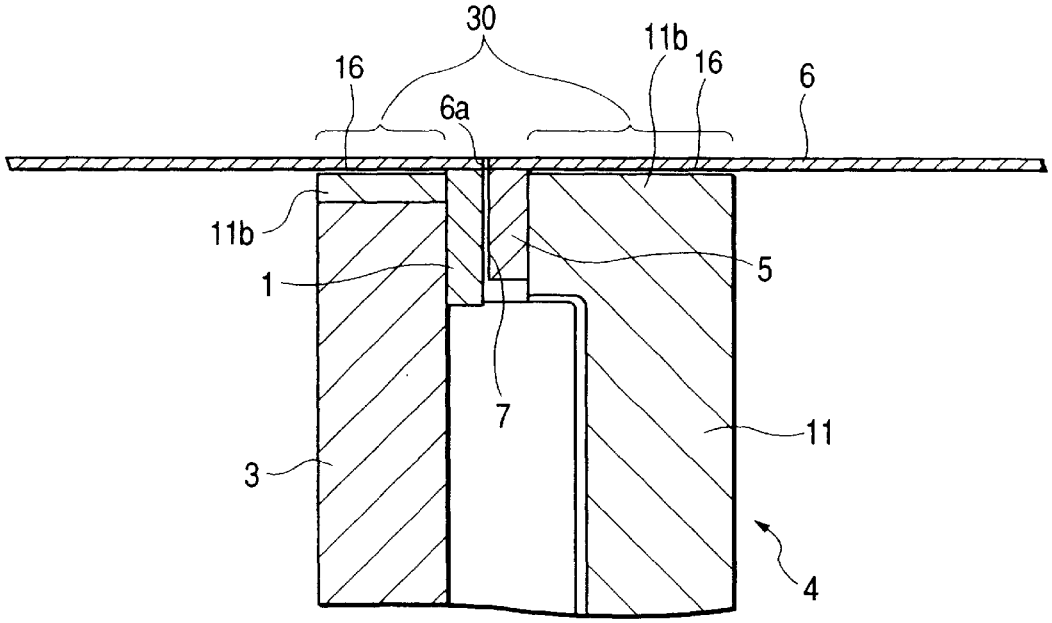
FIG. 52 is a cross-sectional view which illustrates a method for manufacturing the liquid discharge recording head in accordance with a sixteenth embodiment of the present invention.
Figure 53:
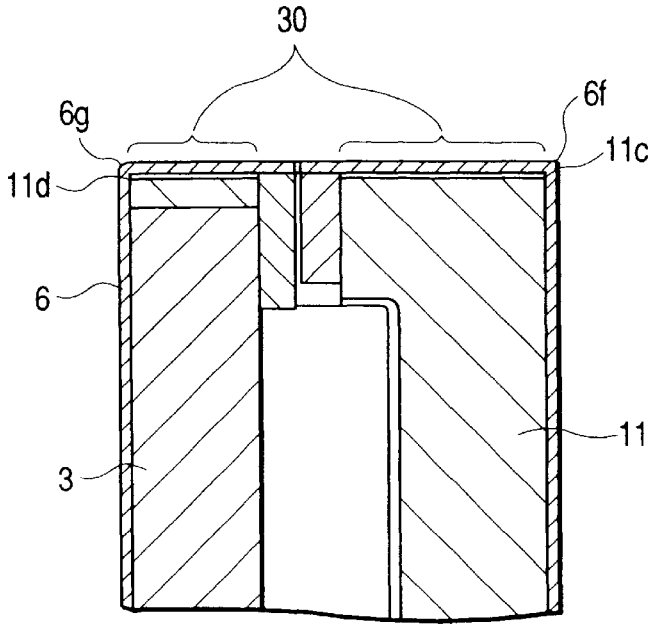
FIG. 53 is a cross-sectional view which illustrates the method for manufacturing the liquid discharge recording head in accordance with a sixteenth embodiment of the present invention.

FIG. 52 and FIG. 53 are cross-sectional views which illustrate the method for manufacturing the liquid discharge recording head in accordance with a sixteenth embodiment of the present invention.

The method for manufacturing the liquid discharge recording head of the present embodiment is the one applicable to the liquid discharge recording head in accordance with the first to fifteenth embodiments described above, as well as to the variational examples thereof as well. Hereunder, the description will be made exemplifying the liquid discharge recording head of the ninth embodiment. In FIG. 52 and FIG. 53, the representation is made with the omission of stepping configuration on the edge portions of front plate portion 11*b* of chip tank 11.

FIG. 52 shows the state where the orifice plate 6 is positioned to the edge face of nozzles 7 formed to be extrusions by the close contact between the heater board 1 and the ceiling plate 5, and then, the orifice plate 6 is bonded to the head main body 4 by bonding means such as bonding agent. FIG. 53 shows the state where the orifice plate 6 is folded at the front folding ridge line 11*c* of front plate portion 11*b* of chip tank 11.

At first, as shown in FIG. 52, a plurality of discharge ports 6*a* formed on the orifice plate 6 are positioned to the plural nozzles 7 formed to be extruded from the front plate portion 11*b* by the close contact between the ceiling plate 5 and the heater board 1, thus fixing the orifice plate 6 by fixing means such as bonding agent. Then, bonding agent or sealant having bonding power is poured into the gap 16 between the backside area of orifice plate 6 and the front plate portion 11*b*.

Then, as shown in FIG. 53, the orifice plate 6 is folded along the front edge portion ridge lines 11*c* and 11*d* of front plate portion 11*b* of chip tank 11, and using the pressure plate 12 or the like the fixing portions 6*i* and 6*j* of orifice plate 6 are fixed to the upper face of chip tank 11 or the backside of base plate 3.

With the orifice plate 6 being folded, stress is exerted on the orifice plate 6 to return to the original plane due to the folding elasticity which the material of the orifice plate 6 owns itself. However, the backside area of the orifice plate 6 and the front plate portion 11*b* are bonded on the contact area 30 by use of bonding agent or sealant having bonding power so as to put down this stress.

In accordance with the present embodiment, the contact area 30 is formed to be bonded by the entire surface where the backside area of orifice plate 6 and the front plate portion 11*b* to face each other. The area of this contact area 30 and bonding strength thereof are determined selectively in accordance with the folding robustness which is defined by the material and thickness of orifice plate 6. It is of course necessary to make the bonding strength thereof having a sufficient margin against the stress exerted on the orifice plate 6 being folded.

The bonding strength of the contact area 30 is influenced by the performance of bonding agent or sealant itself, but it is also influenced by the flatness of the backside area of orifice plate 6 or front plate portion 11*b* or by such cases as the adhesion of dust particles, oil, or the like. Thus, if the bonding strength should be enhanced, it is effective to perform rinsing, surface treatment, or the like as process prior to bonding.

Also, in order to offset the stress exerted when folding the orifice plate 6, it is effective to effectuate folding beyond the elastic limit of the orifice plate 6. However, the effectiveness changes depending on the material of orifice plate 6. It is therefore necessary to make selection in accordance with the situation.

Next, with reference to FIGS. 54A to 54D, the folding process of orifice plate will be described. FIGS. 54A to 54D are views which sequentially illustrate the folding process for the orifice plate bonded to the head main body.

Figure 54A:
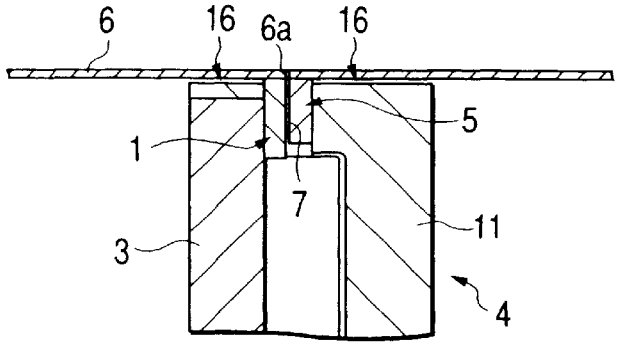
FIGS. 54A, 54B, 54C and 54D are views which sequentially illustrate the folding process for the orifice plate bonded to the head main body.

At first, in FIG. 54A, the discharge ports 6*a* formed on the orifice plate 6 are positioned to the nozzles 7 formed by the ceiling plate 5 and the heater board 1. Then, the orifice plate 6 is fixed by means of bonding agent or the like. At this juncture, the ceiling plate 5 and the heater board 1 are bonded to the orifice plate 6, but the structure is arranged so that the gap 16 of several tens to several hundreds of $\mu$m is present between the aforesaid orifice plate 6 and front plate portion 11*b*.

Figure 54B:
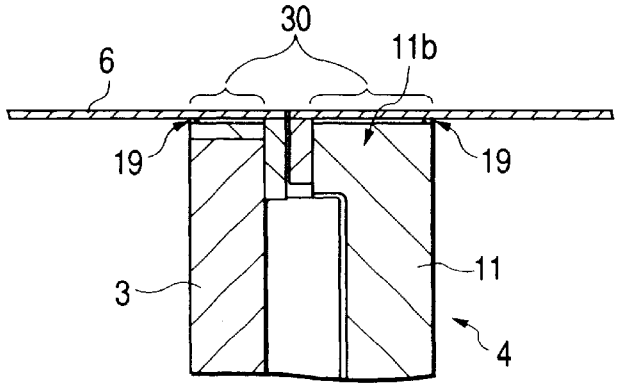

Next, as shown in FIG. 54B, bonding agent or sealant 19 having bonding power is poured into the gap 16. Thus, the orifice plate 6 and the front plate portion 11*b* are integrally bonded on the bonding area 30.

Figure 54C:
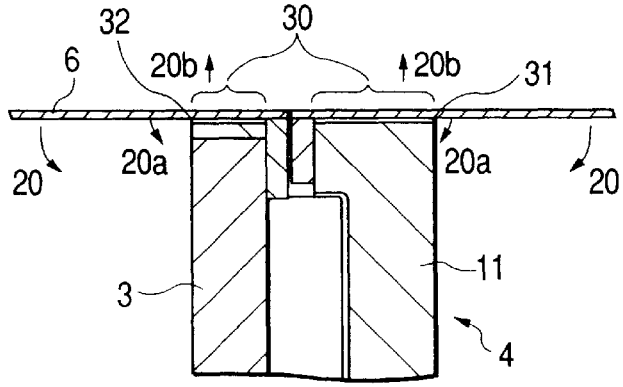
Figure 54D:
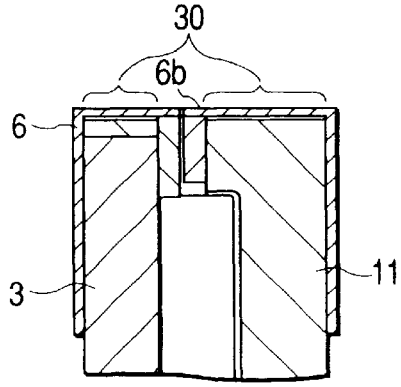

Next,as shown in FIG. 54C, the orifice plate 6 is folded along the edge portions (edges) 31 and 32 of front plate portion 11*b*. At this juncture, folding stress 20*a* is exerted on the orifice plate 6 in the same direction as the folding direction 20 of orifice plate 6. Also, at the same time, the derived force 20*b* is exerted. The derived force 20*b* works in the direction to make the gap 16 greater between the orifice plate 6 and the front plate portion 11*b*. However, in the previous step, the surface portion of orifice plate 6 being bonded and fixed to the front plate portion 11*b*, the size of this gap 16 is not caused to change. Therefore, as shown in FIG. 54D, there is no floating or the like of the orifice plate 6 at the folded portions of orifice plate 6 and on the circumferential portion thereof, hence making it possible to keep the flatness of the facing end 6*b*.

With the bonding process for securing the flatness of the facing end 6*b* of orifice plate 6 being carried out before folding the orifice plate 6 as described above, it becomes possible to enhance the anticipated effect greater.

Therefore, in accordance with the method for manufacturing the liquid discharge recording head of the present embodiment, it is possible to manufacture the liquid discharge recording head which is provided with flat and no step facing end 6*b*. As a result, in the case where the recovery operation is carried out in the same manner as described above for the recording operation executed by means of liquid discharges, and the cap member advances onto the facing end 6*b* of orifice plate 6 to be in contact with the area including the discharge port array 6*a* on the facing end 6*b* of orifice plate 6 for closing it airtightly by means of the cap member, it becomes possible for the contact portion of the facing end 6*b* with the cap member to secure airtightness on any parts on the facing end 6*b*, because the facing end 6*b* is flat and has no step. There is no need for defining the positional accuracy in high precision when the cap member advances, thus making the recording apparatus simpler.

Also, for the wiping operation to be carried out after capping and continuous discharges, among some others, the folded orifice plate 6 provides three bonding faces, such as the bonding face of orifice plate 6 with the head main body 4, and the bonding faces formed by fitting, and, therefore, the reaction force of orifice plate 6 against the wiping blade is exerted not only by the backside of surface portion 6*k* of orifice plate 6, but also, additionally by the backsides of fixing portions 6*i* and 61 of orifice plate 6, that is, by the two faces on the folded sides, thus obtaining a greater reaction in this respect. As a result, the bonding strength of orifice plate 6 is 5 significantly enhanced by means of the three-face holding mode so as to enable the orifice plate 6 to obtain a great reaction force against the slidable rubbing of the wiping blade.

As described above, with the structure in which the orifice plate is folded along the edge portions of head main body and the orifice plate is bonded to the head main body, the cut-offs are formed on the edge portions of head main body to form the stepped edge portions, or to chamfer the edge portions so as to form arc on each folded portion of orifice plate in accordance with the folding stress exerted on the orifice plate, but not to form the curved arc centering on the edge portion ridge line of the front face of head main body. In this manner, it becomes possible to prevent the orifice plate from floating greatly or protruding from the front edge face or edge portion of liquid flow paths of the head main body on the opening surface side, that is, from the surface that receives the orifice plate. If the structure is arranged so that the edge surface of head main body is curved or chamfered to enable the folded faces of orifice plate to be in contact with the surface of such edge portion, it becomes possible to distribute the folding stress exerted on the orifice plate along the surface of such edge portion smoothly. In this way, the orifice plate is prevented from floating greatly or protruded from the edge portion of head main body and the front edge face connected therewith. Further, with the edge portion of head main body being configured in either one of them described above, it becomes possible to deform to a certain extent the bonding agent or sealant which resides in the circumference of edge portion of the front edge face of orifice plate even when the orifice plate is bonded to the front edge face of head main body by means of bonding agent or sealant having bonding power. Therefore, the bonding agent or sealant can be deformed following the curvature of each folded portion of orifice plate. As a result, the residing bonding agent or sealant is not allowed to be the starting point of floating or peeling-off of the bonded surface after the orifice plate is bonded, hence making it possible to obtain the bonding effect of the orifice plate and the front face of head main body. With these functions, it is possible to secure the flatness of surface of the portion of the orifice plate bonded to the front edge face of head main body, that is, the flatness of the discharge port formation surface of liquid discharge recording head. In this way, it becomes possible to make the liquid discharge recording head smaller by equalizing the capping area on the discharge port formation surface with the area of surface of orifice plate, and also, to implement the enhancement of reliability with respect to the peeling-off of orifice plate when wiping operation is carried out. Further, with the smooth surface of orifice plate, the durability of wiping blade is enhanced, among some others, hence making it possible to materialize the liquid discharge recording head capable of making the life of the liquid discharge recording apparatus longer.

In the structure of the liquid discharge recording head described above where the orifice plate is folded along the edge portion of head main body, and then the orifice plate is bonded to the head main body, the portion that corresponds to the edge portion of head main body on the surface of orifice plate on the head main body side, that is, the inner folded portion of orifice plate, is provided with the grooves which are formed to be extended in the direction parallel to the edge portion of head main body, that is in the direction parallel to the fording ridge lines of orifice plate. In this manner, it becomes easier to fold the orifice plate, thus enhancing the productivity of liquid discharge recording heads. To describe more specifically, with the formation of such grooves on the orifice plate, the tension, which is exerted on the orifice plate entirely when the orifice plate is folded, is cut off with the portions where such grooves are formed as boundaries. As a result, when the orifice plate is bonded to the head main body, it becomes possible to reduce the tension exerted on the orifice plate which acts as repellent force on the circumference of the contact surface of orifice plate with the front edge face of head main body. Therefore, in the bonding process of orifice plate, it becomes possible to reduce the repellent force against bonding, such as waving or rolling created on the surface of the contact portion of orifice plate with the front edge face of head face. As a result, the flatness of surface of orifice plate, and the bonding strength on the bonding face on the backside thereof are enhanced accordingly. Here, in the case where the extrusions, which are inserted and fitted into the liquid flow paths of head main body, respectively, are formed on the circumference of discharge ports of orifice plate, it becomes easier to fit these extrusions into the liquid flow paths by the functions executable as described above. Further, by the effect obtainable by the arrangement of grooves, the shrinking stress exerted on the orifice plate due to thermal effect of bonding agent is caused to function mainly toward only inside the grooves with the result that the shrinking stress exerted on the edge portions of orifice plate can be reduced. In this way, it becomes possible to suppress drawback significantly, such as waving or rolling that may be created on the entire body of orifice plate along with the hardening shrinkage stress of bonding agent. Then, the orifice plate can be fixed on the three faces, the surface (front face), and both folded edge faces, and the orifice plate can be held to the head main body more firmly. As a result, the shearing strength of orifice plate is significantly enhanced against the external force exerted by the wiping blade or the like to make it possible to prevent the edge portions of orifice plate from being peeled off. Also, in the case of the structure where the orifice plate is folded as described above, flat area can be created on the surface of orifice plate, and as compared with the structure whereby to provide other member, such as front face plate, for the circumference of orifice plate, there is no possibility that stepping portions are formed on the surface of orifice plate, hence securing the flat area in the wider region thereon to provide the.wider capping area for the cap member. Further, with the flat face being formed on the entire region on the surface of orifice plate, it becomes possible to reduce residual liquid and wiping unevenness significantly when wiping operation is carried out. In addition, the flat wiping surface reduces the damage that may be caused to the blade, and contribute to enhancing the durability of blade, and the reliability of wiping as well. Also, when excimer laser processing or the like is used for forming the discharge ports or extrusions of orifice plate, such grooves are formed in one and the same step, hence making it possible to reduce the manufacturing costs of orifice plate significantly. Also, using excimer laser for processing the discharge ports, extrusions, or grooves on the orifice plate, it becomes possible to execute processing in excellent positional accuracy with excellent surface flatness, and to make the residual stress extremely small simultaneously. Therefore, with these functions, the freedom of designing the liquid discharge recording head is increased, and at the same time, it is implemented to make the liquid discharge recording head and liquid discharge recording apparatus smaller, and reduce the costs of manufacture in the same manner as described above. Also, it becomes possible to materialize the liquid discharge recording head which is capable of making the life of liquid discharge recording apparatus longer.

Meanwhile, regarding the bonding of orifice plate, extrusions are arranged per discharge port on the circumference of discharge ports on the backside of orifice plate, and the orifice plate is bonded to the head main body, while inserting the extrusions totally or partially into the liquid flow paths of head main body. Thus, extrusions check bonding agent to flow even if bonding agent spreads in the gap between the orifice plate and the front edge face of head main body when the orifice plate is pressurized to be in contact in order to connect the liquid passage with the discharge ports.

As a result, it becomes possible to suppress bonding agent to flow into the inner face of each discharge port or liquid flow path. Here, although bonding agent is allowed to flow into the gap between the outer circumference of each extrusion inserted into each liquid flow path and the inner face of liquid flow path, the bonding agent is checked to reside in the gap between the outer circumference of each extrusion and the inner face of each liquid flow path by the surface tension exerted therein, and the bonding agent is not allowed to advance any further in the depth direction. Moreover, with the bonding agent that resides in the gap portion between the outer circumference of each extrusion and the inner face of each liquid flow path, the bonding area of orifice place is increased to enhance the bonding strength of orifice plate as a whole. Further, even if the orifice plate is formed by the material which is different from material of the member that forms liquid flow paths, it becomes possible to physically check the movement of relative positions between discharge ports and liquid flow paths when bonding agent is in the curing process, because the extrusions of orifice plate are inserted into the liquid flow paths, respectively.

As described above, in accordance with the method of the present invention for manufacturing the liquid discharge recording head, it is possible to fold and fix the orifice plate to the head main body exactly when manufacturing the liquid discharge recording head structured to fold the orifice plate along the edge portions of the head main body and fix the orifice plate to the head main body, and also, it becomes easier to fold the orifice plate, thus producing effect on the enhancement of productivity of liquid discharge recording heads. Also, before the orifice plate is folded, the orifice plate is bonded to the front edge face of the head main body. Therefore, stress is exerted by the folding robustness of orifice plate when being folded, and the folded portions of orifice plate tend to be configured having a certain curvature R. However, the orifice plate is in contact with at least the front edge face of head main body and bonded thereto. As a result, it becomes possible to manufacture the liquid discharge recording head while maintaining the flatness of the surface of orifice plate. With this function, the flatness of surface of orifice is secured, and the liquid discharge recording head is made smaller by equalizing the capping area on the discharge port formation surface with the area of surface of orifice plate, hence implementing the enhancement of reliability with respect to the peeling-off of orifice plate when wiping operation is carried out. Further, with the smooth surface of orifice plate, the durability of wiping blade is enhanced, among some others, thus making it possible to materialize the liquid discharge recording head capable of making the life of the liquid discharge recording apparatus longer.

Seventeenth Embodiment

Figure 55:
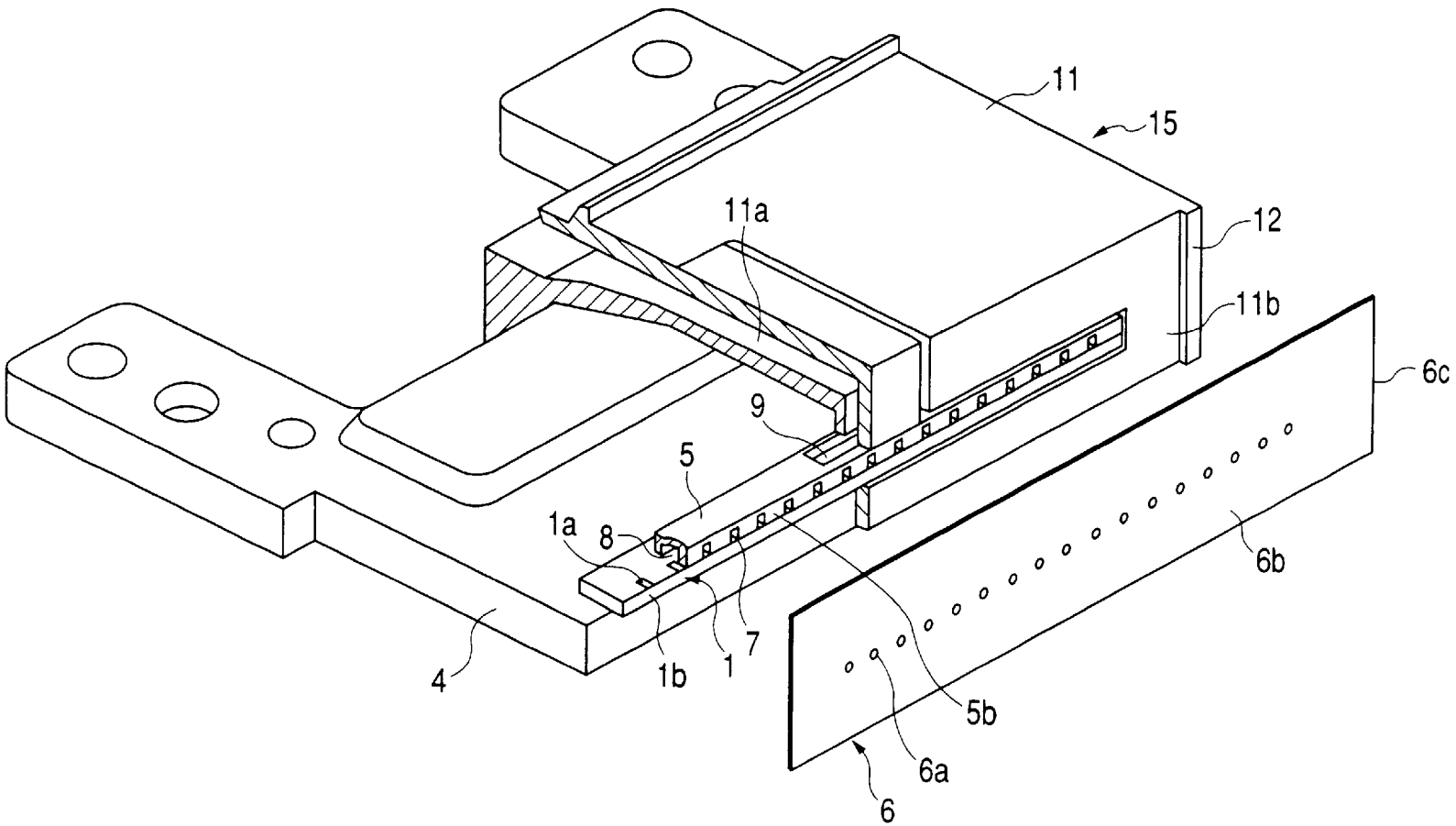
FIG. 55 is a perspective view which shows the liquid discharge recording head in accordance with a seventeenth embodiment of the present invention in a state where a part thereof is cut off, and also, in the state where the orifice plate is separated.
Figure 56:
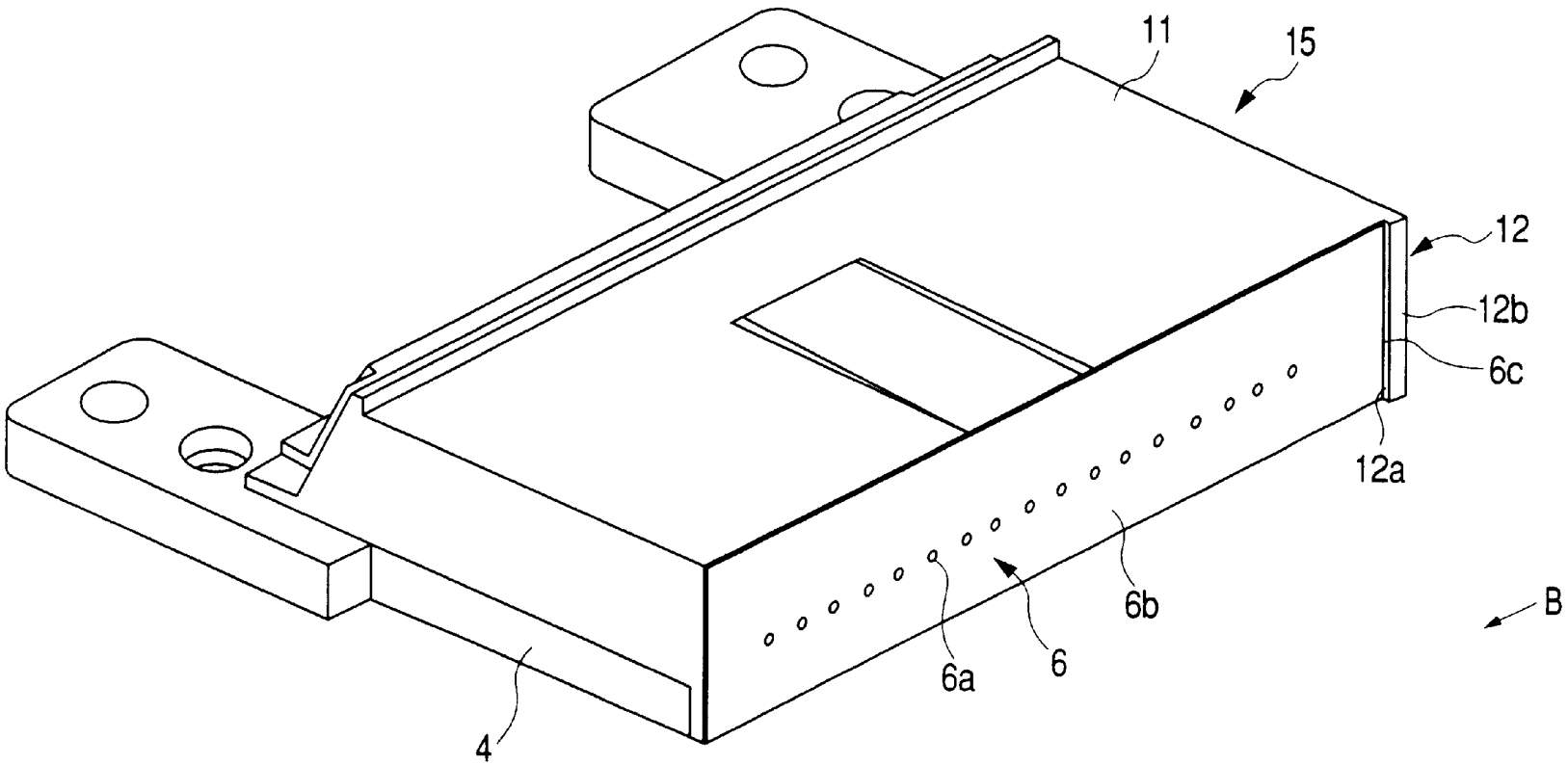
FIG. 56 is a perspective view which shows the liquid discharge recording head represented in FIG. 55 in the state where the orifice plate is bonded.

FIG. 55 is a perspective which shows the liquid discharge recording head in accordance with a seventeenth embodiment of the present invention in a state of partially broken, and also, in the state where the orifice plate is separated. FIG. 56 is a perspective view which shows the liquid discharge recording head represented in FIG. 55 in the state where the orifice plate is bonded.

For the liquid discharge recording head of the present embodiment, the heater board 1, which is provided with the electrothermal converting elements (discharge heaters 1*a*), namely, energy generating elements for discharging ink, and wiring to supply electric power to the discharge heaters 1*a* formed on a silicon base plate by means of silicon film formation process, is set by die bonding on the supporting base plate (base plate 4) formed by aluminum, ceramics, or the like. The base plate 4 functions as heat sink to radiate and cool heat generated along the driving of discharge heaters 1*a*.

On the heater board 1, the ceiling plate 5 is arranged to form ink flow paths. The ceiling plate 5 is provided with nozzles 7 constituting ink flow paths communicated with the discharge ports 6*a* of orifice plate 6, which are formed in recess on the bottom face of ceiling plate 5; the common liquid chamber 8 that functions as the sub-tank to supply ink to the nozzles 7 formed in recess on the bottom face of ceiling plate 5; and the ink supply port 9 through which ink is supplied to the common liquid chamber 8.

Further, on the base plate 4, the chip tank 11 is arranged to form ink passage 11*a* to conduct ink from the ink storage tank (not shown), sub-tank, or the like arranged on the upstream side of liquid discharge recording head 15 in the ink flow direction to the ink supply port 9.

On the surface where the nozzles 7 of chip tank 11 are open, the front plate portion 11*b* is formed. The front plate portion 11*b* functions to bond and hold the orifice plate 6 having the discharge ports 6*a* being open at the same intervals as those of nozzles 7 themselves on the outer circumferential area of the discharge ports 6*a*, and also, functions to support the orifice plate 6 so that the orifice plate 6 can withstand sufficiently the attaching or detaching force and pressure holding force exerted when the capping operation is carried out by the cap member (not shown) arranged for the recording apparatus main body.

On one edge of front plate portion 11*b*, there is provided the extrusion 12 which is arranged for the blade 21 (see FIG. 57) on the advancing side. Here, the structure is arranged so that when the wiping blade 21 advances onto the front plate portion 11, the blade 21 abuts against the extrusion 12 at first.

In this respect, the structure of liquid discharge recording head from which the orifice plate is removed is called "recording head main body" in the specification hereof.

The aforesaid ceiling pate 5 is formed by resin such as polysulfone, polyether sulfone, polypropylene, denatured polyphenylene oxide, polyphenylene sulfide, or liquid crystal polymer or by material such as ceramics, silicon, nickel, or carbon.

Also, the orifice plate 6 is formed by use of metallic plate, such as SUS (stainless steel), Ni, Cr, or Al, or a resin mold, resin film material, or the like, such as polyimide, polysulfone, polyether sulfone, polyphenylene oxide, polyphenylene sulfide, or polypropylene, or further by silicon, ceramics, or the like.

Next, the description will be made of the outline of liquid discharge recording head assembling process.

At first, the discharge heaters 1*a* on the heater board 1 set on the base plate 4, and the nozzles 7 of ceiling plate 5 that face them are aligned so that these are in agreement in high precision. After that, the heater board 1 and the ceiling plate 5 are closely bonded by means of bonding means such as bonding agent or pressure means such as pressure spring (not shown) to as to from ink flow paths (7;8;9).

Next, the chip tank 11 is incorporated on the base plate 4 to connect the ink supply port 9 of ceiling plate 5 with the ink passage 11*a* of chip tank 11. At this juncture, the front plate portion 11*b* of chip tank 11 covers the outer side of heater board front edge face 1*b* and the ceiling plate front edge face 5*b*. Here, the ink flow path edge faces 1*b* and 5*b* are structured to protrude form the surface of front face plate portion 11*b* by several tens to several hundreds of $\mu$m.

Next, the orifice plate 6 is bonded by bonding means, such as bonding agent, to the ink flow path edge faces 1*b* and 5*b* formed to protrude by means of heater board 1 and ceiling plate 5. Here, the surface of front plate portion 11*b* is retracted from the ink flow path edge faces 1*b* and 5*b* so as not to hinder bonding the orifice plate 6 to the ink flow path edge faces 1*b* and 5*b*.

In this respect, the precision of each component, and precision of bonding each member are set to make the distance between the inner wall face 12*a* of the extrusion 12 and the edge portion 6*c* of orifice plate to be 1 mm or less. Also, the ceiling face 12*b* of extrusion 12 is arranged to protrude from the facing end 6*b* of orifice plate. However, it is preferable to set the step between them at 1 mm or less. If such step becomes larger, the distance between the ink discharge surface and a recording medium becomes greater to result in a fear that ink impact precision is deteriorated.

Then, in the last process, bonding agent, sealant, or the like is poured into the gap (the stepped portion of several tens to several hundreds of $\mu$m between the front plate portion 11*b* and the ink flow path edge faces 1*b* and 5*b*) formed between the front plate portion 11*b* and the area on the backside of orifice plate 6 where no discharge ports 6*a* are formed, thus completing the bonding of orifice plate 6. In this manner, the assembling process of liquid discharge recording head 15 is completed.

Now, the wiping operation will be described.

Figure 57:
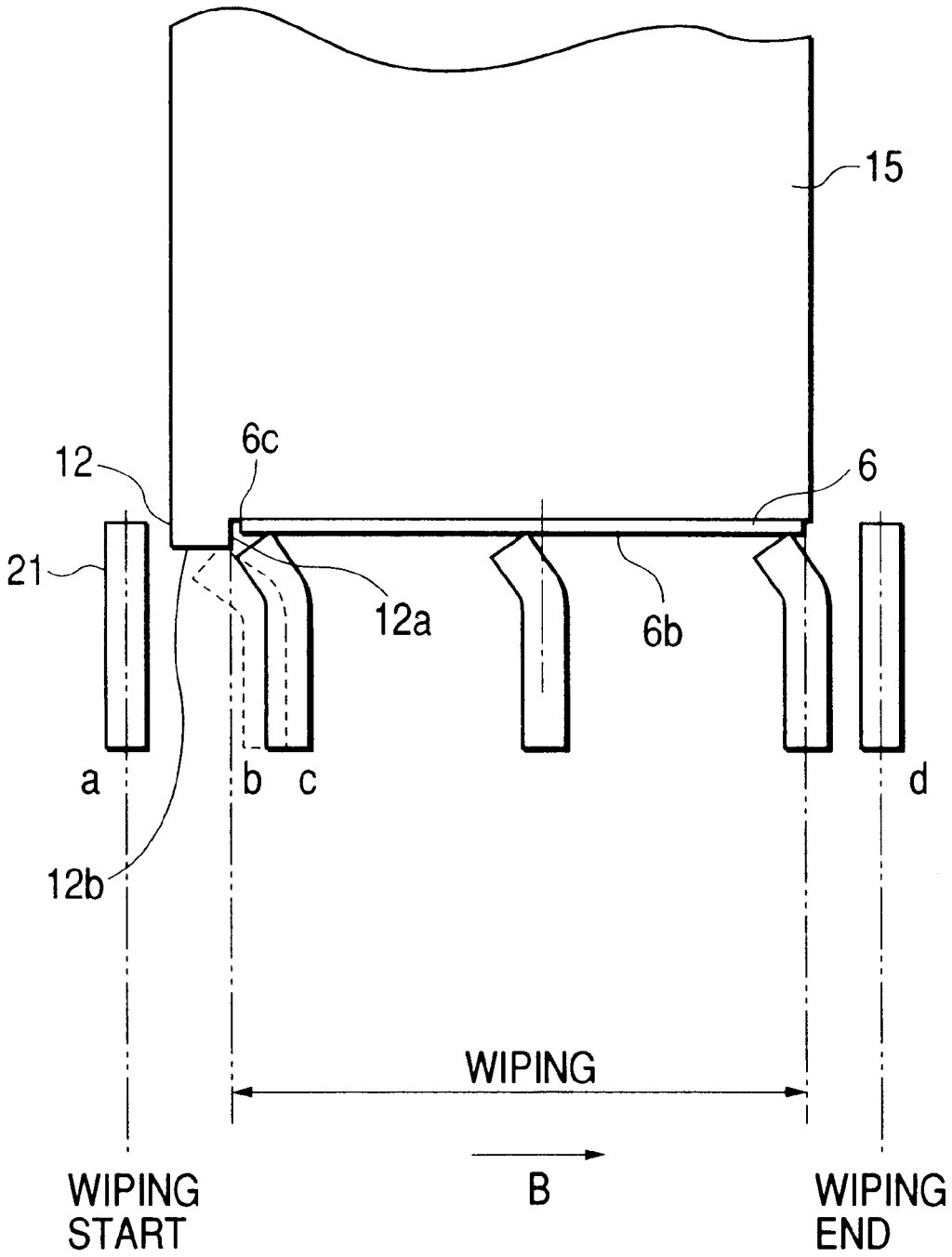
FIG. 57 is a view which schematically illustrates the wiping operation of a wiping blade.

FIG. 57 is a view which schematically illustrates the wiping operation of wiping blade.

Generally, the wiping blade 21 is formed by such material as rubber, elastomer so as to be provided with the resorting force to return to the original shape thereof by means of elastic recovery when the blade 21 is deformed. Also, if the width of wiping blade 21 is larger than the width of orifice plate 6 in the shorter direction or larger than the width of the front plate portion 11*b* in the shorter direction, there is created no region where the blade cannot rub slidably, thus performing the wiping operation effectively. Therefore, it is preferable to make the blade 21 larger than the wide of orifice plate 6 or front plate portion 11*b*.

In FIG. 57, each condition a, b, c, and d of the wiping blade 21 arranged for the recovery device of recording apparatus main body represents the initiation of wiping operation, on the way of passing the extruded portion, during wiping operation (beginning to advance onto the surface of orifice plate), and completion of wiping operation, respectively.

The wiping blade 21 moves in the direction indicated by an arrow mark B from the wiping operation initiating condition (condition a), and when the tip of the blade 21 abuts against the outer wall face of extrusion 21, the tip end of blade 21 slides to rub while being curved greatly along the ceiling face 12*b* of extrusion 12 (condition b). Then, when the wiping blade 21 further advances, the tip end of blade 21 advances onto the facing end 6*b* of orifice plate to slidably rut this surface.

As the facing end 6*b* of orifice plate is retracted from the extrusion ceiling face 12*b*, the tip end of blade 21 reduces along the step the amount of curving deformation by the elastic restoring force of its own immediately after having passed the extrusion 12, and then, slides to rub the facing end 6*b* of orifice plate (condition c).

In this manner, when the contact face of tip end of blade 21 is transferred from the extrusion ceiling face 12*b* to the facing end 6*b* of orifice plate, the blade 21 passes the contact surface having the step, and the tip end of the blade 21 is deformed rapidly in the moving direction by the restoring force thereof. As a result, the tip end of blade 21 jumps over the circumferential part of step eventually. Then, the edge portion 6*c* of orifice plate is arranged in the area where the tip end of blade 21 jumps over without contacting with such area, there is no possibility that the tip end of blade 21 hooks the edge portion 6*c* of orifice plate.

In this respect, as described above, the distance of the area that the blade 21 jumps over is determined by the material of blade 21 (elastic recovery force), the moving speed of blade 21, the relative heights of the extrusion ceiling end 12*b* and the orifice plate facing end 6*b*, among others. Also, the step between the extrusion ceiling end 12*b* and the orifice plate facing end 6*b* is set at 1 mm or less as described above. As a result, the tip portion of wiping blade 21 is not forcibly deformed to curve, and the change of states at the curved portion is effectuated smoothly in a short period of time.

As described above, the blade 21 that passes on the ceiling end 12*b* of extrusion 12 jumps over the vicinity of the edge portion 6*c* of orifice plate when it advances onto the orifice plate facing end 6*b*. Here, it is arranged to enable the tip of blade 21 maintain the curved configuration so that the blade 21 can press the orifice plate facing end 6*b* immediately at the landing point and begins wiping. Therefore, dust particles and ink adhering to the circumference of discharge ports 6*a* are removed reliably by the tip of wiping blade 21.

Then, when the wiping blade 21 has passed the orifice plate facing end 6*b* completely, the wiping blade 21 is restored to the original shape by the elastic recovery force of its own (condition d).

With a series of wiping operation described above, the orifice plate facing end 6*b* is cleaned to stabilize the ink discharges and obtain images in good condition.

In this respect, the corner between the extrusion inner wall 12*a* and the front plate portion 11*b* is positioned on the upstream of the starting point of cleaning. Thus, there is no possibility that the ink which adheres to the wiping blade 21 to be carried is not allowed to reside on this corner.

Also, there occurs on the orifice plate facing end 6*b* the remaining ink which flows out in the widthwise direction of the blade 21 and which is not completely removed when the wiping operation is executed, and the remaining ink or the like which cannot be removed by one-time wiping. However, in order not to allow these ink remainders to reside on the area outside the passage of blade 21, there are arranged no walls or extrusions or the like other than the extrusion 12 on the circumference of orifice plate 6, which protrude from the facing end 6*b* of orifice plate at all. Also, in order to enable the blade 21 to be bent uniformly over the entire area in the widthwise direction when the wiping blade 21 abuts against the extrusion 12 and caused to be bent, the structure is arranged to make the width of extrusion 12 larger than that of the blade 21 so that the blade 21 is allowed to be in contact with the extrusion 12 over the entire width thereof.

In this respect, the description has been made of the structure having one line discharge port array 6*a* arranged for the liquid discharge recording head in accordance with the present embodiment. However, the present invention is not limited to this structure. The invention is executable for the liquid discharge recording head having a plurality of discharge port arrays are arranged, and the same effect is obtainable.

Also, the moving direction of blade with respect to the discharge port array 6*a* is determined depending on the physical property of ink to be adopted, the parallel numbers of discharge port arrays, the distance between the adjacent discharge port arrays, and various other factors. As described above, it may be possible to arrange the structure so that the blade 21 moves along the discharge port array 6*a* or to arrange the structure so that the blade moves in the direction orthogonal to the discharge port array 6*a*. As to the latter structure, the detailed description will be made later in a nineteenth embodiment with reference to FIG. 62.

Figure 58:
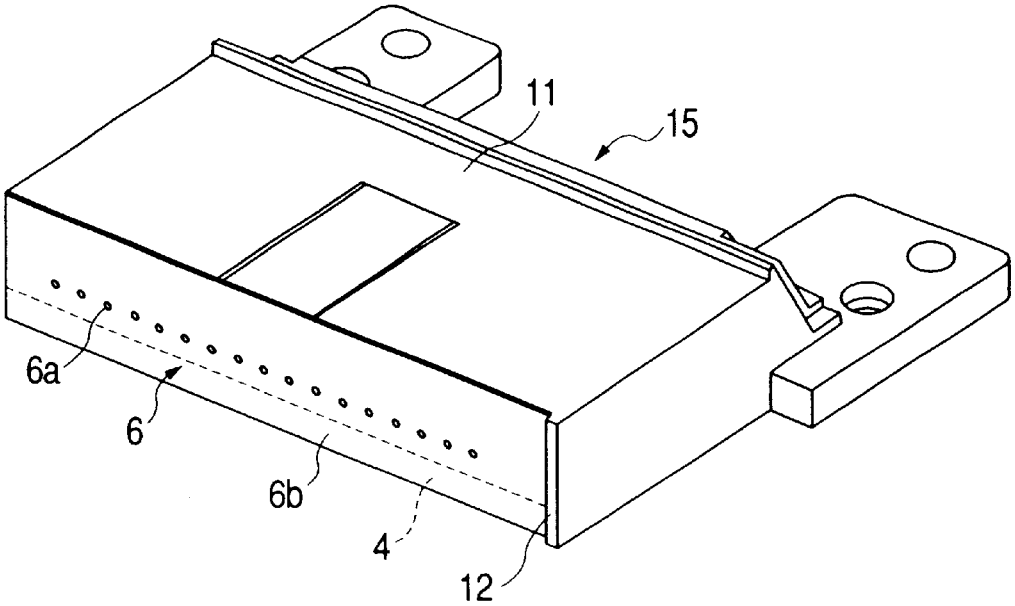
FIG. 58 is a perspective view which shows the variational example of the liquid discharge recording head represented in FIG. 55 and FIG. 56.

FIG. 58 is a perspective view which shows the variational example of the liquid discharge recording head represented in FIG. 55 and FIG. 56.

The liquid discharge recording head shown in FIG. 55 and FIG. 56 is structured to enable the front plate 11*b* of chip tank 11 to cover the front face of base plate 4, but not to cover both side faces of base plate 4.

Meanwhile, as the variational example shown in FIG. 58, it may be possible to arrange the structure so that the front plate 11*b* (not shown in FIG. 58) of chip tank 11 is not allowed to cover the front face of base plate 4, but to cover both side faces of base plate 4.

Eighteenth Embodiment

The present embodiment makes it possible for the blade to be deformed smoothly when the tip of blade abuts against the outer wall of extrusion to be bent at the initiation of wiping operation.

Figure 59:
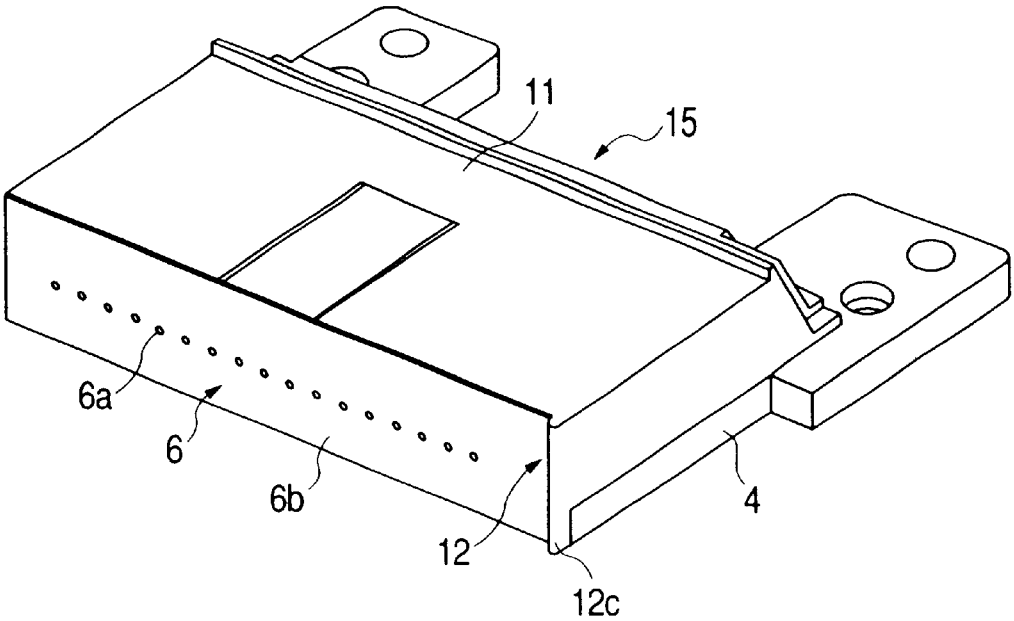
FIG. 59 is a perspective view which shows the liquid discharge recording head in accordance with an eighteenth embodiment of the present invention.

FIG. 59 is a perspective view which shows the liquid discharge recording head in accordance with an eighteenth embodiment of the present invention.

As shown in FIG. 59, a curved face portion 12*c* is formed on the ridge line portion where the ceiling end 12*b* of extrusion 12 and the outer wall face intersect. Here, the other structures of liquid discharge recording head of the present embodiment are the same as those of the liquid discharge recording head shown in FIG. 55 and the like, and the same reference marks are applied for description.

With the curved face thus formed on the ridge portion of extrusion 12, the tip of blade is gradually bent along such curved face. As a result, it becomes possible to reduce the load given to the tip of blade when it is bent, thus enhancing the durability of blade.

Figure 60:
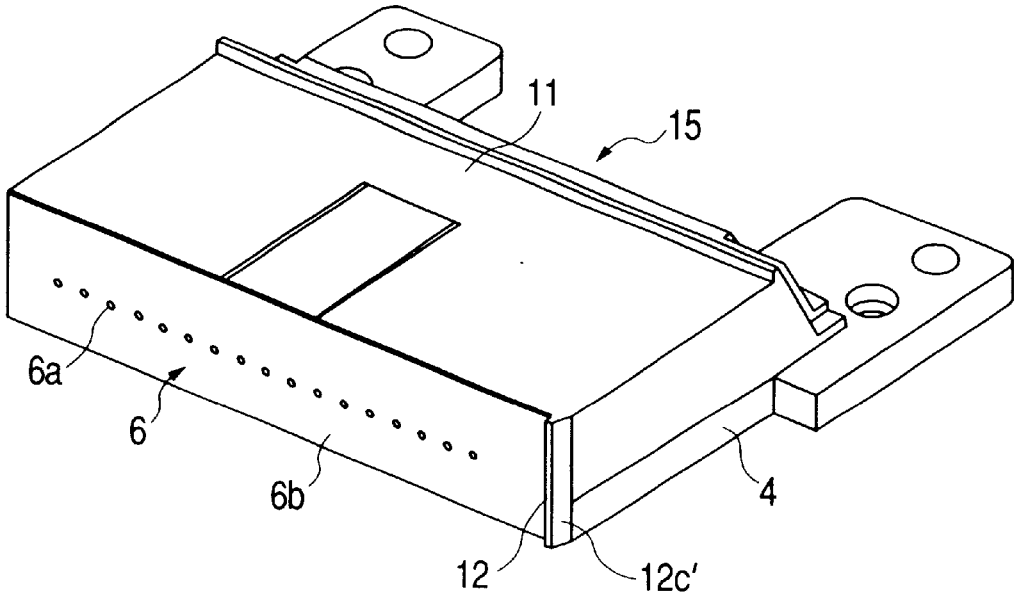
FIG. 60 is a perspective view which shows the variational example of the liquid discharge recording head represented in FIG. 59.
Figure 61:
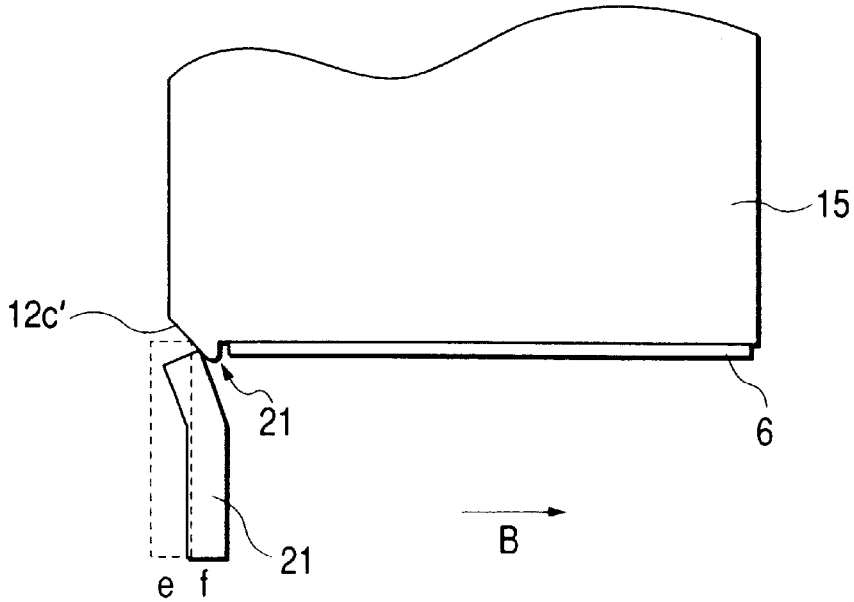
FIG. 61 is a view which schematically shows the wiping operation for the liquid discharge recording head represented in FIG. 60.

FIG. 60 is a perspective view which shows the variational example of the liquid discharge recording head represented in FIG. 59. FIG. 61 is a view which schematically shows the wiping operation for the liquid discharge recording head represented in FIG. 60.

As shown in FIG. 60, in accordance with this variational example, an inclined face 12*c*' is formed on the ridge line portion where the ceiling end 12*b* of extrusion 12 and the outer wall face intersect. The gradient of inclined face 12*c*' and the inclining position are set so that the ridge portion of blade tip abuts against the inclined face when the blade advances.

As shown in FIG. 61, when the wiping operation begins, the tip ridge portion of wiping blade 21 abuts against the inclined face 12*c*' of extrusion 12, and when the blade 21 further moves, the tip of blade 21 forms curve along the inclined face 12*c*'.

In other words, when the curve is formed, the tip of blade 21 is being deformed uniformly from the tip ridge portion to the foot portion along the inclined face 12*c*', but the blade 21 is not caused to be bent locally. Therefore, the load given to the tip of blade 21 is reduced to form a desired curving configuration. In this manner, the durability of blade 21 is enhanced significantly.

Nineteenth Embodiment

The structure of the aforesaid embodiment is that the wiping blade moves along the discharge port array. In accordance with the present embodiment, however, the blade moves in the direction orthogonal to the discharge port array.

Figure 62:
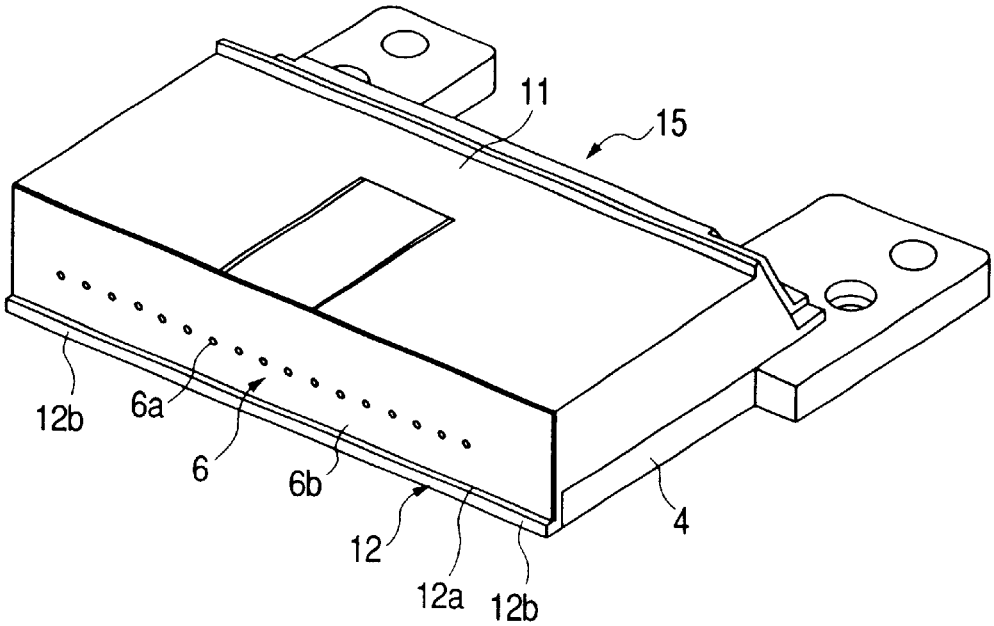
FIG. 62 is a perspective view which shows the liquid discharge recording head in accordance with a nineteenth embodiment of the present invention.

FIG. 62 is a perspective view which shows the liquid discharge recording head in accordance with a nineteenth embodiment of the present invention.

For the present embodiment, the extrusion 12 is arranged on one edge portion on the advancing side of blade 21 substantially in parallel with the discharge port array 6*a* on the front plate 11*b* (not shown in FIG. 62). Then, as in each of the embodiments described above, the structure is arranged so that no extrusions exist at all on the other three edge portions on the front plate 11*b*, which protrude from the orifice plate facing end 6*b*. Here, the other structures of liquid discharge recording head of the present embodiment are the same as those shown in FIG. 55 and the like, and the same reference marks are applied for description.

Thus, in accordance with the present embodiment, the ceiling end 12*b* of extrusion 12 protrudes from the orifice plate facing end 6*b*, and also, the extrusion 12 is arranged in parallel to the discharge port 6*a* array. Therefore, if the extrusion 12 is arranged in a length larger than the entire length of the discharge port 6*a* array, the extrusion 12 functions to prevent a recording medium from being in contact with the discharge ports 6*a* when a greatly curled recording medium passes through or a recording medium should be removed for jamming disposal.

As a result, there is no possibility that a recording medium gives damages to the circumference of discharge ports 6*a* or the quality of images is degraded due to ink on the circumference of discharge ports 6*a* being dragged, or it becomes possible to avoid such problem as creating ink remains that the wiping cannot deal with.

Here, it is of course preferable to arrange the extrusion 12 and the discharge port 6*a* group as close as possible in order to increase the effect to prevent the discharge port 6*a* group and recording medium from being slidably rubbed each other. If both of them are apart from each other, the extruding height of extrusion 12 should be made larger.

Twentieth Embodiment

Figure 63:
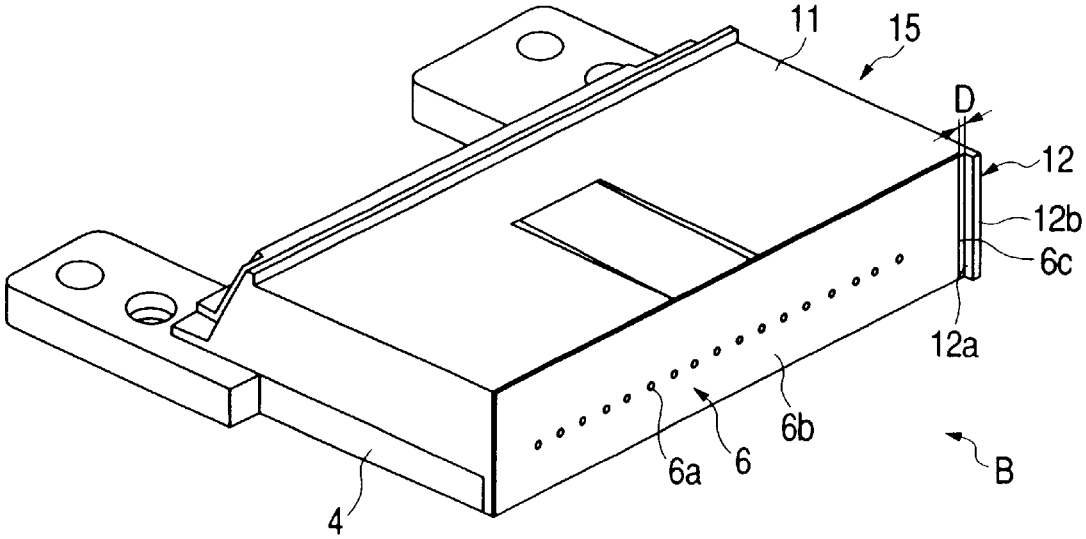
FIG. 63 is a perspective view which illustrates the problems of the liquid discharge recording head in accordance with each of the first to third embodiments.

FIG. 63 is a perspective view which illustrates the problems related to each liquid discharge recording head of the embodiments described above.

As described in the seventeenth embodiment, the orifice plate 6 is bonded to the ink flow path edge faces (1*b* and 5*b*. See FIG. 55). In this case, in order to keep each of the discharge ports 6*a* and each of the nozzles 7 to be in agreement, the mechanical alignment is performed in high precision. Then, if the edge portion 6*c* of orifice plate is allowed to part from the inner wall 12*a* of extrusion, it becomes easier for the blade tip to be in contact with the orifice plate edge portion 6*c*. Ideally, therefore, the relative positions of both of them should be in agreement. In other words, it is preferable to enable the orifice plate edge portion 6*c* to approach the inner wall 12*a* of extrusion closely.

However, the relative positions of both of them being affected by the precision of aforesaid alignment, the precision of components, the precision of bonding, and the like, it is extremely difficult to keep them in agreement. As a result, there is formed a gap D between the orifice plate edge portion 6*c* and the inner wall 12*a* of extrusion 12 (see FIG. 63).

Then, in such a case where the contact initiation point of the tip of blade is formed within the range of the gap D or ink mist reaches the range of gap D due to the blade material, the blade movement speed, the steps of extruded portion, or the like, remaining ink is allowed to reside in the gap D. It becomes extremely difficult to remove the ink reminders of the kind.

The present embodiment overcomes such problem as described above by filling bonding agent, sealant, or the like into the corners between the inner wall 12*a* of extrusion and the front plate 11*b*.

Figure 64:
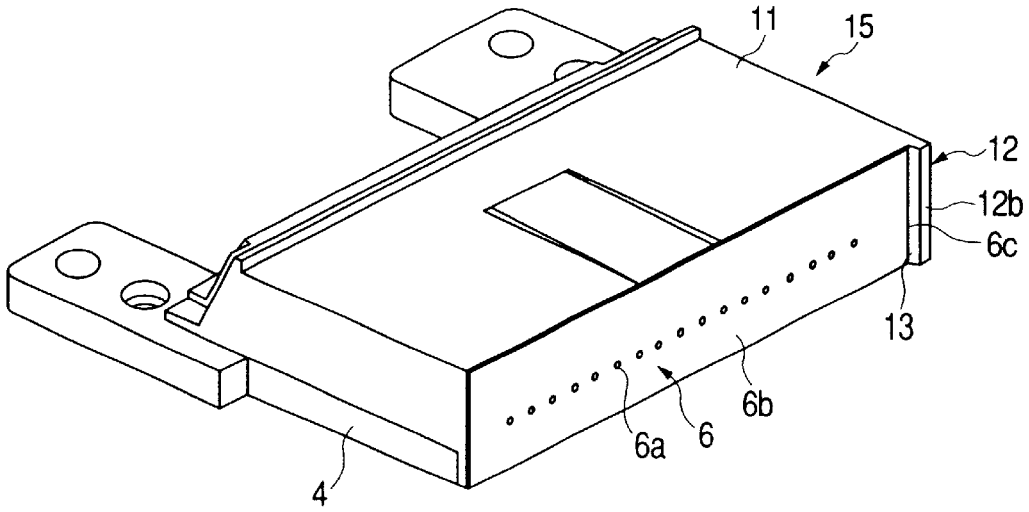
FIG. 64 is a perspective which shows the liquid discharge recording head in accordance with twentieth embodiment of the present invention.

FIG. 64 is a perspective view which shows the liquid discharge recording head in accordance with a twentieth embodiment of the present invention.

For the corners between the inner wall 12*a* of extrusion 12 and the front plate 11*b*, bonding agent (or sealant) 13 are filled, as shown in FIG. 64, so as to cover the corner portions and the orifice plate edge portion 6*c* completely. In this respect, the other structures of liquid discharge recording head of the present embodiment are the same as those of liquid discharge recording head shown in FIG. 55 or the like, and the same reference marks are applied for description.

As described above, in accordance with the present embodiment, the gap D is filled with bonding agent, sealant or the like with the result that the wiping blade slidably rubs the bonding agent 13 on the area of gap D, and even if ink spreads over the area of gap D, the wiping blade can remove it completely.

Also, bonding agent (sealant) 13 is coated along the inner wall 12*a* of extrusion 12 so that the coating height of bonding agent (sealant) 13 is not allowed to be beyond the height of ceiling end 12*b* of extrusion 12 greatly due to the capillary force of bonding agent (sealant) 13. For that matter, the control of coating process becomes easier, and the productivity is also becomes excellent.

Also, if the extrusion 12 has an appropriate robustness, the load given to the curving formation of blade tip does not affect bonding agent or sealant, thus making it possible to operate highly reliable wiping.

On the other hand, for the structure whereby to coat bonding agent or sealant for the purpose of protecting the orifice plate edge portion (sealing to cover the orifice plate edge portion for the protection thereof), the extrusion formed by such bonding agent or sealant functions to curve the blade tip. As a result, the load given to the bonding agent or sealant becomes greater to necessitate the bonding agent or sealant to increase the strength thereof. Consequently, the costs of liquid discharge recording cartridge is made higher inevitably.

Twenty-first Embodiment

The present embodiment makes it possible to enhance the cleaning accuracy by use of the wiping blade by arranging cleaning means using the blade on the upstream side of the extrusion in the advancing direction of the wiping blade.

Figure 65:
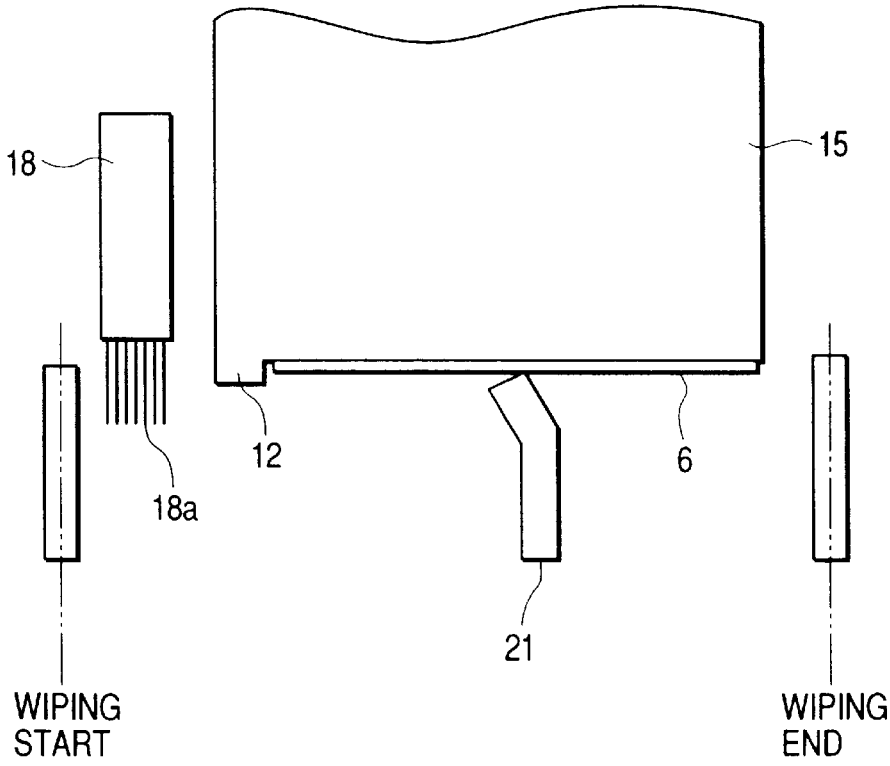
FIG. 65 is a view which schematically illustrates the structure of the liquid discharge recording head in accordance with the twenty-first embodiment of the present invention, and the wiping operation thereof.

FIG. 65 is a view which schematically illustrates the structure of liquid discharge recording head, as well as the wiping operation in accordance with a twenty-first embodiment of the present invention.

As shown in FIG. 65, there is arranged cleaning means 18 for the wiping blade 21 on the upstream side of the extrusion 12 in the advancing direction of wiping blade 21. Brushing portion 18*a* is provided for the tip of cleaning means 18. Here, the other structures of liquid discharge recording head of the present embodiment are the same as those shown in FIG. 55 or the like, and the same reference marks are applied for description.

When the wiping blade 21 moves at the time of initiating the wiping operation, the side face of blade 21 tip (wiping face) is caused to be rubbed by the brushing portion 18*a* of cleaning means 18 to remove ink and dust particles or the like adhering to the side face of blade 21 tip.

In this manner, the blade 21 is cleaned immediately after the wiping operation is started in accordance with the present embodiment. As a result, at the same time that the wiping capability of blade 21 is enhanced, the durability of blade 21 and the durability of orifice plate 6 are enhanced.

In this respect, cleaning means 18 may be arranged for the liquid discharge recording head 15 or arranged for the liquid discharge recording apparatus main body.

Twenty-second Embodiment

The present embodiment relates to the structure of extrusion when using the orifice plate where a plurality of discharge port arrays are arranged in parallel.

Figure 66:
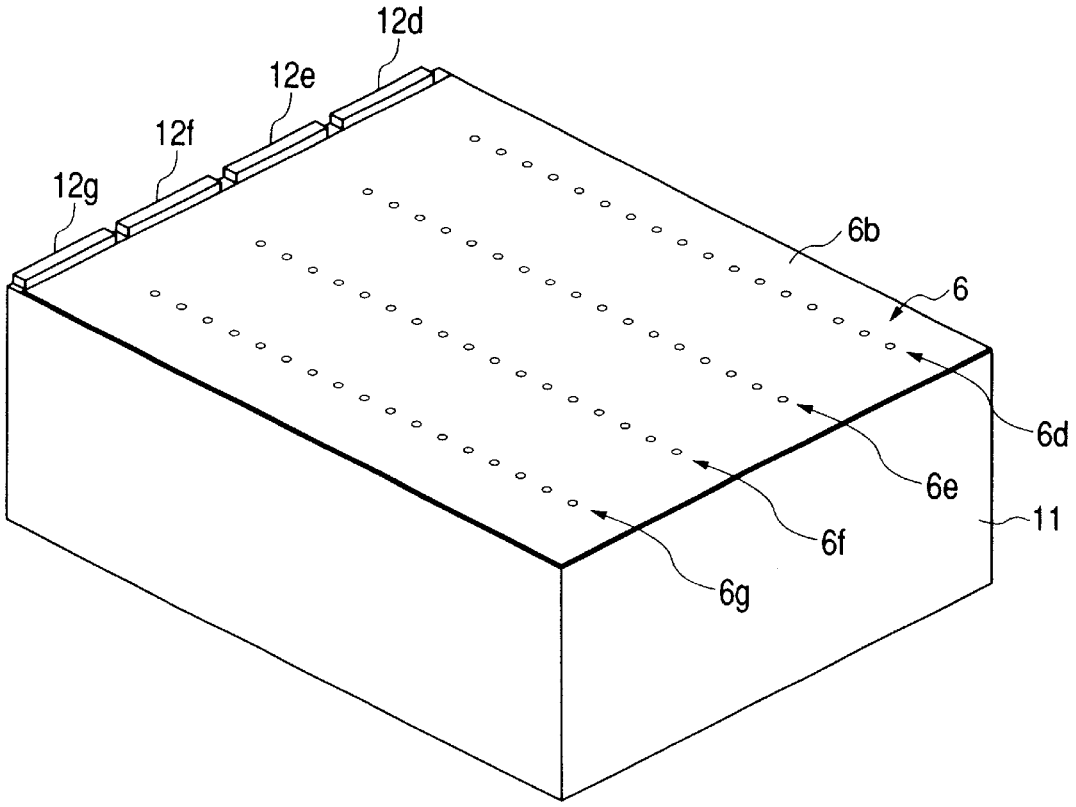
FIG. 66 is a perspective view which shows the liquid discharge recording head in accordance with the twenty-second embodiment of the present invention.
Figure 67:
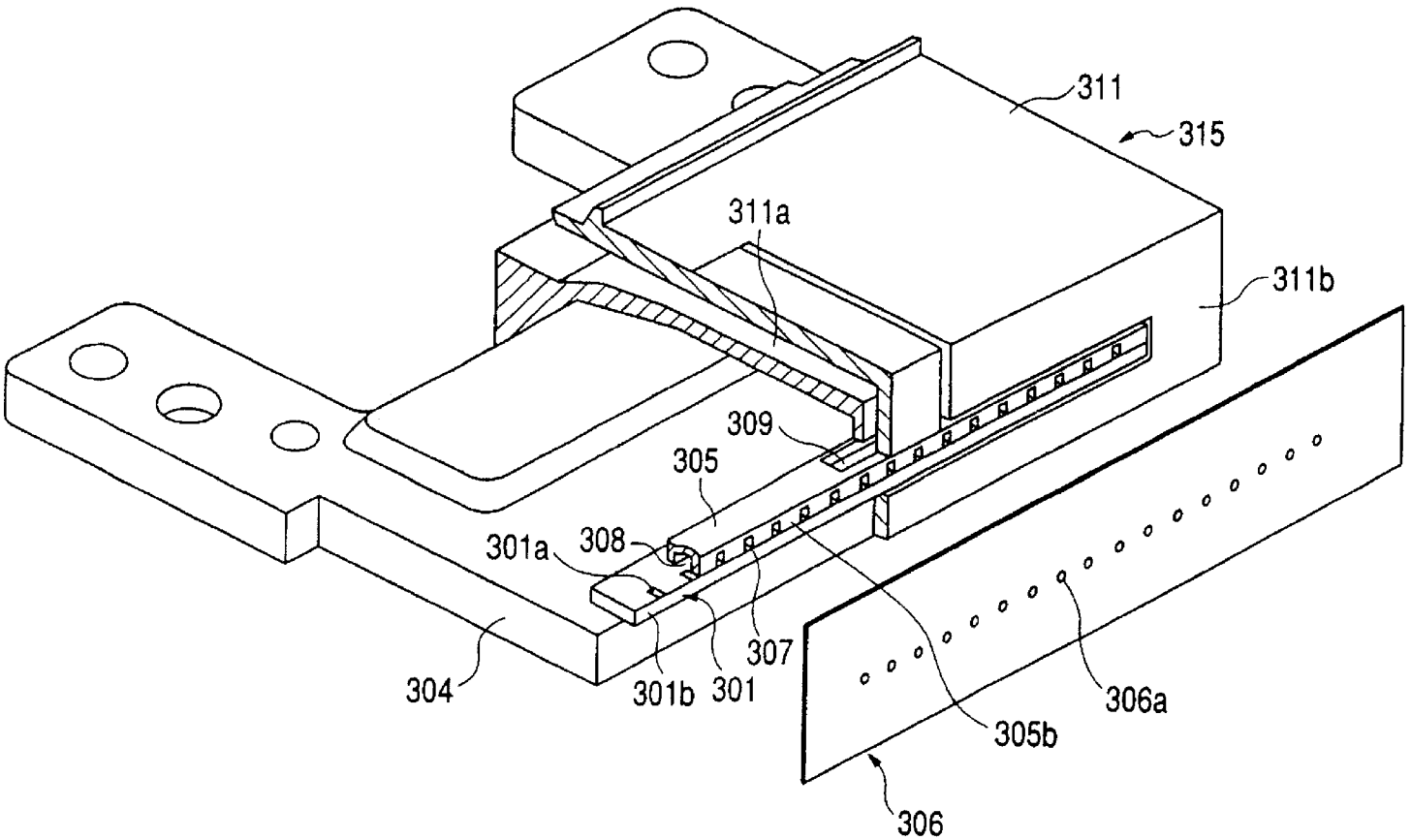
FIG. 67 PRIOR ART
FIG. 67 is a perspective view which shows the conventional liquid recording head in the state where a part thereof is cut off, and also, in the state where the orifice plate is separated.
Figure 68:
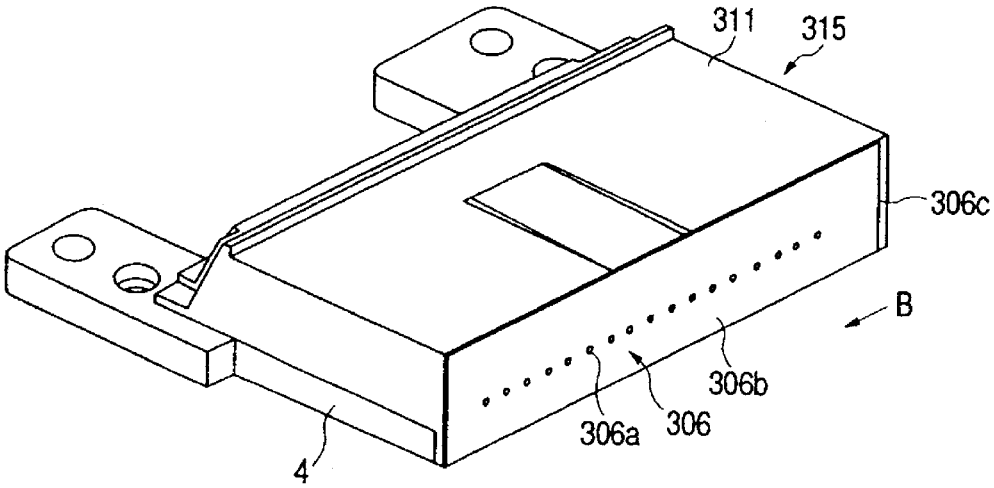
FIG. 68 PRIOR ART
FIG. 68 is a perspective view which shows the liquid discharge recording head represented in FIG. 67 in the state where the orifice plate is bonded.

FIG. 66 is a perspective view which shows the liquid discharge recording head in accordance with a twenty-second embodiment of the present invention.

The liquid discharge recording head of the present embodiment is structured to discharge plural kinds of ink, and the ink flow paths and nozzles are provided per kind of ink. Then, the orifice plate 6 is also formed corresponding to the nozzles of each color, and a plurality of discharge port arrays 6*d*, 6*e*, 6*f*, and 6*g* are formed in parallel.

Also, one edge on the front plate (not shown) is provided with extrusions 12*d*, 12*e*, 12*f*, and 12*g* corresponding to the discharge port arrays 6*d*, 6*e*, 6*f*, and 6*g*, respectively. Each of the extrusion 12*d*, 12*e*, 12*f*, and 12*g* is formed in the state of being cut off from each other.

Also, the wiping blades (not shown) are arranged individually corresponding to each of the discharge port arrays 6*d*, 6*e*, 6*f*, and 6*g*, respectively.

In this respect, the other structures of liquid discharge recording head of the present embodiment are the same as those shown in FIG. 55 or the like, and the same reference marks are applied for description.

In this manner, each of discharge port arrays 6*d*, 6*e*, 6*f*, and 6*g* is arranged corresponding to each of the extrusions 12*d*, 12*e*, 12*f*, and 12*g*, respectively, and the wiping blades are arranged each individually. As a result, there is no fear that the ink, which is transferred by the blade to adhere to each of the extrusions, is not allowed to be mixed with ink of the adjacent discharge port array even if the blade operation is repeated.

Also, in accordance with the present embodiment, unlike the mode in which the extrusions and wiping blades are integrally formed, it becomes possible to narrow the width of each blade in the widthwise direction. Therefore, the moving range of ink in the widthwise direction of blade is made narrower to make it difficult to cause color mixture by different kind of adjacent ink. Thus, wiping is possible with higher reliability.

In this respect, the description has been made of the example in which the extrusions and blades are provided each individually with respect to each of the discharge port arrays. The present invention, however, is not limited to such structure. It may be possible to provide the extrusions and blades individually corresponding to the discharge port array group that discharge ink of one and the same kind.

In accordance with the seventeenth to twenty-second embodiments, the liquid discharge recording head is provided with the extrusion, which protrudes from the facing end of orifice plate in the vicinity of the edge portion of orifice plate on the front face of recording head main body on the upstream side in the advancing direction of wiping blade. Then, when the wiping blade moves in the advancing direction at the time of starting the wiping operation, the wiping blade abuts against the extrusion to bend the tip end of blade. At this juncture, on the blade, elastic recovery force is exerted so that it tends to return from the condition of curved deformation to the original configuration. As a result, with further movement of wiping blade in the advancing direction, the edge portion of wiping blade jumps over the orifice plate edge portion and abuts against the facing end of orifice plate. Therefore, the wiping blade is not allowed to hook the edge portion of orifice plate, and arrives at the facing end of orifice plate. Here, when the blade arrives at the facing end of orifice plate, the blade is restored to make the amount of curved deformation of the tip end smaller. However, the curved condition is maintained as it is. Thus, the wiping performance is not deteriorated in the process where the facing end of orifice plate is being wiped by means of the blade.

In this manner, the present embodiment makes it possible to prevent the orifice plate from being peeled off by wiping operation, and at the same time, to implement the enhancement of the durability of blade. Further, it is possible to carry out the wiping operation reliably on the facing end of orifice plate with such simple and inexpensive structure.

Moreover, the extrusion is arranged to protrude from the facing end of orifice plate, and when a greatly curled recording medium passes or the jamming disposition is carried out for the liquid discharge recording apparatus, and the recording medium tends to be in contact with the discharge ports, it becomes possible for the extrusion check the contact between both of them. As a result, there is no possibility that the circumference of discharge ports is damaged or the recording medium is allowed to drag liquid around the discharge ports. In this way, it becomes possible to avoid such problem as to allow liquid to remain on the facing end of orifice plate or to degrade the quality of prints on the recording medium.

Also, with the arrangement of the structure in which no extrusion that protrudes from the facing end of orifice plate exist on the front face of recording head main body with the exception of the vicinity of edge portion of orifice plate on the upstream side in the advancing direction of wiping blade, it becomes possible to eliminate any corner portion where liquid remains after wiping in the advancing direction of blade even if the blade left liquid yet to be wiped when the wiping operation is carried out. As a result, such liquid still remains after wiping can be wiped off by means of blade in the next wiping operation and on.

Further, with the arrangement of the structure in which a gap is formed between the inner wall of extrusion on the downstream side in the advancing direction of wiping blade, and the edge portion of orifice plate, and then, bonding agent or sealant is filled in such gap, the steps formed by the ceiling end of extrusion and the facing end of orifice plate are connected smoothly. In this manner, the wiping blade abuts against the extrusion, and the curved tip end of blade is gradually deformed to be recovered along this filled portion, thus reducing the load exerted when the tip end of blade is bent. The durability of blade is also enhanced. Moreover, it becomes possible to prevent liquid to reside in the gap between the inner wall of extrusion and the edge portion of orifice plate. Thus, there is no fear that the liquid that may have resided in this gap should flow out by some reason to the facing end of orifice plate to produce unfavorable effect on the discharge performance.

Furthermore, the structure is arranged so that the curved face or inclined face is formed on the ridge portion where the outer wall of extrusion in the advancing direction of wiping blade, and the ceiling end of extrusion intersect, and when the blade tip end abuts against the outer wall face of extrusion, the blade is deformed gradually from the tip end to the foot portion. In this manner, the blade tip end is not forcibly deformed but it is allowed to form a desired curving configuration. As a result, the load given to the blade is reduced to enhance the durability of blade significantly, and also, an efficiently good cleaning is made executable.

It is preferable to arrange the structure of the aforesaid curved face or inclined face so that the end face of wiping blade abuts against such face when the wiping blade begins to move in the advancing direction of wiping blade.

Further, it may be possible to arrange the structure so that the width of extrusion in the direction orthogonal to the advancing direction of wiping blade is formed larger than the wide of wiping blade, and that the wiping blade is allowed to be in contact with the extrusion on the entire width thereof. In this manner, when the wiping blade is curved by contacting with the extrusion, it becomes possible for the blade to be curved uniformly over the entire area in the widthwise direction.

Also, with the arrangement of structure in which cleaning means is arranged on the upstream side of the extrusion in the advancing direction of wiping blade for cleaning the wiping face of wiping blade, it becomes possible to clear the tip end of blade when wiping operation begins. Thus, the wiping performance and the durability of wiping blade are enhanced significantly.

As described above, in accordance with the present invention, the orifice plate has extended portions which extend more than the width of the front face of recording head main body in the alignment direction of discharge port array or in the direction orthogonal to that direction, and the extended portions are fixed to the adjacent faces to the front face of recording head main body. Therefore the fixing strength of orifice plate is increased with respect to the recording head, hence making it possible to prevent the edge portions of orifice plate from being peeled off by means of wiping blade.

Further, the orifice plate is provided with the area almost the same as the front face of recording head, and therefore the capping area can be made wider to perform the suction recovery operation reliably without using any complicated capping mechanism. As a result, it is possible to suppress and make the costs of recording apparatus lower.

Furthermore, the entire face of orifice plate is made flat to reduce the remaining liquid, wiping unevenness, or the like significantly when wiping operation is carried out by use of blade. Also, the damage that may be caused to the blade can be reduced, thus enhancing the reliability of wiping operation.

As described above, in accordance with the present invention, the freedom of designing recording head is increased to promote making the recording head and the recording apparatus itself smaller, as well as to promote the cost reduction. Also, it becomes possible to provide a liquid discharge recording head the life of which is designed to be longer.

What is claimed is:

1. A liquid discharge recording head comprising:

a recording head main body provided with openings for a plurality of discharge ports for discharging liquid; and an orifice plate comprising a face portion provided with said plurality of discharge ports forming a discharge port array, wherein said orifice plate is provided with an extended portion in an alignment direction of said discharge port array or in a direction orthogonal to the alignment direction, said extended portion being extended more than a thickness of a front face of said recording head main body, and said extended portion is fixed to a face of said recording head main body adjacent to said front face by being placed between a fixing member to be fixed to said recording head main body and said adjacent face.

2. A liquid discharge recording head according to claim 1, wherein said extended portion of said orifice plate is fixed by bonding or welding to said adjacent face.

3. A liquid discharge recording head according to claim 1, wherein an extrusion is provided for said adjacent face, and said extended portion is in a state of riding over said extrusion.

4. A liquid discharge recording head according to claim 3, wherein a pressure plate for pressing said extended portion is arranged behind said extrusion on said extended portion, which is in contact with said adjacent face.

5. A liquid discharge recording head according to claim 4, wherein said extended portion is put between said extrusion and said pressure plate.

6. A liquid discharge recording head according to claim 1, wherein an edge portion of said orifice plate is bonded to a face different from a front edge face of said head main body and, on an edge portion of said front face and said adjacent face, a cut-off portion is formed to be extended along said edge portion of said front face and said adjacent face.

7. A liquid discharge recording head according to claim 6, wherein said cut-off portion is formed on said edge portion of said front face and said adjacent face to configure said edge portion of said front face and said adjacent face to be in a stepped form.

8. A liquid discharge recording head according to claim 6, wherein said orifice plate is also bonded to said front edge face of said head main body, and a line connecting said face portion of said orifice plate and said extended portion of said orifice plate is disposed away from an edge of said front face of said head main body by a designated distance.

9. A liquid discharge recording head according to claim 6, wherein said orifice plate is bonded to only said face different from said front edge face of said head main body, and a line connecting said face portion of said orifice plate and said extended portion of said orifice plate is disposed a distance away from an edge of said front edge face of said head main body.

10. A liquid discharge recording head according to claim 1, wherein a surface of an edge portion of said front face and said adjacent face is made a curved face.

11. A liquid discharge recording head according to claim 10, wherein said orifice plate is bonded to said front face, and said orifice plate is in contact with said surface of said edge portion of said front face and said adjacent face.

12. A liquid discharge recording head according to claim 11, wherein said orifice plate is bonded to only a face different from a front edge face of said head main body, and said orifice plate is in contact with said surface of said edge portion of said front face and said adjacent face.

13. A liquid discharge recording head according to claim 10, wherein said orifice plate is bonded to a front edge face of said head main body, and a line connecting said face portion of said orifice plate and said extended portion of said orifice plate is disposed away from an edge of said front face of said head main body by a designated distance.

14. A liquid discharge recording head according to claim 10, wherein said orifice plate is bonded to only a face different from a front edge face of said head main body, and a line connecting said face portion of said orifice plate and said extended portion of said orifice plate is disposed a distance away from an edge of said front edge face of said head main body.

15. A liquid discharge recording head according to claim 1, wherein an edge portion of said front face and the said adjacent face is chamfered.

16. A liquid discharge recording head according to claim 15, wherein said orifice plate is bonded to said front face, and said orifice plate is in contact with a surface of said edge portion of said front face and said adjacent face.

17. A liquid discharge recording head according to claim 16, wherein said orifice plate is bonded to only a face different from a front edge face of said head main body, and said orifice plate is in contact with said surface of said edge portion of said front face and said adjacent face.

18. A liquid discharge recording head according to claim 15, wherein said orifice plate is bonded to a front edge face of said head main body, and a line connecting said face portion of said orifice plate and said extended portion of said orifice plate is disposed away from an edge of said front face of said head main body by a designated distance.

19. A liquid discharge recording head according to claim 15, wherein said orifice plate is bonded to only a face different from a front edge face of said head main body, and a line connecting said face portion of said orifice plate and said extended portion of said orifice plate is disposed a distance away from an edge of said front edge face of said head main body.

20. A liquid discharge recording head according to claim 1, wherein the an edge portion of said orifice plate is bonded to a face different from a front edge face of said head main body, and a groove extending in a direction parallel to said edge portion is formed on at least a part of a portion facing said edge portion on a face of said orifice plate on the head main body side.

21. A liquid discharge recording head according to claim 20, wherein said groove of said orifice plate is divided into plural grooves.

22. A liquid discharge recording head according to claim 20, wherein a side wall face in said groove of said orifice plate is inclined toward a bottom face of said groove.

23. A liquid discharge recording head according to claim 20, wherein a sectional shape of said groove is in a wedge form in a direction perpendicular to a longitudinal direction of said orifice plate.

24. A liquid discharge recording head according to claim 20, wherein said groove of said orifice plate is formed in a position excluding two other edge portions of said orifice plate.

25. A liquid discharge recording head according to claim 20, wherein said orifice plate is adhesively bonded to said front edge face of said head main body.

26. A liquid discharge recording head according to claim 1, wherein said head main body is provided with an element substrate having an energy generating element arranged therefor, a ceiling plate laminated onto said element substrate, and a chip tank fixed to the laminated combined body of said element substrate and said ceiling plate, and a front face of said head main body is a front plate portion of said chip tank, and a wall face of said head main body is a side face of said chip tank.

27. A liquid discharge recording apparatus for recording on a recording medium by discharging liquid to the recording medium for adhesion of the liquid to the recording medium, comprising:

a liquid discharge recording head according to any one of claims 1 and 2 to 26; and a cap member for airtightly closing an area including said discharge ports on a discharge port formation surface having said discharge ports positioned thereon for said liquid discharge recording head.

28. A liquid discharge recording apparatus for recording on a recording medium by discharging liquid to the recording medium for adhesion of the liquid to the recording medium, comprising:

a liquid discharge recording head according to any one of claims 1 and 2 to 26; and a wiping blade for cleaning a discharge port formation surface by wiping said discharge port formation surface having said discharge ports positioned for said liquid discharge recording head.

29. A liquid discharge recording apparatus comprising:

an orifice plate having on a face thereof a discharge port array provided with a plurality of discharge ports for discharging liquid;

a recording head main body provided with openings for said plurality of discharge ports, respectively:

a liquid discharge recording head having said orifice plate bonded to a face of said recording head main body having said openings; and a wiping blade for wiping said face of said orifice plate of said liquid discharge recording head by moving relatively in a state of being in contact with said face, wherein an extrusion is provided to protrude from said face of said orifice plate in the vicinity of an edge portion of said orifice plate on the upstream side in the advancing direction of said wiping blade, said orifice plate is provided with an extended portion in an alignment direction of said discharge port array or in a direction orthogonal to the alignment direction, said extended portion being extended more than a thickness of a front face of said recording head main body, and said extended portion is fixed to a face of said recording head main body adjacent to said front face by being placed between a fixing member to be fixed to said recording head main body and said adjacent face.

* * * * *

UNITED STATES PATENT AND TRADEMARK OFFICE

CERTIFICATE OF CORRECTION

PATENT NO. : 6,652,062 B2
DATED : November 25, 2003
INVENTOR(S) : Mikiya Umeyama et al.

It is certified that error appears in the above-identified patent and that said Letters Patent is hereby corrected as shown below:

Column 3,
Line 19, "ultimately. In" should read -- ultimately. ¶ In --; and
Lines 23 and 27, "where" should read -- which --.

Column 4,
Lines 1 and 11, "rubbed" should read -- rubbed against --; and
Line 33, "face" should read -- faces --.

Column 7,
Line 33, "on" should read -- an --.

Column 8,
Line 25, "perspective" should read -- perspective view --.

Column 10,
Line 66, "111a," should read -- 101a, --.

Column 11,
Line 14, "to fixe" should read -- to affix --.

Column 13,
Line 18, "harding" should read -- hardening --.

Column 21,
Line 12, "necessities" should read -- necessitates --;
Line 22, "form" should read -- from --; and
Lines 65 and 67, "lie" should read -- 11e --.

Column 23,
Line 10, "polypropylene" should read -- polypropylene- --; and
Line 57, "boding" should read -- bonding --.

Column 26,
Line 22, "alignment-direction" should read -- alignment direction --.

UNITED STATES PATENT AND TRADEMARK OFFICE

CERTIFICATE OF CORRECTION

PATENT NO. : 6,652,062 B2
DATED : November 25, 2003
INVENTOR(S) : Mikiya Umeyama et al.

It is certified that error appears in the above-identified patent and that said Letters Patent is hereby corrected as shown below:

Column 28,
Line 21, "o" should read -- of --;
Line 51, "such" should read -- such a --; and
Line 52, "simple." should read -- simple, --.

Column 31,
Line 3, "A Next," should read -- Next, --; and
Line 12, "form" should read -- from --.

Column 32,
Line 14, "46J" should read -- 46j --;
Line 32, "curves" should read -- curved --;
Line 43, "face" should read -- faces --;
Line 57, "fixe" should read -- fix --; and
Line 59, "As" should read -- As for --.

Column 33,
Line 33, "close" should read -- closes --; and
Line 41, "highly" should read -- of high --.

Column 34,
Line 20, "it" should read -- It --.

Column 35,
Line 18, "wight" should read -- weight --.

Column 36,
Line 4, "such" should read -- such a --; and
Line 54, “represent” should read -- represented --.

Column 39,
Line 23, "61" should read -- 6j --.

Column 40,
Line 23, "fording" should read -- folding --; and
Line 66, "other" should read -- another --.

UNITED STATES PATENT AND TRADEMARK OFFICE

CERTIFICATE OF CORRECTION

PATENT NO. : 6,652,062 B2
DATED : November 25, 2003
INVENTOR(S) : Mikiya Umeyama et al.

It is certified that error appears in the above-identified patent and that said Letters Patent is hereby corrected as shown below:

Column 41,
Line 3, "the.wider" should read -- the wider --.

Column 42,
Line 24, "perspective" should read -- perspective view --.

Column 43,
Line 29, "to as to from" should read -- so as to form --; and
Line 36, "form" should read -- from --.

Column 44,
Line 26, "rut" should read -- rub --; and
Line 58, "maintain" should read -- to maintain --.

Column 45,
Line 1, "operation" should read -- operations --.

Column 48,
Line 7, "is" should be deleted.

Column 49,
Line 4, "extrusion" should read -- extrusions --; and
Line 26, "kind" should read -- kinds --.

Column 50,
Line 4, "check" should read -- to check --;
Lines 9, 27 and 53, "such" should read -- such a --;
Line 37, "by" should read -- for --; and
Line 58, "wide of" should read -- width of the --.

Column 52,
Line 54, "the said" should read -- said --.

UNITED STATES PATENT AND TRADEMARK OFFICE

CERTIFICATE OF CORRECTION

PATENT NO. : 6,652,062 B2
DATED : November 25, 2003
INVENTOR(S) : Mikiya Umeyama et al.

It is certified that error appears in the above-identified patent and that said Letters Patent is hereby corrected as shown below:

Column 53,
Line 12, "the an" should read -- an --.

Column 54,
Lines 2 and 12, "1 and 2 to 26;" should read -- 1 to 26; --; and
Line 23, "respectively:" should read -- respectively; --.

Signed and Sealed this

Twenty-eighth Day of December, 2004

JON W. DUDAS
*Director of the United States Patent and Trademark Office*